US009843121B1

(12) United States Patent
Sparrowhawk et al.

(10) Patent No.: US 9,843,121 B1
(45) Date of Patent: Dec. 12, 2017

(54) COMMUNICATION CONNECTOR HAVING CONTACT PADS CONTACTED BY MOVABLE CONTACT MEMBERS

(71) Applicant: Leviton Manufacturing Co., Inc., Melville, NY (US)

(72) Inventors: Bryan L. Sparrowhawk, Monroe, WA (US); Hua Wang, Mill Creek, WA (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 15/245,060

(22) Filed: Aug. 23, 2016

(51) Int. Cl.
*H01R 13/187* (2006.01)
*H01R 24/64* (2011.01)
*H01R 107/00* (2006.01)

(52) U.S. Cl.
CPC ..... *H01R 13/187* (2013.01); *H01R 24/64* (2013.01); *H01R 2107/00* (2013.01)

(58) Field of Classification Search
CPC .. H01R 13/187; H01R 24/64; H01R 2107/00; H01R 4/52; H01R 4/48; H01R 13/71
USPC ..... 439/676, 743, 786, 788, 862
See application file for complete search history.

(56) References Cited

U.S. PATENT DOCUMENTS

| | | | | |
|---|---|---|---|---|
| 6,786,776 | B2 * | 9/2004 | Itano | H01R 13/193 439/676 |
| 7,427,218 | B1 * | 9/2008 | Hashim | H05K 1/0228 439/676 |
| 8,790,139 | B2 * | 7/2014 | Fitzpatrick | H01R 13/15 439/676 |
| 2016/0211627 | A1 * | 7/2016 | Planard-Luong | H01R 13/521 |

* cited by examiner

*Primary Examiner* — R S Luebke
*Assistant Examiner* — Paul Baillargeon
(74) *Attorney, Agent, or Firm* — Davis Wright Tremaine LLP; George C. Rondeau, Jr.; Heather M. Colburn

(57) ABSTRACT

A communication outlet for use with a communication plug comprising a plurality of plug contacts. The outlet includes contact pads, contact members, and a biasing member. The contact members each have an electrically conductive portion attached to an electrically non-conductive portion. Each of the conductive portions forms an electrical connection with a different corresponding one of the contact pads. Each of the contact members is movable with respect to its corresponding contact pad. The contact members are movable with respect the plug contacts. The biasing member is attached to the non-conductive portion of each of the contact members and is configured to bias the conductive portion of each of the contact members toward a different corresponding one of the plug contacts when the plug is inserted into the outlet.

34 Claims, 38 Drawing Sheets

COMMUNICATION CONNECTOR HAVING CONTACT PADS CONTACTED BY MOVABLE CONTACT MEMBERS

BACKGROUND OF THE INVENTION

Field of the Invention

The present invention is directed generally to communication connections and connectors, and more particularly, to communication outlets.

Description of the Related Art

The popularity of the RJ-type connectors (plugs and jacks) motivates manufacturers to work to extend the market life of these types of connectors and the standards that control them. Later generations of Category RJ-45 connectors are designed to transfer data at higher bandwidths (equating to higher data transfer rates and higher operating frequencies). Unfortunately, these later generation connectors must mitigate particularly nagging problems inherent in the original design, which include near end crosstalk ("NEXT"), far end crosstalk ("FEXT"), and some lesser associated return loss ("Rloss") issues.

Referring to FIG. 1, a cable C1 terminated by a conventional RJ-type connector includes a plurality of wires W-1 to W-8 that are substantially identical to one another. As is appreciated by those of ordinary skill in the art, each of the wires W-1 to W-8 includes an electrical conductor 5 (e.g., a conventional copper wire) surrounded by an outer layer of insulation 6 (e.g., a conventional insulating flexible plastic jacket). The wires W-1 to W-8 are arranged in four twisted-wire pairs TP1-TP4 (also known as "twisted pairs"). The first twisted pair TP1 includes the wires W-4 and W-5. The second twisted pair TP2 includes the wires W-1 and W-2. The third twisted pair TP3 includes the wires W-3 and W-6. The fourth twisted pair TP4 includes the wires W-7 and W-8. Each twisted pair may be described as being a transmission line.

Inside a conventional RJ-type connector, the wires W-3 and W-6 of the third twisted pair TP3 are separated (or split) and straddle the wires W-4 and W-5 of the first twisted pair TP1. This causes a significant problem, namely unwanted NEXT inside the connector. Unfortunately, the wide straddle of the wires W-3 and W-6 of the third twisted pair TP3 increases unwanted NEXT to the first, second, and fourth twisted pairs TP1, TP2, and TP4 that must be mitigated by the RJ-type connector when operating at higher frequencies. The NEXT is greatest in the first twisted pair TP1 and less in the second and fourth twisted pairs TP2 and TP4. However, NEXT may be introduced into the second and fourth twisted pairs TP2 and TP4 in a common mode fashion that may in turn increase crosstalk to nearby cables. Signal coupling to cables outside of the cable C1 is referred to as "alien crosstalk" and is especially difficult to negate or reduce in high-speed communications systems.

Generally speaking, a plug, and a portion of the outlet to which the plug is mated, introduce unwanted crosstalk among the number of transmission lines the plug and outlet connect. The outlet is configured to introduce additional crosstalk that cancels or reduces the unwanted crosstalk. When an unwanted crosstalk signal "jumps" from one transmission line to another, that crosstalk signal travels in both directions, at a speed that does not exceed the speed of light. The portion that travels away from the signal source end is called far end crosstalk ("FEXT"). FEXT can be negated with reasonable time delay, because there is a "reversed" image of (or inverted signal with respect to) the unwanted FEXT signal available that is propagating in-phase (in parallel) with the unwanted FEXT signal. The "reversed" image signal may be used to create a cancellation signal.

On the other hand, the portion of the unwanted crosstalk signal that travels toward the signal source end of the crosstalking transmission lines is called near end crosstalk ("NEXT"). The inverted signal available to cancel the NEXT signal travels in parallel with the NEXT signal and has changed since after the crosstalk occurred (or "jumped"). At low bandwidths (low frequencies), the rate of change of the signals is low enough to generally allow for a reasonable negation of the NEXT signal by remixing the NEXT signal with a portion of this inverted, slightly advanced compensation signal. However, this may become a problem at higher frequencies because the rate of change is large enough to not perfectly negate the NEXT signal due to the growing significance of any delay that causes a misalignment between the travelling NEXT (crosstalk) signal and the now-changed inverted (compensation) signal. This time misalignment is caused by the signal propagation time operating over the physical distance between the unwanted crosstalk insertion point and the negation point.

A key to negating (or reducing) NEXT at higher frequencies is to negate the NEXT from the signal at a location along the transmission lines that is as physically near as possible to the location where the unwanted crosstalk was introduced into the transmission lines. Thus, it is desirable to remove or reduce crosstalk introduced by the plug at a location (inside the outlet) that is as close to the plug contacts as possible.

Thus, a need exists for new communication connections and connectors configured to better reduce and/or negate unwanted crosstalk. Communication connections and connectors that remove such unwanted crosstalk at a location that is as physically near as possible to the region where the crosstalk was introduced are particularly desirable. The present application provides these and other advantages as will be apparent from the following detailed description and accompanying figures.

BRIEF DESCRIPTION OF THE SEVERAL VIEWS OF THE DRAWING(S)

Like reference numerals have been used in the figures to identify like components.

DETAILED DESCRIPTION OF THE INVENTION

Figure 2:
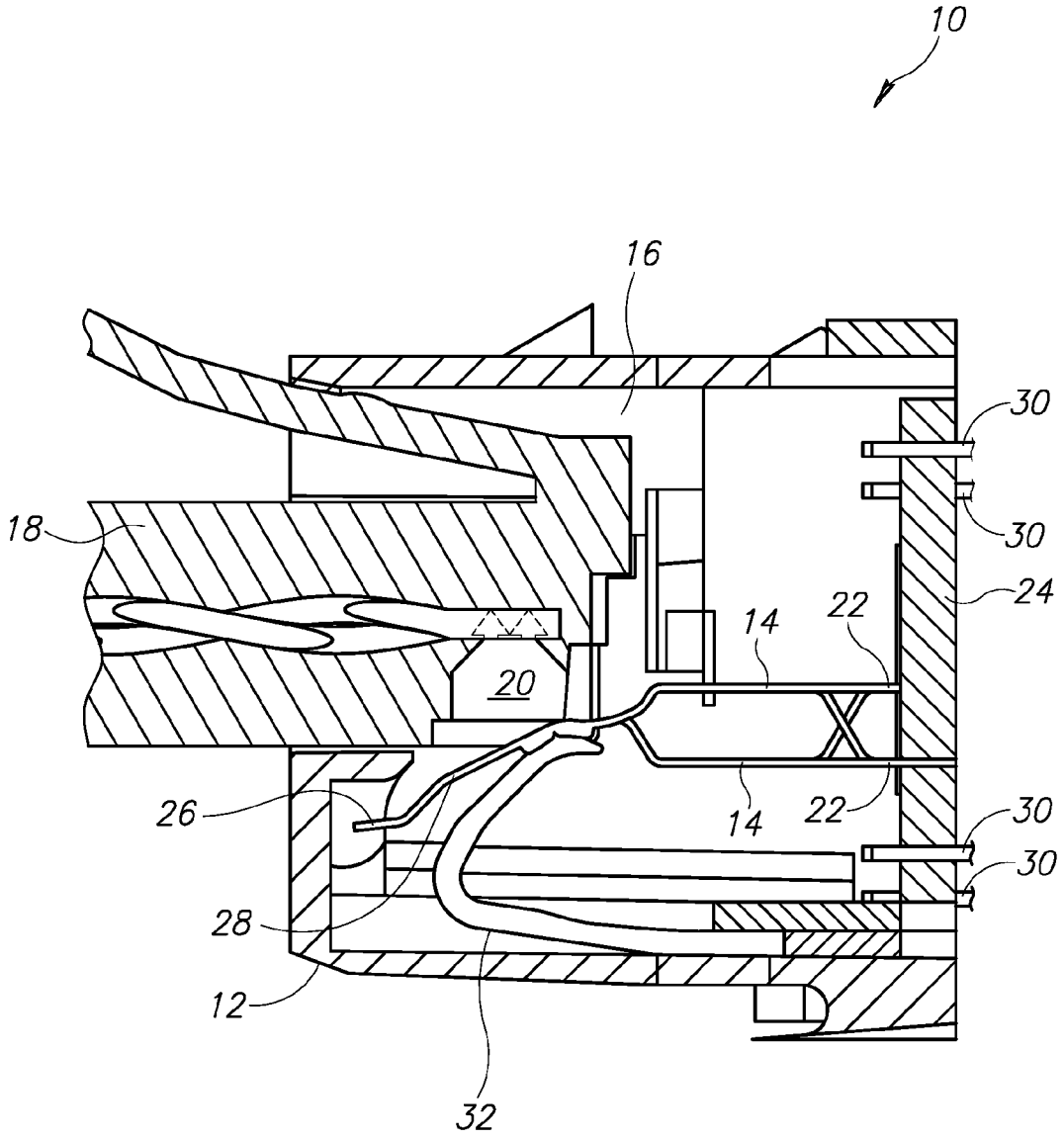
FIG.2 (PRIOR ART)
FIG. 2 is a longitudinal cross sectional view of a conventional communication jack and plug forming a conventional communication connection.

FIG. 2 illustrates a conventional RJ-type outlet or jack 10 that includes a housing or body 12 and a plurality of resilient contact tines 14 arranged in a parallel arrangement within an interior receptacle 16 of the body 12. When a conventional plug 18 having a plurality of metal conductive plates or plug contacts 20 is inserted into the receptacle 16, the contacts 20 physically contact corresponding tines 14. The tines 14 each has a first end portion 22 fixedly attached to a printed circuit board ("PCB") 24, and a free second end portion 26 opposite the first end portion 22. Between the first and second end portions 22 and 26, each of the tines 14 includes a first contact portion 28. The first contact portions 28 are arranged in the body 12 to be contacted by the plug contacts 20 when the plug 18 is inserted into the receptacle 16.

When the plug contacts 20 contact the first contact portions 28 of the tines 14, the contacted tines 14 flex downwardly. In other words, the tines 14 are moved by the plug contacts 20 in a generally downward direction, with a small rearward component. Each of the tines 14 is sufficiently resilient to produce a first generally upward force against the corresponding plug contact 20 in response thereto. This serves as a contact force between the tine 14 and the corresponding plug contact 20 to help provide good electrical contact. A spring assembly 32 may be mounted to the PCB 24 in a position below the tines 14. The spring assembly 32 is configured to push the tines 14 upwardly and into engagement with the plug contacts 20. The PCB 24 includes conductors (e.g., traces) that connect each of a plurality of wire contacts 30 to a corresponding one of the tines 14.

Figure 3:
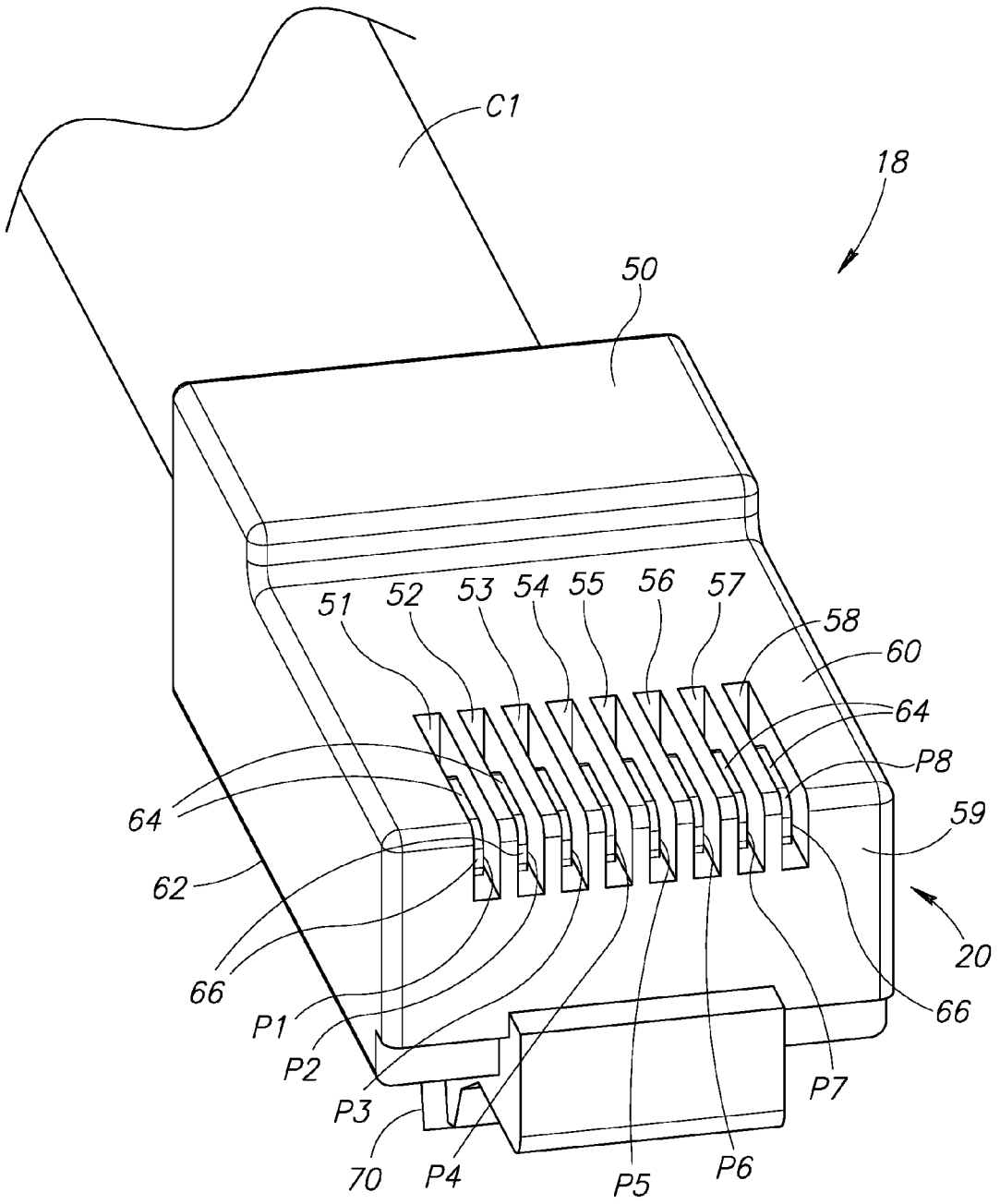
FIG.3 (PRIOR ART)
FIG. 3 is a front perspective view of a conventional communication plug.

FIG. 3 is a perspective view of the conventional plug 18, which has a housing 50 with apertures 51-58 formed therein.

The apertures 51-58 are formed in a front portion 59 of the housing 50. The housing has an upper surface 60 opposite a lower surface 62. The apertures 51-58 extend inwardly from the upper surface 60. In the embodiment illustrated, the apertures 51-58 extend from the front portion 59 of the housing 50 rearwardly.

In the embodiment illustrated, the plug contacts 20 include plug contacts P1-P8 that are positioned inside the apertures 51-58, respectively. As is apparent to those of ordinary skill in the art, each of the plug contacts P1-P8 may have an upper surface 64 and a forward facing surface 66. One or more technical specifications may include a limit with respect to how far the upper surfaces 64 of the plug contacts P1-P8 may be positioned below the upper surface 60 of the housing 50. For example, according to some technical specifications, the upper surfaces 64 of the plug contacts P1-P8 may be positioned about 0.0135 inches to about 0.0320 inches below the upper surface 60 of the housing 50.

Inside the plug 18, the plug contacts P1 to P8 are electrically connected to the wires W-1 to W-8 (see FIG. 1), respectively. A conventional latch arm 70 may be attached to the housing 50.

Referring to FIG. 2, a problem with the housing of conventional RJ-type outlets (like the body 12 of the jack 10) is the use of the tines 14 that are flexible enough to form connections with plug contacts 20 and are located in inexact positions. In addition to being flexible, the tines 14 must also be sufficiently stiff to create enough contact pressure to form a reliable galvanic connection with the plug contacts 20. These design constraints cause the tines to be relatively long, which creates unnecessary distance between a first location (e.g., inside the plug 18) whereat crosstalk is introduced by the plug 18, and secondary locations (e.g., the tines 14 and the PCB 24 inside the jack 10) whereat such crosstalk is at least partially negated or reduced.

Figure 4B:
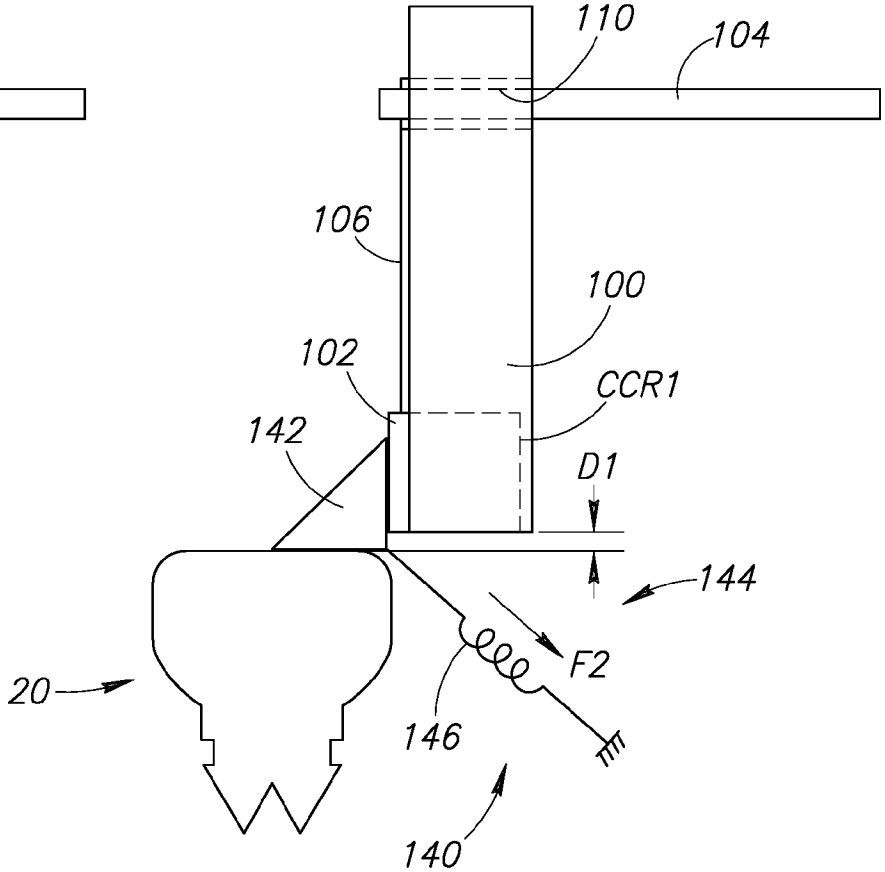
FIG. 4B is a side view of a second embodiment of a plurality of exemplary contact assemblies forming electrical connections between the plurality of plug contacts and the plurality of contact pads mounted on the substrate.
Figure 4A:
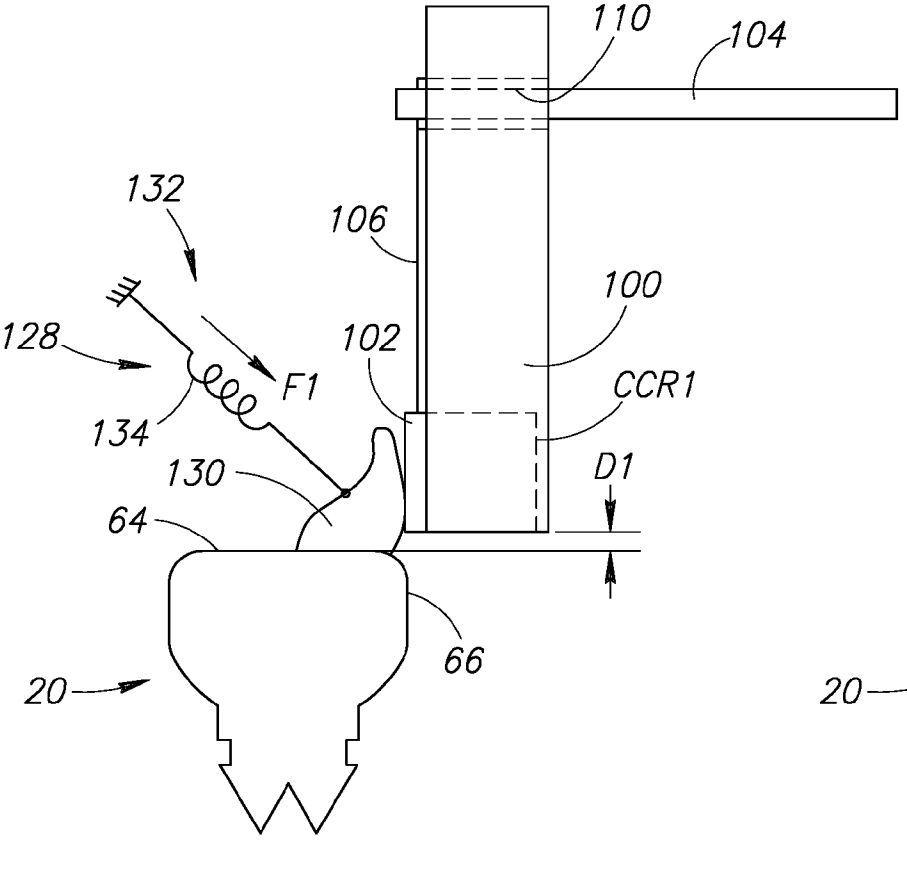
FIG. 4A is a side view of a first embodiment of a plurality of exemplary contact assemblies forming electrical connections between a plurality of plug contacts and a plurality of contact pads mounted on a substrate.

FIG. 4A illustrates a plurality of exemplary contact assemblies 128 in a substantially parallel arrangement configured to be used instead of the elongated tines 14 (see FIG. 2) and similar structures. The contact assemblies 128 form electrical connections between the plug contacts 20 (of the plug 18 illustrated in FIG. 3) and a plurality of corresponding contact pads 102 positioned on a substrate 100 (e.g., a printed circuit board). As is apparent to those of ordinary skill in the art, different ones of the contact assemblies 128 form separate electrical connections between the plug contacts P1-P8 (see FIG. 3) and the contact pads 102.

Each of the contact assemblies 128 includes an outlet contact 130 mounted on a biasing assembly 132 that biases the outlet contact 130 into physical contact with one of the plug contacts 20 and one of the contact pads 102 on the substrate 100. Each outlet contact 130 is configured to contact one of the plug contacts 20. Each of the outlet contacts 130 is constructed from a substantially electrically conductive material (e.g., metal). It may be desirable for the outlet contacts 130 to be as small (e.g., electrically short) as possible because this may provide a desirable amount of NEXT cancellation at high frequencies. For example, each of the outlet contacts 130 may be characterized as being a granule of electrically conductive material that is just large enough not to pass through the gap defined between the contact pads 102 and the plug contacts 20.

For example, it is desirable for the outlet contacts 130, the plug contacts 20, and the contact pads 102 to form a transmission line without any significant discontinuity of characteristic impedance or unfavorable geometry that may increase undesired crosstalk. It is further desirable that the outlet contacts 130, the plug contacts 20, and/or the contact pads 102 maintain positional relationship(s) that reduce or minimize unrepeatable electrical characteristics during successive cycles of mating and unmating. Thus, if the contact pads 102 and the plug contacts 20 are of a sufficiently small size to accomplish this, it may be desirable to construct the outlet contacts 130 with an even smaller size. In other words, the outlet contacts 130 may be smaller than these adjacent conductive elements that are connected by outlet contacts 130. In such embodiments, the outlet contacts 130 may be considered to be of a satisfactory size when the outlet contacts 130 combined with the contact pads 102 have a relatively smaller size than the plug contacts 20.

Alternatively, considering operating frequency and its related wavelength, and knowing that ¼ effective-wavelength (or quarter wavelength) features have extremely strong bandwidth narrowing frequency-selective resonant effects, the outlet contacts 130 may have a size that is less than the quarter wavelength of the signal being carried. A rule of thumb is that features smaller than about half of this quarter wavelength, or about $1/8^{th}$ wavelength (e.g., approximately 19 mm in free space), tend to cause less significant perturbances. Thus, the outlet contacts 130 may have a maximum dimension (or maximum linear feature size) that is significantly less than the $1/8^{th}$ of the wavelength of the signal being carried. In this instance, if the connection formed by the outlet contacts 130 is to support a proposed 25 Gb/s or 40 Gb/s data transfer rate and provide good electrical transmission performance to approximately 2 GHz, unmanaged features approaching 19 mm tend to become very significant artifacts that could cause unwanted good incipient resonances, delays/skew, crosstalk/couplings, and the like. Thus, in this example, when striving for good signal integrity in the ordinary sense, it is desirable that each of the outlet contacts 130 has a maximum dimension (or maximum linear feature size) that is far less than about 19 mm. However, when excessive NEXT occurs, such as exists in a standardized RJ plug, the distance from the source of the undesired but quantified crosstalk within the plug, that occurs just beyond the plug contacts 20, to a crosstalk compensation network or region CCR1 is even more critical than the other parameters involving signal integrity. For example at 2 GHz, each millimeter of distance creates at least 4.8 degrees of round-trip phase shift and may create as much as 7.4 degrees of round-trip phase shift in certain dielectric environments. This phase shift is not reversible. This means approximately, 8% to 13% per mm distance of path distance added by the outlet contacts 130, the contact pads 102, and any other incidental distances encountered between the crosstalk source and the crosstalk compensation region CCR1, is not cancellable specifically in regard to NEXT compensation. With RJ style standardized connectors, the maximum gap between the contact pads 102 and the plug contacts 20, according to standard specifications, may be held to 0.032 inches. Thus, by way of a non-limiting example, the outlet contacts 130 may each have a maximum dimension (or maximum linear feature size) of approximately 1.3 mm (0.050 inches) which accounts for additional tolerances that widen the above mentioned gap and is well under the rule of thumb 19 mm dimension of concern, in this case.

In any event, each of the outlet contacts 130 need only be large enough to form a satisfactory electrical connection between one of the plug contacts 20 and one of the contact pads 102.

The biasing assembly 132 is constructed from a substantially electrically non-conductive (or insulating) material (e.g., plastic). When the plug contacts 20 are positioned near the contact pads 102, the biasing assemblies 132 of the contact assemblies 128 bias (e.g., push) the outlet contacts 130 (in a direction identified by an arrow "F1") against the plug contacts 20 and the contact pads 102. The outlet contacts 130 may first contact the contact pads 102 and then slide along the contact pads 102 until the outlet contacts 130 encounter the plug contacts 20.

As mentioned above, each of the plug contacts P1-P8 (see FIG. 3) may have the upper surface 64 and the forward facing surface 66. At least one of these surfaces 64 and 66, or adjacent surfaces such as the corner between the surfaces 64 and 66, may be contacted by the outlet contact 130. For example, according to some technical specifications, the upper surfaces 64 of the plug contacts P1-P8 (see FIG. 3) may be positioned about 0.0135 inches to about 0.0320 inches below the upper surface 60 of the housing 50. In such embodiments, each of the outlet contacts 130 may have a vertical dimension that is slightly larger than 0.0320.

As is apparent to those of ordinary skill in the art, the plug contacts 20 are positioned at approximately a vertical distance "D1" away from the contact pads 102. However, one or more of the plug contacts 20 may be at a distance slightly greater than or less than the vertical distance "D1." At the same time, the plug contacts 20 are positioned at approximately a horizontal distance (orthogonal to the vertical distance "D1") away from the contact pads 102. However, one or more of the plug contacts 20 may be at a distance slightly greater than or less than the horizontal distance. In other words, the plug contacts 20 may be positioned near the contact pads 102 but at uncertain vertical and horizontal distances therefrom. Thus, each of the outlet contacts 130 may be dimensioned to insure that an electrical connection is formed between the plug contacts 20 and the contact pads 102. As is apparent to those of ordinary skill in the art, conventional tines (e.g., the tines 14) are substantially longer than is required to effect these connections.

The substrate 100 may rest upon or contact the upper surface 60 (see FIG. 3) of the plug housing 50 (see FIG. 3). The outlet contacts 130 may be configured to rest upon portions of the housing 50, for example the upper surface 60, in an instance where any of the apertures 51-58 (see FIG. 3) are not formed. Typically, each of the outlet contacts 130 are configured to fit within one of the apertures 51-58 (see FIG. 3).

The biasing assembly 132 may include a substantially non-electrically conductive biasing member 134. The biasing member 134 may be constructed using a variety of geometries. For example, the biasing member 134 may be a coil spring, an undulated spring, and the like. The biasing member 134 may be compressed to adapt to irregularities in the vertical distance "D1" and/or in the plug contacts 20.

A plurality of connectors 104 are mounted on the substrate 100. By way of a non-limiting example, the connectors 104 may be implemented as insulation displacement connectors ("IDCs"), pins, and the like. A plurality of conductors 106 (e.g., circuit traces) mounted to, or positioned within, the substrate 100 form separate electrical connections between the contact pads 102 and the connectors 104 via an interdicting compensation network on or within the substrate 100. In the embodiment illustrated, the connectors 104 are implemented as IDCs that are each positioned inside a plated through-hole 110. Each plated through-hole 110 is connected to one of the conductors 106, which is connected to one of the contact pads 102. Thus, a different electrical connection is formed between each of the connectors 104 and a corresponding one of the contact pads 102.

The substrate 100 may include the crosstalk compensation region CCR1 configured to place crosstalk ("NEXT") compensation components (not shown) as close as possible to the plug contacts 20. The crosstalk compensation region CCR1 may provide primary compensation and secondary compensation (not shown) may also be included.

While the plug contacts 20 have been illustrated as being approximately orthogonal to the contact pads 102, this is not a requirement. In alternate embodiments, the plug contacts 20 may be positioned at an acute angle or an obtuse angle with respect to the contact pads 102. By way of another non-limiting sample, the plug contacts 20 may be coplanar with the contact pads 102. In such alternate embodiments, the contact assemblies 128 are configured to form separate electrical connections between the plug contacts 20 and the contact pads 102.

In alternate embodiments, the connectors 104 may be extended and used in place of the substrate 100 and the conductors 106. In such embodiments, the contact assemblies 128 connect the array of plug contacts 20 directly to the array of connectors 104.

As is apparent to those of ordinary skill in the art, when a plug 18 having a number of plug contacts other than eight is used, the outlet may include a different contact pad corresponding to each of the plug contacts, a different contact assembly for each contact pad, a different conductor for each contact pad, and a different connector for each contact pad. Further, these components need not be identical to one another to achieve desired electrical and transmission characteristics.

In an alternate embodiment illustrated in FIG. 4B, a plurality of contact assemblies 140 form electrical connections between the plug contacts 20 and the contact pads 102. Each of the contact assemblies 140 includes an outlet contact 142 mounted on a biasing assembly 144. The outlet contact 142 is substantially similar to the outlet contact 130 (see FIG. 4A). However, the biasing assembly 144 includes a substantially non-electrically conductive biasing member 146 that differs from the biasing member 134 illustrated in FIG. 4A. While the biasing member 134 is configured to push the outlet contact 130, the biasing member 146 is configured to pull the outlet contact 142. In the embodiment illustrated in FIG. 4B, the biasing assemblies 144 of the contact assemblies 140 pull the outlet contacts 142 (in a direction identified by an arrow "F2") against the plug contacts 20 and the contact pads 102. The outlet contacts 142 may first contact the contact pads 102 and then slide along the contact pads 102 until the outlet contacts 142 encounter the plug contacts 20.

First Embodiment of Communication Outlet

Figure 5:
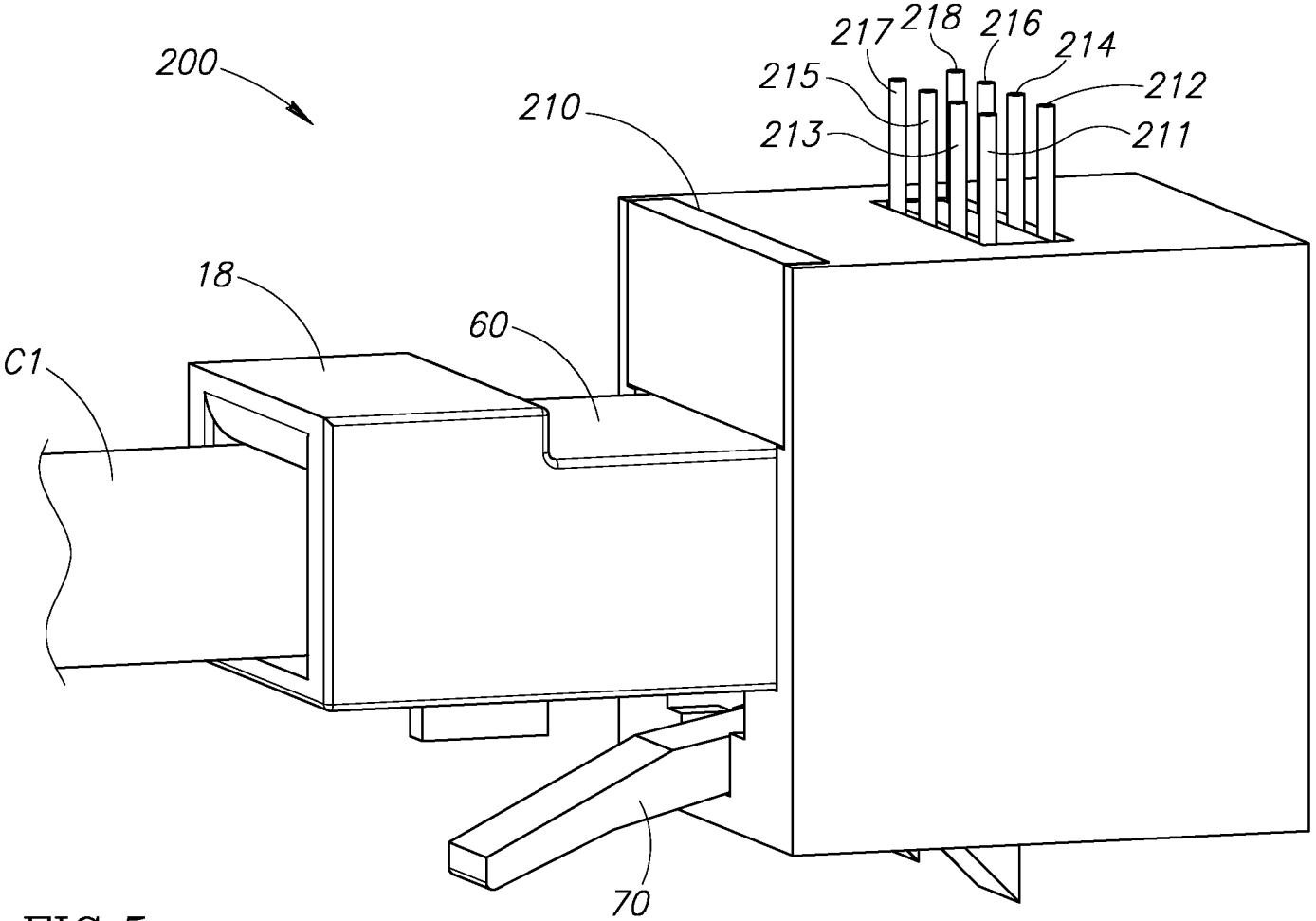
FIG. 5 is a side perspective view of a communication connection formed by a first embodiment of a communication outlet and the communication plug.

FIG. 5 is a perspective view of a communication connection 200 formed by the conventional plug 18 and an outlet 210. In this embodiment, the plug 18 terminates the cable C1 and the outlet 210 includes a plurality of connectors 211-218 (e.g., pins) configured to form a connection with an external structure (e.g., printed circuit board). By way of a non-limiting example, the connectors 211-218 may be implemented as solder tail pins. The connectors 211-218 may be curled or gull-winged. The connectors 211-218 may be isolated from one another and/or arranged into four pairs corresponding to the four twisted pairs TP1-TP4 (see FIG. 1) of the cable C1.

Figure 6:
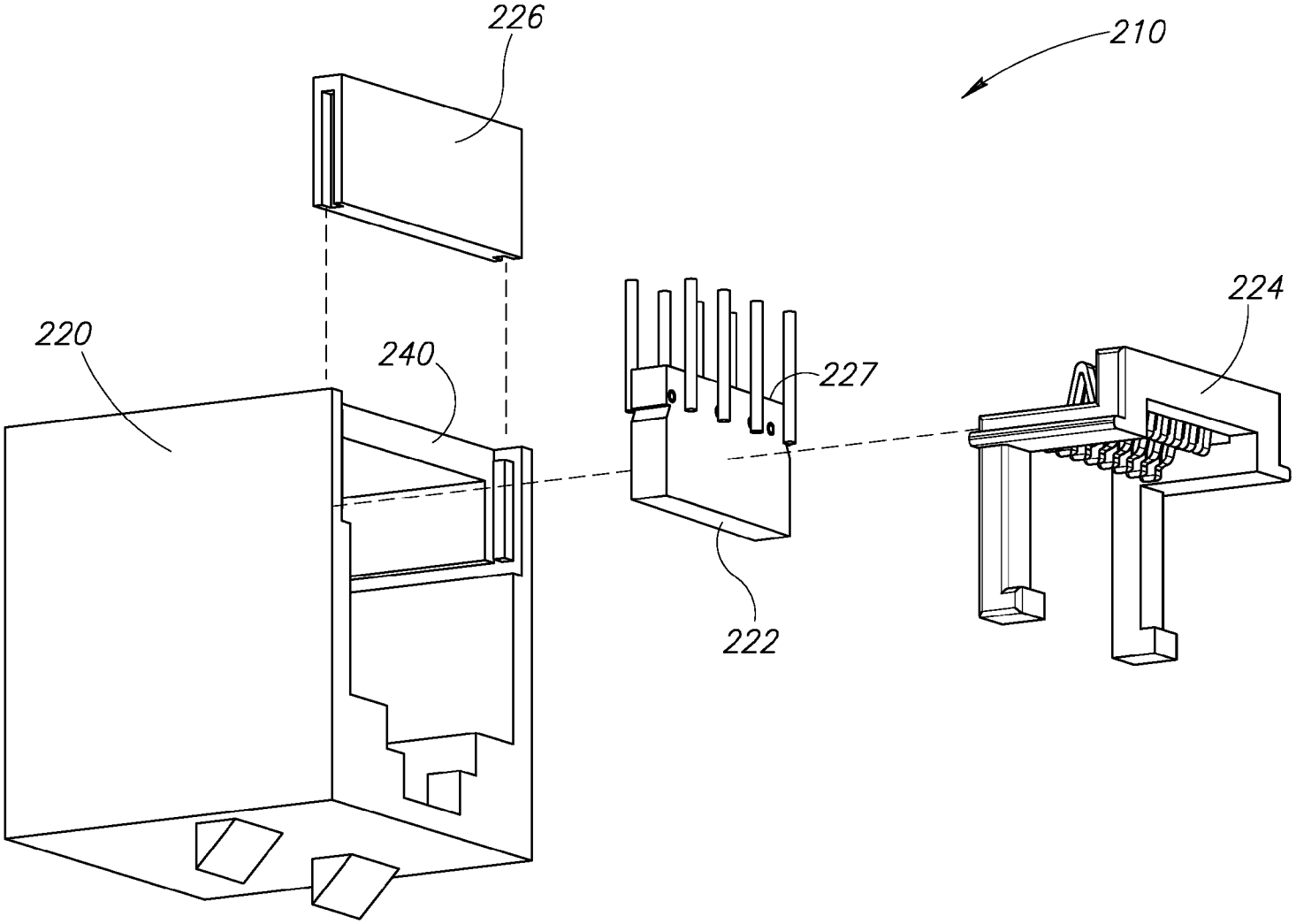
FIG. 6 is an exploded perspective view of the communication outlet of FIG. 5.
Figure 9A:
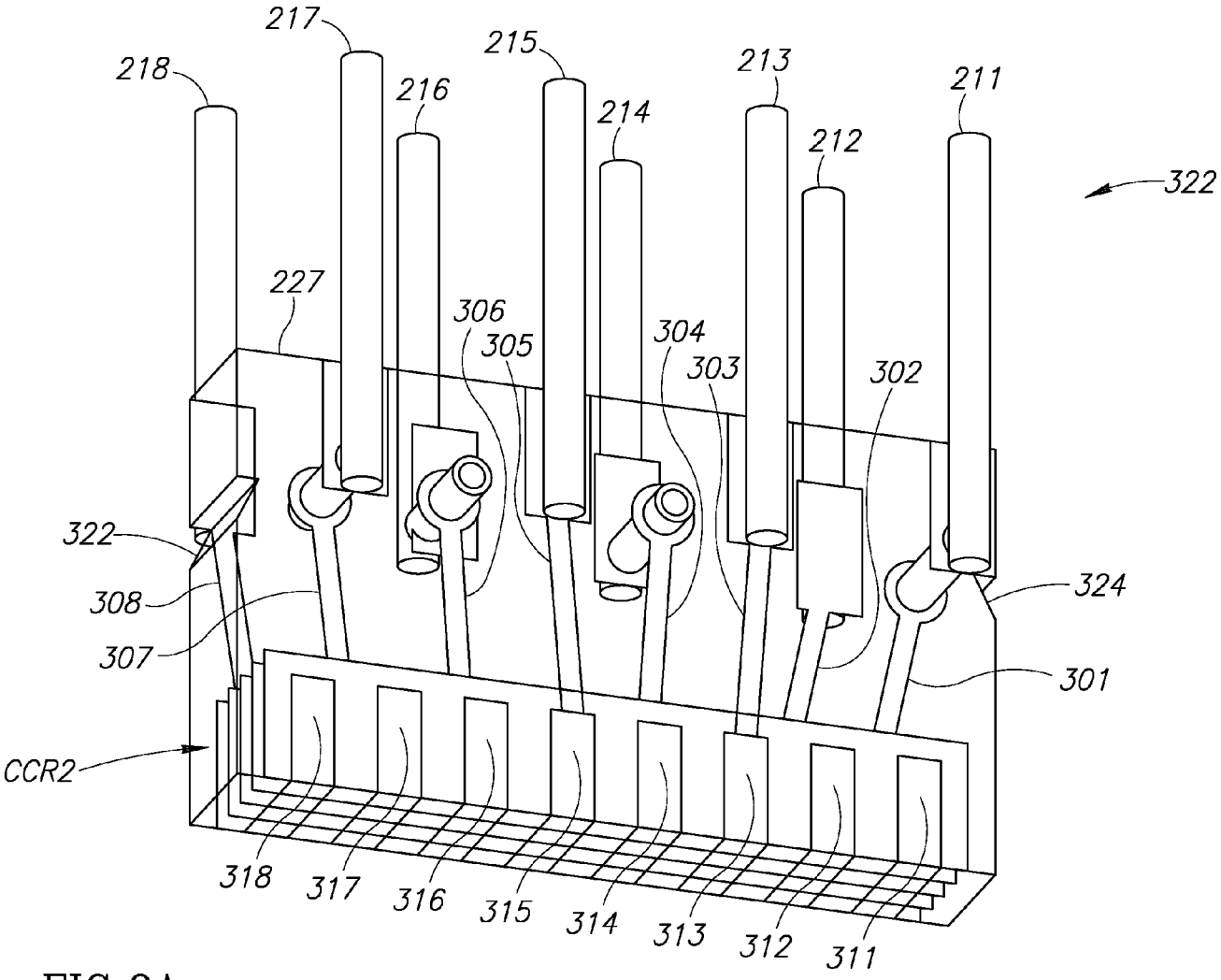
FIG. 9A is an enlarged front perspective view of an underside of a substrate of the communication outlet of FIG. 5.
Figure 9B:
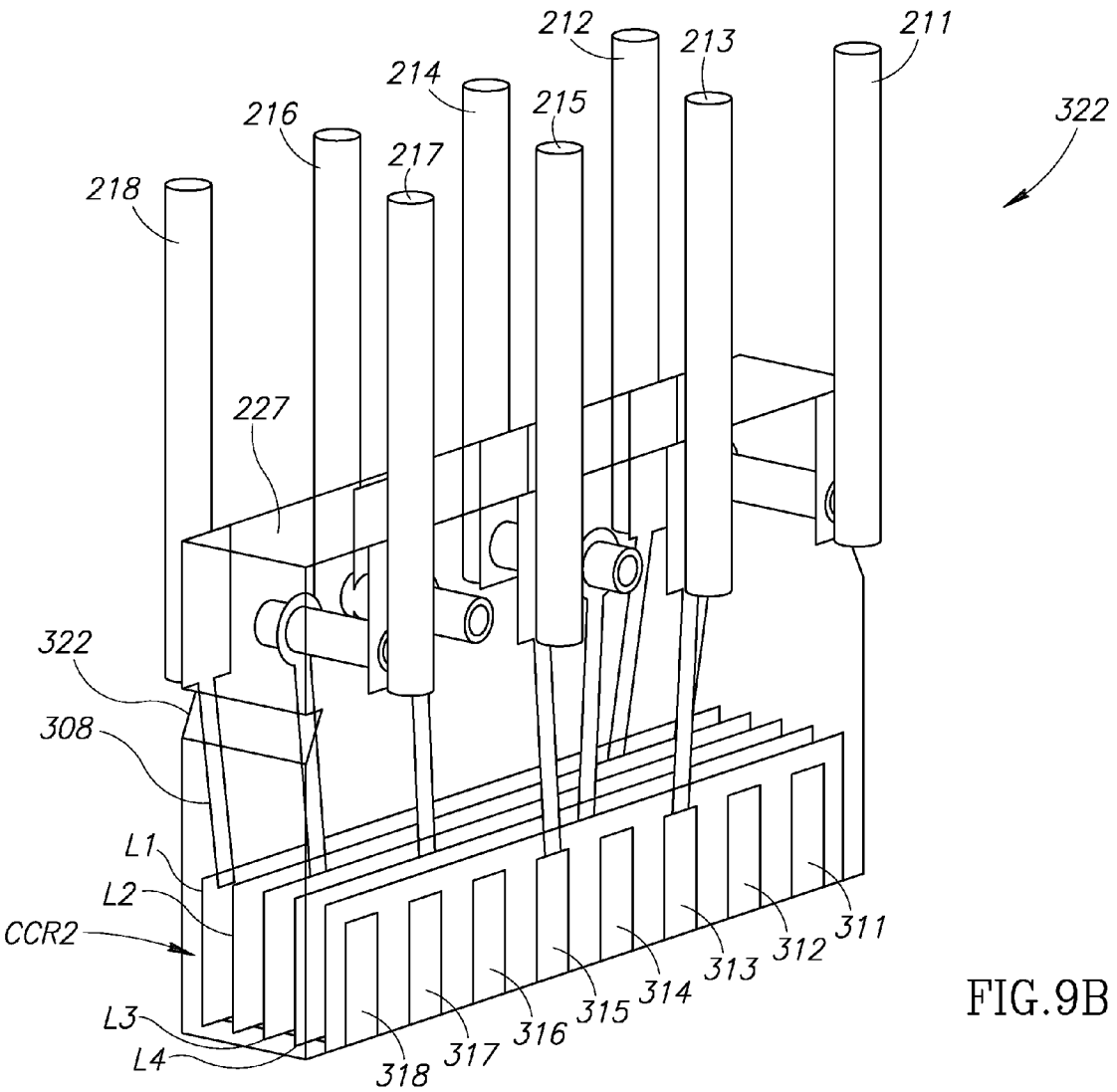
FIG. 9B is an enlarged front perspective view of an upper side of the substrate of FIG. 9A.

FIG. 6 is an exploded perspective view of the outlet 210. The outlet 210 includes an outlet housing 220, a substrate 222, a moveable biasing member 224, and a cover plate 226. Referring to FIGS. 9A and 9B, the substrate 222 may include a crosstalk compensation network or region CCR2 configured to place crosstalk ("NEXT") compensation components (illustrated as PCB layers or conductive plates L1-L4 in FIG. 9B) as close as possible to the plug contacts 20 (see FIGS. 4A and 4B). In the example illustrated, the crosstalk compensation region CCR2 provides primary compensation and the outlet 210 (see FIGS. 5 and 6) may also include secondary compensation (not shown). In FIGS. 9A and 9B, the substrate 222 has been illustrated as being transparent to provide a better view of the crosstalk compensation region CCR2.

Referring to FIG. 6, the substrate 222 and the biasing member 224 are both configured to be positioned inside the outlet housing 220. After the substrate 222 and the biasing member 224 have been positioned inside the outlet housing 220, the cover plate 226 is slid into place to retain the biasing member 224 inside the outlet housing 220. The connectors 211-218 (see FIGS. 5, 9A, and 9B) extend upwardly beyond an edge portion 227 of the substrate 222 and outwardly through the outlet housing 220.

Figure 7:
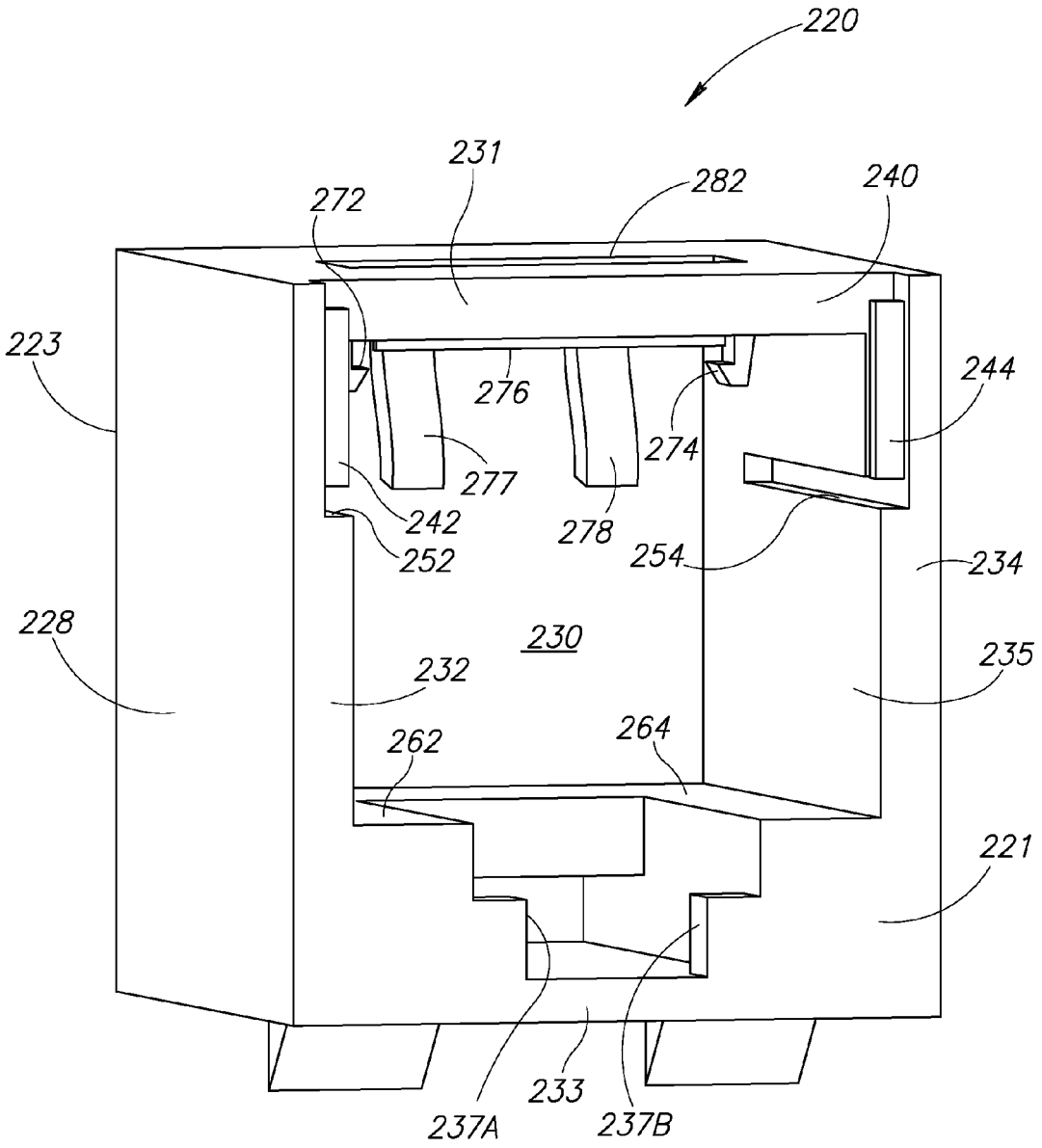
FIG. 7 is an enlarged front perspective view of an outlet housing of the communication outlet of FIG. 5.

FIG. 7 is a perspective view of the outlet housing 220. The outlet housing 220 has a front portion 221 opposite a rear portion 223.

The embodiment illustrated, the outlet housing 220 has a substantially square or rectangular cross-sectional shape. Thus, the outlet housing 220 may be characterized as having a sidewall 228 with four sides 231-234. The sides 231 and 233 are opposite one another, and the sides 232 and 234 are opposite one another.

The sidewall 228 defines an interior receptacle 230 with a plug receiving opening 235 configured to receive the plug 18 (see FIG. 5). The plug receiving opening 235 is formed in the front portion 221 of the outlet housing 220 and configured to permit the front portion 59 (see FIG. 3) of the plug 18 to pass therethrough unobstructed. The front portion 221 of the outlet housing 220 includes conventional latching lips 237A and 237B onto which the latch arm 70 (see FIG. 5) of the plug 18 may latch. Thus, the plug 18 may be latched to the outlet 210.

In the front portion 221 of the outlet housing 220, a recess 240 extends from the side 231 into the sides 232 and 234. The recess 240 is configured to slidably receive the cover plate 226 (see FIG. 6). The recess 240 extends into and is continuous with the plug receiving opening 235. Thus, before the cover plate 226 is slid into place, the plug receiving opening 235 is open along the side 231 of the sidewall 228. A first guiderail 242 is formed in the side 232 within the recess 240, and a second guiderail 244 is formed in the side 234 within the recess 240.

Grooves 252 and 254 are formed in the sides 232 and 234, respectively, of the sidewall 228 and extend from the front portion 221 of the outlet housing 220 into the interior receptacle 230. The grooves 252 and 254 are open along the front portion 221 of the outlet housing 220. In the embodiment illustrated, the grooves 252 and 254 are in communication with the recess 240. However, this is not a requirement.

The outlet housing 220 includes a first support portion 262 positioned inside the interior receptacle 230 at the intersection of the sides 232 and 233, and a second support portion 264 positioned inside the interior receptacle 230 at the intersection of the sides 233 and 234. The outlet housing 220 includes a "stop" (not shown) that halts the insertion of the plug 18 into the outlet 210. Gripping tabs 272 and 274 extend into the interior receptacle 230 from the side 231 of the sidewall 228. The gripping tabs 272 and 274 are configured to grip the substrate 222 (see FIG. 6) and hold the substrate 222 in a desired position within the interior receptacle 230.

One or more supports 276, 277, and 278 extend into the interior receptacle 230 from the side 231. The support 276 may be characterized as being a forward support and the supports 277 and 278 may be characterized as being rear supports. When the substrate 222 is gripped by the gripping tabs 272 and 274, the substrate 222 is positioned between the forward support 276 and the rear supports 277 and 278. The supports 277 and 278 maybe substantially similar to one another and spaced apart laterally within the interior receptacle 230. When the substrate 222 is gripped by the gripping tabs 272 and 274, the supports 277 and 278 abut the substrate 222 and help prevent it from being pushed rearwardly by the plug 18 (see FIG. 5).

Figure 8:
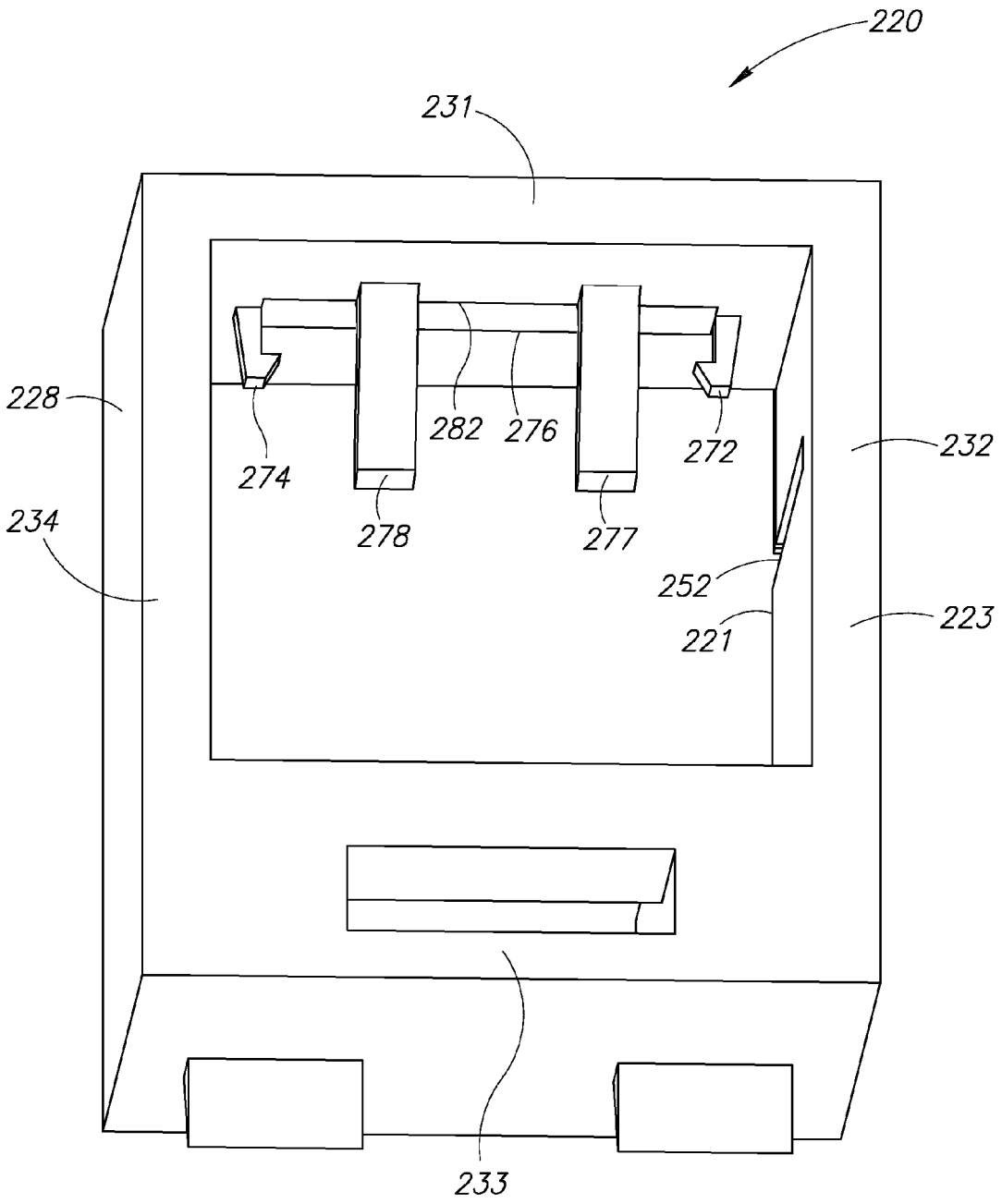
FIG. 8 is an enlarged rear perspective view of the outlet housing of FIG. 7.

Referring to FIGS. 7 and 8, a through-hole or slot 282 is formed in the side 231 of the sidewall 228 and positioned to receive the connectors 211-218 (see FIGS. 5, 9A, and 9B) and allow the connectors 211-218 to pass through the side 231 of the sidewall 228 of the outlet housing 220.

Referring to FIG. 9A, electrical connections 301-308 (e.g., traces) are electrically connected to the connectors 211-218, respectively. The electrical connections 301-308 are also connected to the contact pads 311-318, respectively, via the crosstalk compensation region CCR2. Thus, the connectors 211-218 are connected by the electrical connections 301-308, respectively, to the crosstalk compensation region CCR2. The crosstalk compensation region CCR2 is connected to the contact pads 311-318. Thus, the connectors 211-218 are connected to the contact pads 311-318, respectively. In the embodiment illustrated, the substrate 222 includes apertures 322 and 324 configured to receive the gripping tabs 272 and 274 (see FIGS. 7 and 8), respectively, of the outlet housing 220. In the embodiment illustrated, the substrate 222 is suspended from the side 231 of the sidewall 228 by the gripping tabs 272 and 274 (see FIGS. 7 and 8).

The crosstalk compensation region CCR2 shown in FIGS. 9A and 9B is one embodiment and not intended to be limiting. The crosstalk compensation region CCR2 may extend further into the volume of the substrate 222, may be formed in any layered configuration or orientation, or may not be formed in or include layers at all (such as when the substrate 222 is not a PCB). Critical crosstalk compensation elements may be given priority locations within the crosstalk compensation region CCR2. Whether crosstalk compensation is achieved by a circuit board and possibly with multiple layers (e.g., the conductive plates L1-L4 shown in FIG. 9B) formed within the substrate 222, the crosstalk compensation region CCR2 may include a lead frame array of conductive and insulative portions. It may be desirable to position the most critical compensation elements immediately adjacent to the contact pads 311 to 318. It may be particularly desirable to position the most critical compensation elements immediately adjacent to a subset of the contact pads 311-318, such as the contact pads 313 to 316, which relate to the most difficult crosstalk to compensate.

Figure 10:
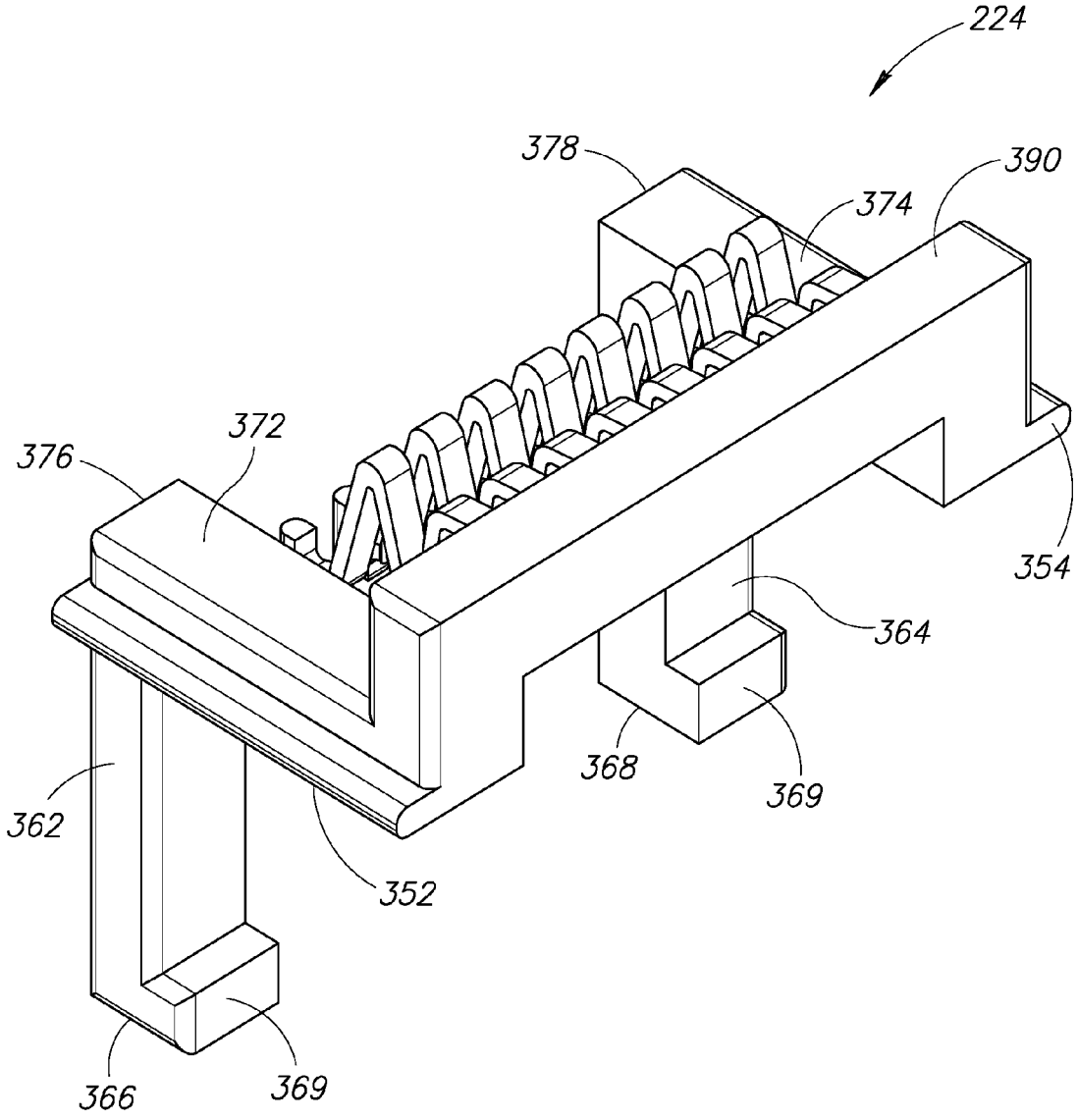
FIG. 10 is an enlarged front perspective view of a biasing member of the communication outlet of FIG. 5.

Referring to FIG. 10, the biasing member 224 is configured to be slid inwardly by the plug 18 (see FIGS. 13A-13C) as the plug 18 is inserted into the interior receptacle 230 (see FIG. 7) of the outlet 210 (see FIG. 5). The biasing member 224 has side rails 352 and 354 configured to be received by and slide within the grooves 252 and 254 (see FIG. 7), respectively, formed in the outlet housing 220.

The biasing member 224 has one or more plug engaging members 362 and 364 configured to contact the plug 18 when the plug 18 is inserted into the interior receptacle 230 (see FIG. 7) of the outlet 210 (see FIG. 5). As the plug 18 is inserted into the interior receptacle 230, the plug 18 presses against the plug engaging members 362 and 364 and pushes the biasing member 224 farther into the outlet housing 220 (see FIG. 6). In the embodiment illustrated, the plug engaging members 362 and 364 are engaged by the front portion 59 (see FIG. 3) of the plug 18. Distal free end portions 366 and 368 of the plug engaging members 362 and 364, respectively, rest upon the first and second support portions 262 and 264 (see FIG. 7), respectively. Optionally, the distal free end portions 366 and 368 may include wrap-around hooks 369A and 369B. However, this is not a requirement. The wrap-around hook 369A may help relieve a bending moment from a support member 372 and the plug engaging member 362 by converting any upward bow from the support member 372 into a frictional grabbing force between the top surface of the wrap-around hook 369A and the plug 18 (see FIG. 3). Similarly, the wrap-around hook 369B may help relieve a bending moment from a support member 374 and the plug engaging member 364 by converting any upward bow from the support member 374 into a frictional grabbing force between the top surface of the wrap-around hook 369B and the plug 18 (see FIG. 3).

The side rails 352 and 354 are mounted on the support members 372 and 374, respectively. The support members 372 and 374 are mounted by their first end portions 376 and 378, respectively, to the plug engaging members 362 and 364, respectively. The support members 372 and 374 extend forwardly toward the front portion 221 (see FIG. 7) of the outlet housing 220 from the plug engaging members 362 and 364, respectively. When the plug 18 is inserted into the interior receptacle 230 (see FIG. 7) of the outlet 210 (see FIG. 5), the support members 372 and 374 extend along the upper surface 60 (see FIG. 3) of the plug 18.

Figure 11:
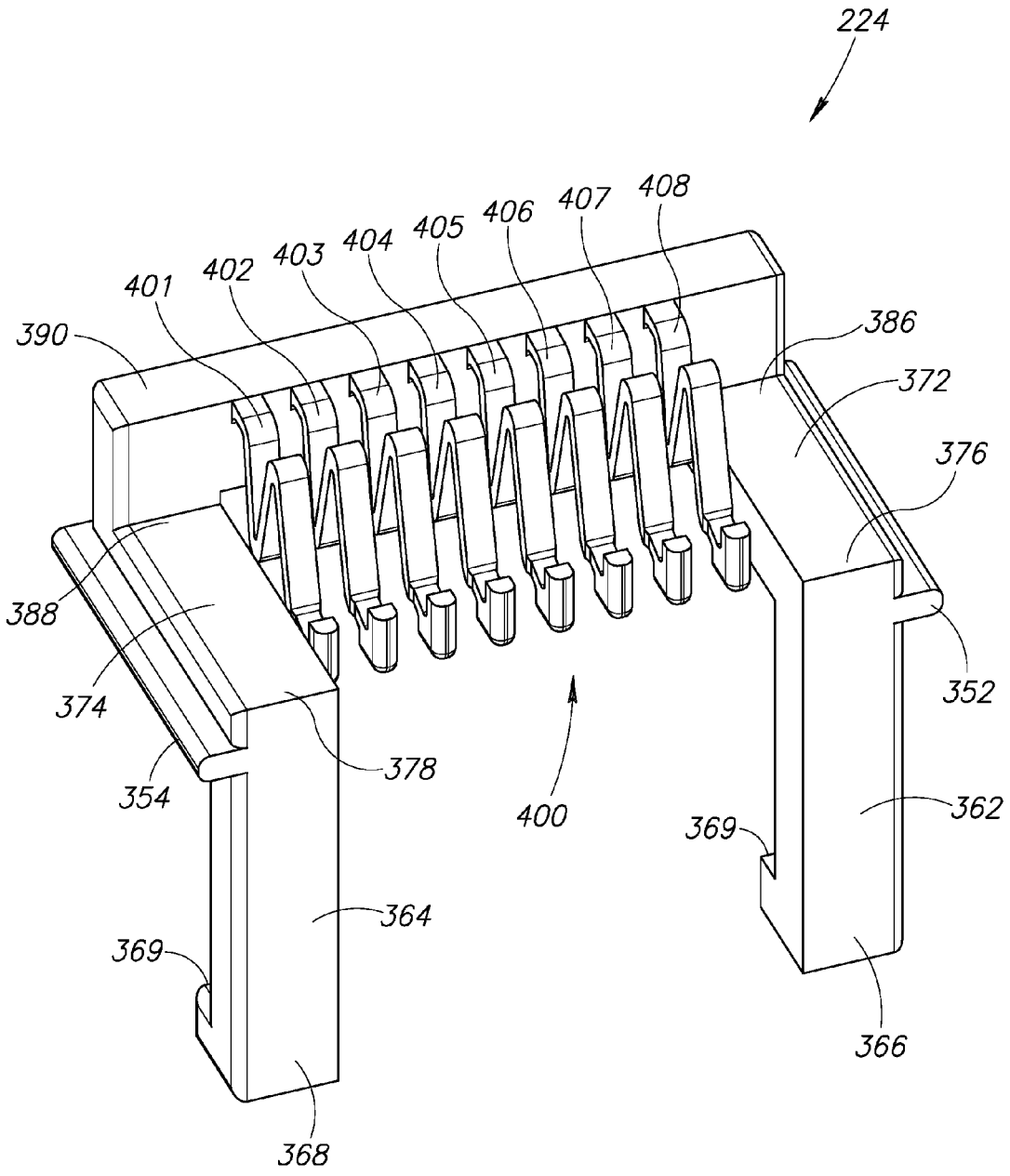
FIG. 11 is an enlarged rear perspective view of the biasing member of FIG. 10.

Referring to FIG. 11, the support members 372 and 374 have second end portions 386 and 388 opposite their first end portions 376 and 378, respectively. A transverse support member 390 extends between the second end portions 386 and 388 of the support members 372 and 374 and couples them together.

A plurality of contact assemblies 400 are mounted to the transverse support member 390 and extend rearwardly therefrom toward the substrate 222 (see FIG. 6) when the substrate 222 is gripped by the gripping tabs 272 and 274 (see FIG. 7). In the embodiment illustrated, the contact assemblies 400 include eight contact assemblies 401-408. Together the side rails 352 and 354, the plug engaging members 362 and 364, the support members 372 and 374, and the transverse support member 390 form a movable sled configured to carry the contact assemblies 400 toward and away from the contact pads 311-318 (see FIGS. 9A and 9B).

Figure 12:
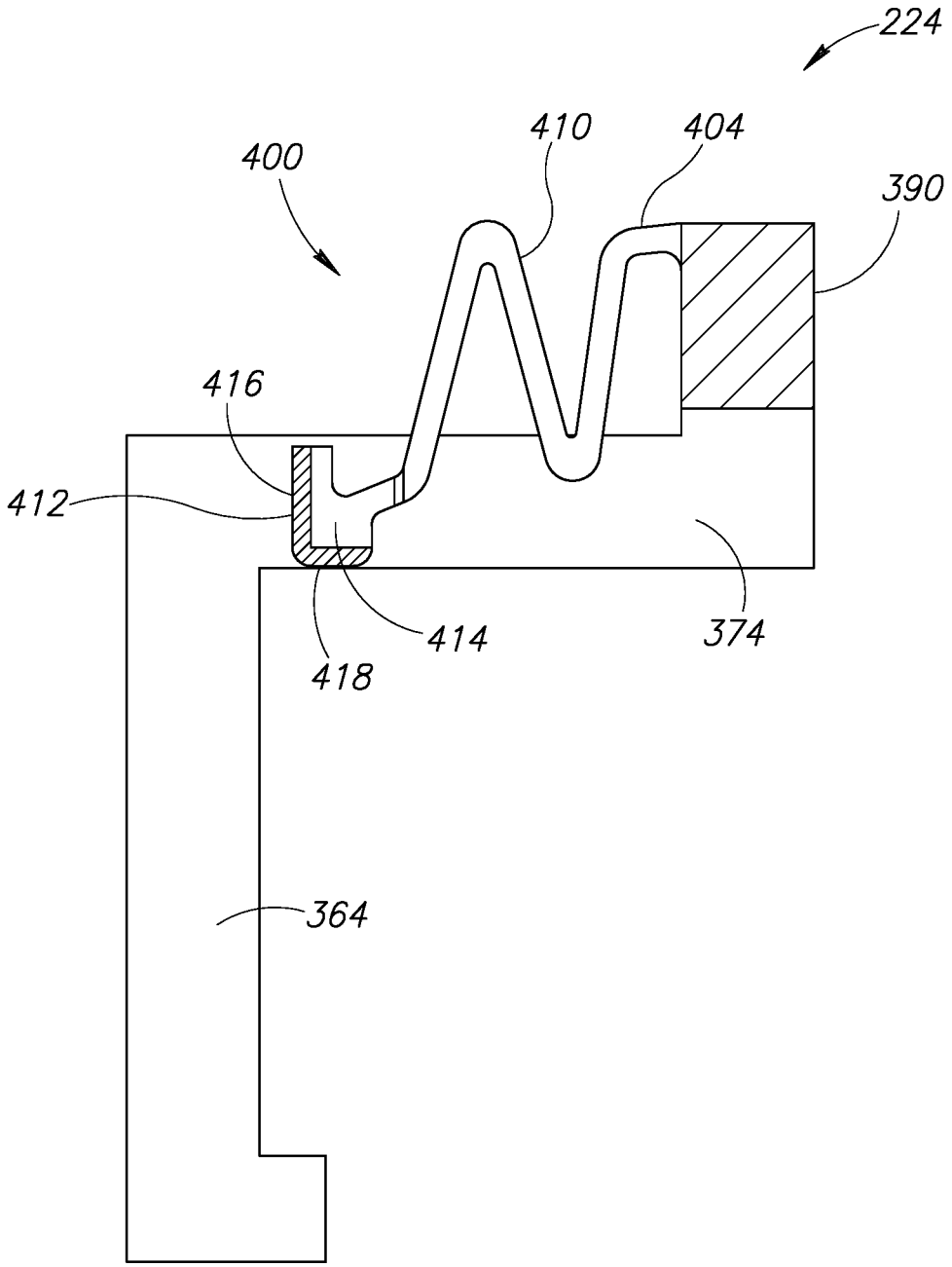
FIG. 12 is a longitudinal cross sectional view of the biasing member of FIG. 10.

Referring to FIG. 12, each of the contact assemblies 400 (see FIG. 11) includes an undulating spring 410 and an outlet contact 412. The outlet contact 412 is constructed from a substantially electrically conductive material (e.g., gold plating) and at least a portion of the spring 410 is constructed from a substantially electrically non-conductive (or insulating) material (e.g., plastic). The outlet contact 412 may be formed by plating an end portion 414 of the undulating spring 410 with a conductive material. Alternatively, the outlet contact 412 may be formed by crimping, threading, or insert molding conductive material onto the end portion 414 of the undulating spring 410.

In the embodiment illustrated, the outlet contact 412 has a first surface 416 positioned to contact one of the contact pads 311-318 (see FIGS. 9A and 9B) formed on the substrate 222, and a second surface 418 positioned to contact one of the plug contacts P1-P8 (see FIG. 3) of the plug 18 when the plug 18 is inserted into the outlet 210 (see FIG. 5). The undulating spring 410 is configured to press the first surface 416 of the outlet contact 412 against a corresponding one of the contact pads 311-318 (see FIGS. 9A and 9B) when the plug 18 is inserted into the outlet 210 (see FIG. 5) and travels a distance "D2" (see FIG. 13A). As the plug 18 travels the distance "D2" but before forward movement of the plug 18 is stopped, the undulating spring 410 may press the first surface 416 of the outlet contact 412 against the corresponding contact pad (e.g., the contact pad 314 illustrated in FIG. 13A) and toward the upper surface 60 of the plug 18. This causes the outlet contact 412 to slide along the corresponding contact pad toward a corresponding one of the plug contacts P1-P8 (see FIG. 3). By the time the plug 18 has stopped (after having traveled from the end of the distance "D2" to the maximum insertion of the plug 18), the undulating spring 410 is pressing the second surface 418 of the outlet contact 412 against the upper surface 64 (see FIG. 3) of the corresponding plug contact or the rounded corner adjacent to the upper surface 64 of the corresponding plug contact.

Figure 13A:
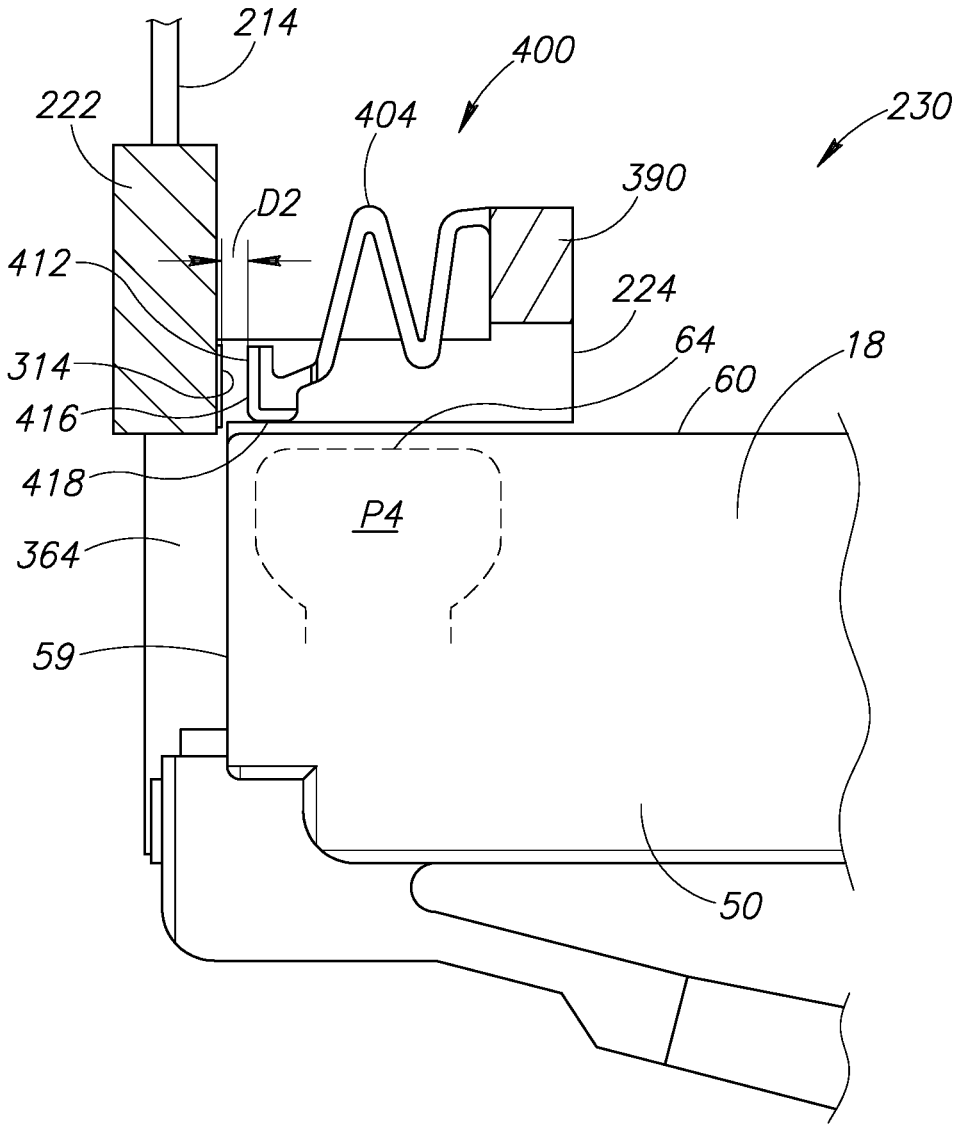
FIG. 13A is a first side view inside the outlet housing showing the biasing member, the substrate, a transverse stop portion of the outlet housing, and the plug when the plug first contacts the biasing member, which is shown in cross section taken between the fourth and fifth contact assemblies toward the fourth contact assembly.
Figure 13B:
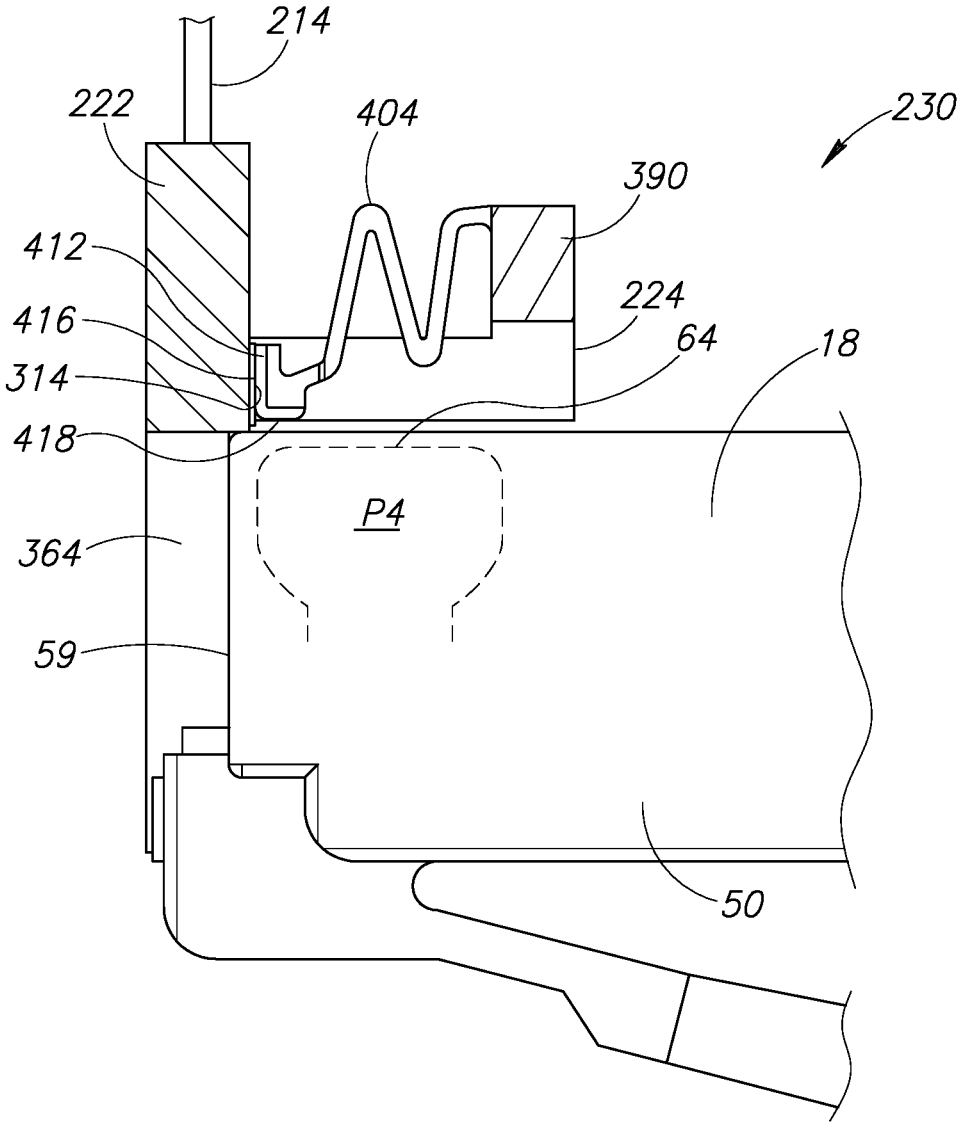
FIG. 13B is a second side view inside the outlet housing showing the biasing member, the substrate, the transverse stop portion of the outlet housing, and the plug when a plurality of contact assemblies of the biasing member first contact a plurality of contact pads on the substrate.
Figure 13C:
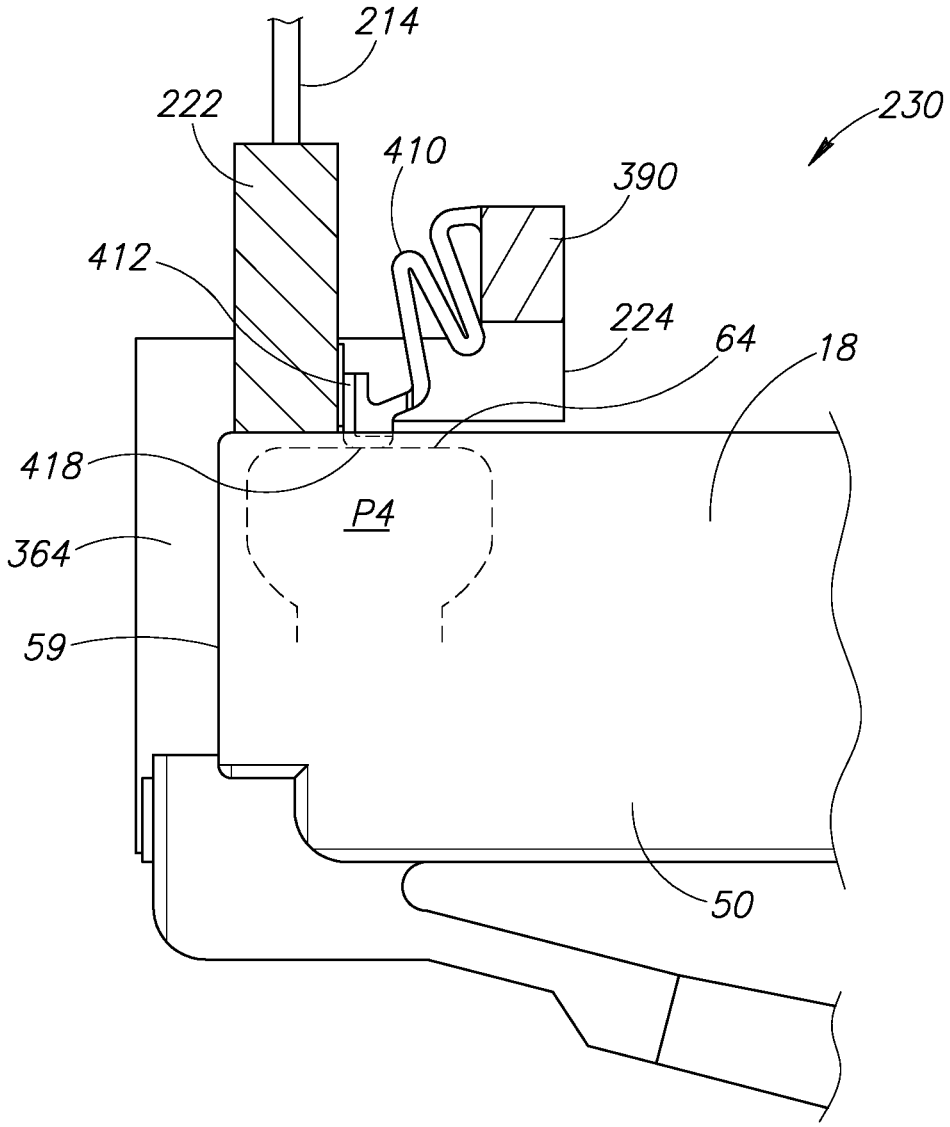
FIG. 13C is a third side view inside the outlet housing showing the biasing member, the substrate, the transverse stop portion of the outlet housing, and the plug when the plug is fully inserted into the outlet.

FIGS. 13A-13C depict the movement of the biasing member 224 with respect to the substrate 222 when the plug 18 is inserted into the outlet 210 (see FIGS. 5 and 6). FIGS. 13A-13C show a cross-section of the biasing member 224 taken between the contact assemblies 404 and 405 toward the contact assembly 404.

First, referring to FIG. 13A, the plug 18 is inserted into the interior receptacle 230 until the front portion 59 of the housing 50 of the plug 18 contacts the plug engaging members 362 (see FIG. 10) and 364 of the biasing member 224. At this point, the biasing member 224 has not yet moved. Then, referring to FIG. 13B, the plug 18 continues traveling further into the interior receptacle 230 pushing the biasing member 224 inwardly toward the substrate 222 until the first surfaces 416 of the outlet contacts 412 of the contact assemblies 401-408 (see FIG. 11) physically contact and press against the contact pads 311-318 (see FIGS. 9A and 9B), respectively. At this point, the biasing member 224 has traveled the distance "D2" (see FIG. 13A). Next, referring to FIG. 13C, the plug 18 continues traveling further into the interior receptacle 230 until the plug 18 is stopped at full insertion, which halts the inward travel of the plug 18. At this point, the undulating springs 410 of the contact assemblies 401-408 (see FIG. 11) are pressing the second surfaces 418 of the outlet contacts 412 of the contact assemblies 401-408 (see FIG. 11) through the apertures 51-58 (see FIG. 3) in the housing 50 and against the upper surfaces 64 (see FIG. 3) or the rounded corners adjacent to the upper surfaces 64 of the plug contacts P1-P8 (see FIG. 3). Although, in the embodiment illustrated, the first surface 416 initially touches one of the contact pads 311-318 (e.g., the contact pad 314) prior to the plug 18 being fully inserted, in alternate embodiments, the second surface 418 may touch one of the plug contacts P1-P8 (e.g., the plug contact P4) prior to the plug 18 being fully inserted.

When the plug 18 is removed from the outlet 210 (see FIGS. 5 and 6), the undulating springs 410 of the contact assemblies 401-408 (see FIG. 11) may return the biasing member 224 to the position illustrated in FIG. 13B. Thus, after the first time the plug 18 has been inserted into the outlet 210 (see FIGS. 5 and 6), the contact assemblies 401-408 (see FIG. 11) may transition between the positions shown in FIGS. 13B and 13C when the plug 18 is removed and reinserted. Alternatively, when the plug 18 is removed from the outlet 210 (see FIGS. 5 and 6), the undulating springs 410 of the contact assemblies 401-408 (see FIG. 11) may return the biasing member 224 to the position illustrated in FIG. 13A.

Figure 14:
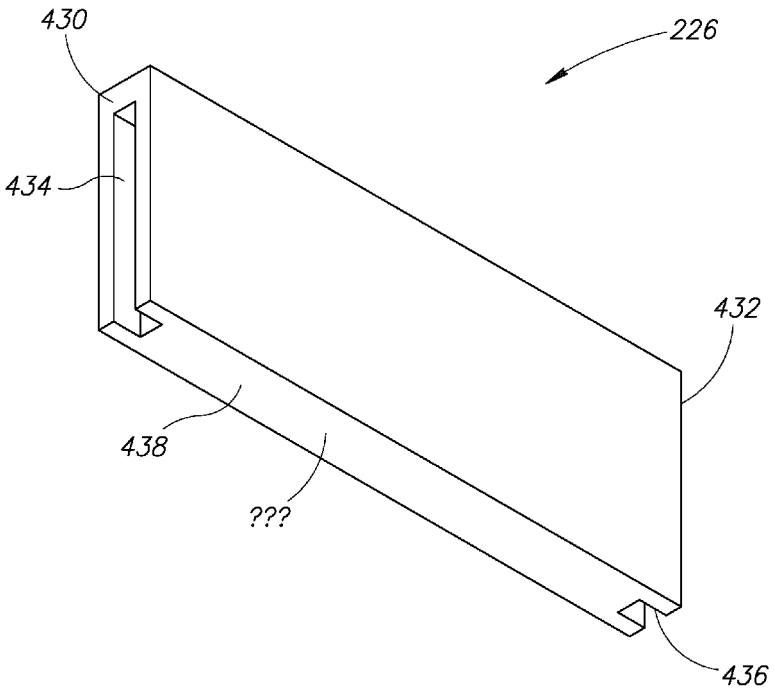
FIG. 14 is a perspective view of a cover plate of the communication outlet of FIG. 5.

Referring to FIG. 14, the cover plate 226 is generally planar and has a first side portion 430 opposite a second side portion 432. A first groove 434 is formed in the first side portion 430 and a second groove 436 is formed in the second side portion 432. Both the first and second grooves 434 and 436 are open along a lower surface 438. As mentioned above, the recess 240 (see FIG. 7) of the outlet housing 220 is configured to slidably receive the cover plate 226. The first and second grooves 434 and 436 are configured to receive the first and second guiderails 242 and 244 (see FIG. 7) as the cover plate 226 is slid into the recess 240 (see FIG. 7). Referring to FIG. 6, after the substrate 222 and the biasing member 224 have been positioned inside the outlet housing 220, the cover plate 226 is slid into the recess 240 and retains the biasing member 224 inside the outlet housing 220. Friction and/or a bonding or latching means may help maintain the cover plate 226 inside the recess 240.

Second Embodiment of Communication Outlet

Figure 15:
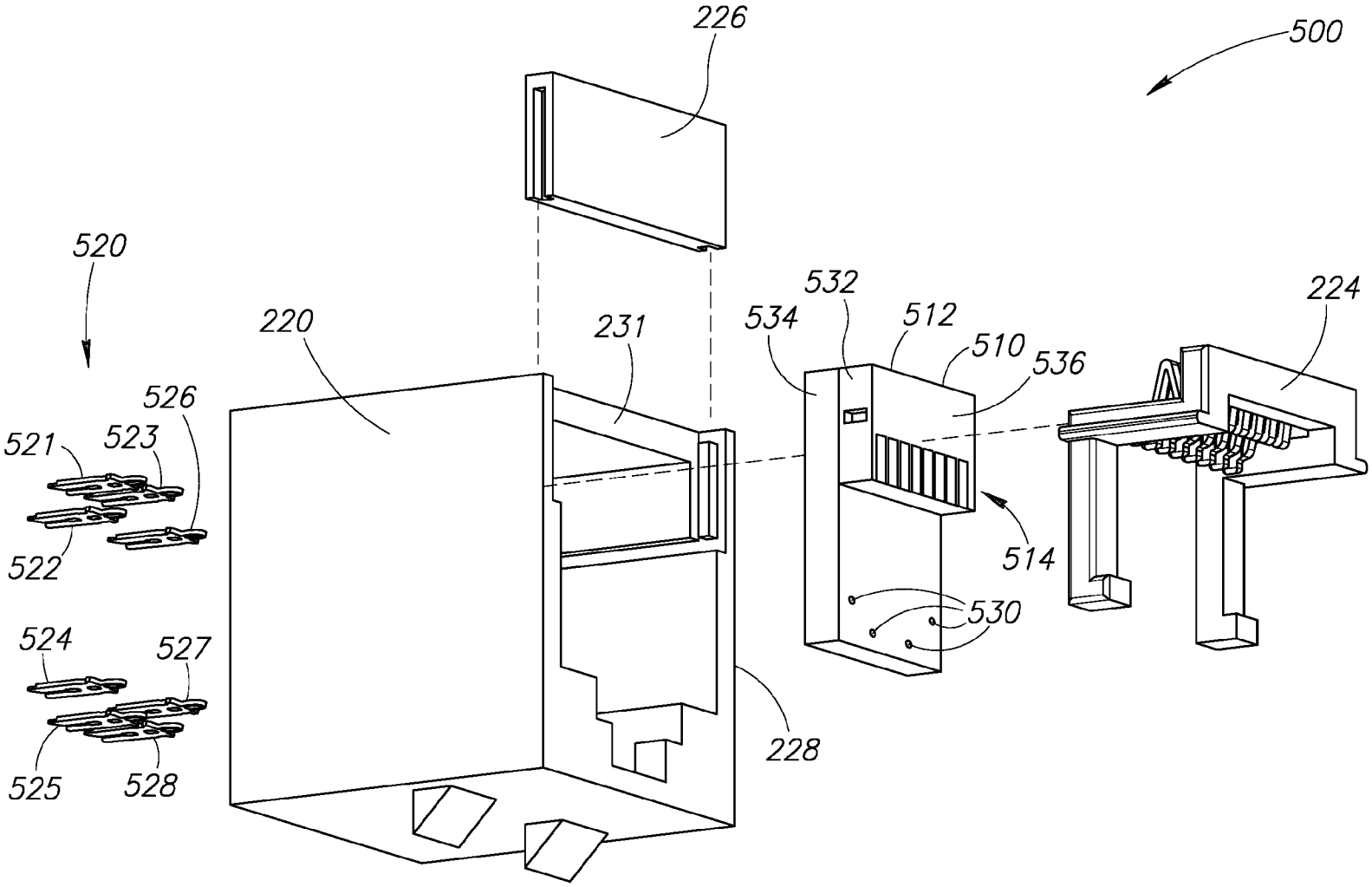
FIG. 15 is an exploded perspective view of a second embodiment of a communication outlet that may be used to form the communication connection of FIG. 5.

FIG. 15 is an exploded perspective view of an outlet 500 that may be used in place of the outlet 210 (see FIGS. 5 and 6) to form the connection 200 illustrated in FIG. 5. Referring to FIG. 15, the outlet 500 includes the outlet housing 220, the biasing member 224, the cover plate 226, a substrate 510, and wire connectors 520. In the embodiment illustrated, the forward support 276 (see FIG. 8) is spaced sufficiently from the rear supports 277 and 278 (see FIG. 8) to permit the substrate 510 to be positioned therebetween.

Figure 1:
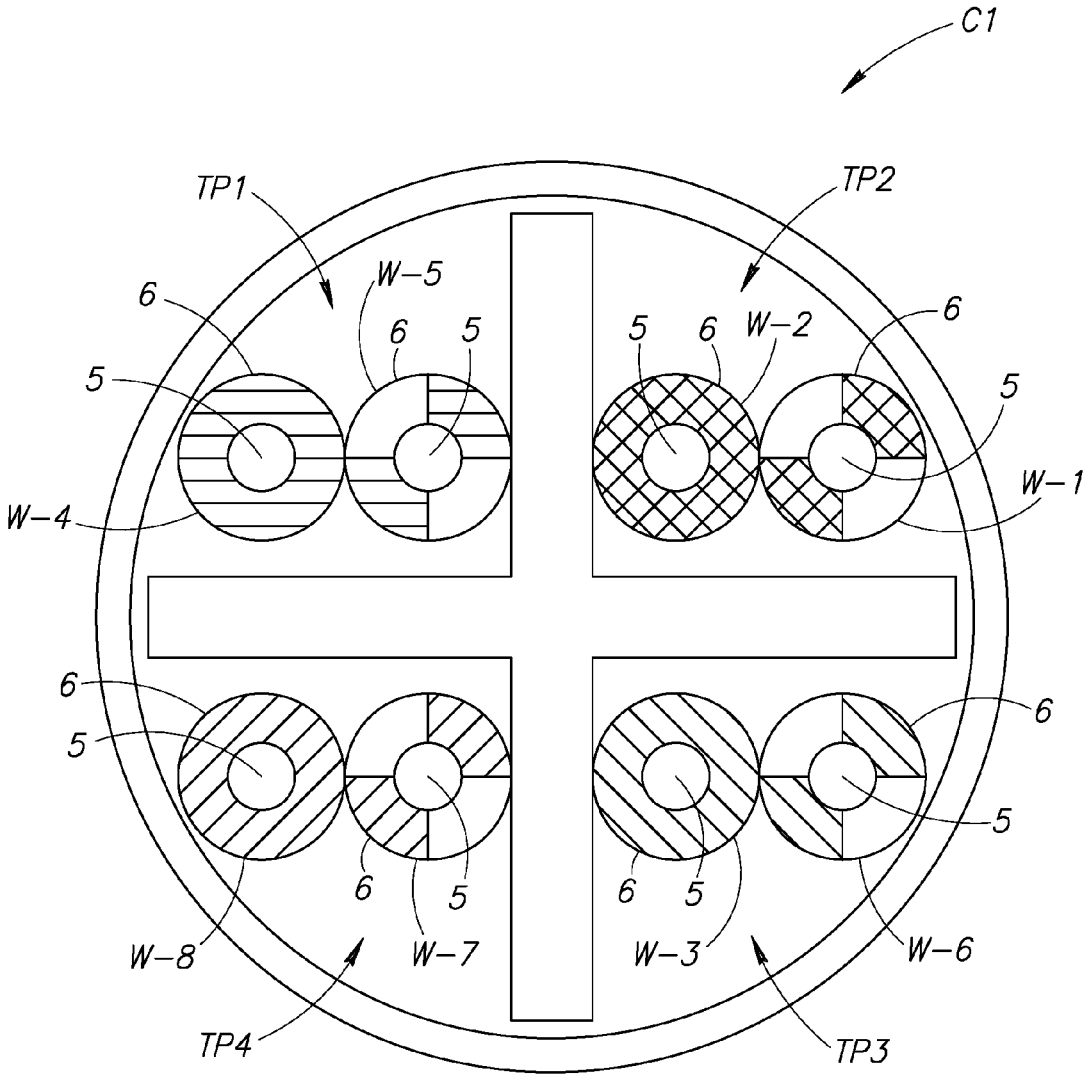
FIG.1 (PRIOR ART)
FIG. 1 is a lateral cross sectional view of a conventional communication cable.

The substrate 510 is configured to terminate a cable, like the cable C1 (see FIG. 1). The substrate 510 includes contact pads 514 that are substantially identical to the contact pads 311-318 (see FIGS. 9A and 9B) and correspond to the plug contacts P1-P8 (see FIG. 3), respectively. Returning to FIG. 15, the wire connectors 520 include wire connectors 521-528 (e.g., IDCs) corresponding to the wires W-1 to W-8 (see FIG. 1), respectively, of the cable like the cable C1 (see FIG. 1). The substrate 510 has a different plated through-hole 530 (like the plated through-hole 110 illustrated in FIGS. 4A and 4B) configured to receive and form electrical connections with each of the wire connectors 520. The substrate 510 also includes electrical connections (not shown) that connect each of the contact pads 514 with both a different one of the plated through-hole 530 and crosstalk compensation components positioned immediately adjacent to the contact pads 514. While not illustrated in the figures, the substrate 510 may include NEXT compensation components (e.g., like the crosstalk compensation region CCR2 illustrated in FIGS. 9A and 9B).

In the embodiment illustrated, the substrate 510 includes a front substrate 532 surface mounted to a back substrate 534. The contact pads 514 are mounted on a front face 536 of the front substrate 532 and the plated through-holes 530 are formed in the back substrate 534. Thus, the electrical connections (not shown) that connect each of the contact pads 514 with a different one of the plated through-hole 530 extend between the front and back substrates 532 and 534.

Third Embodiment of Communication Outlet

Figure 16:
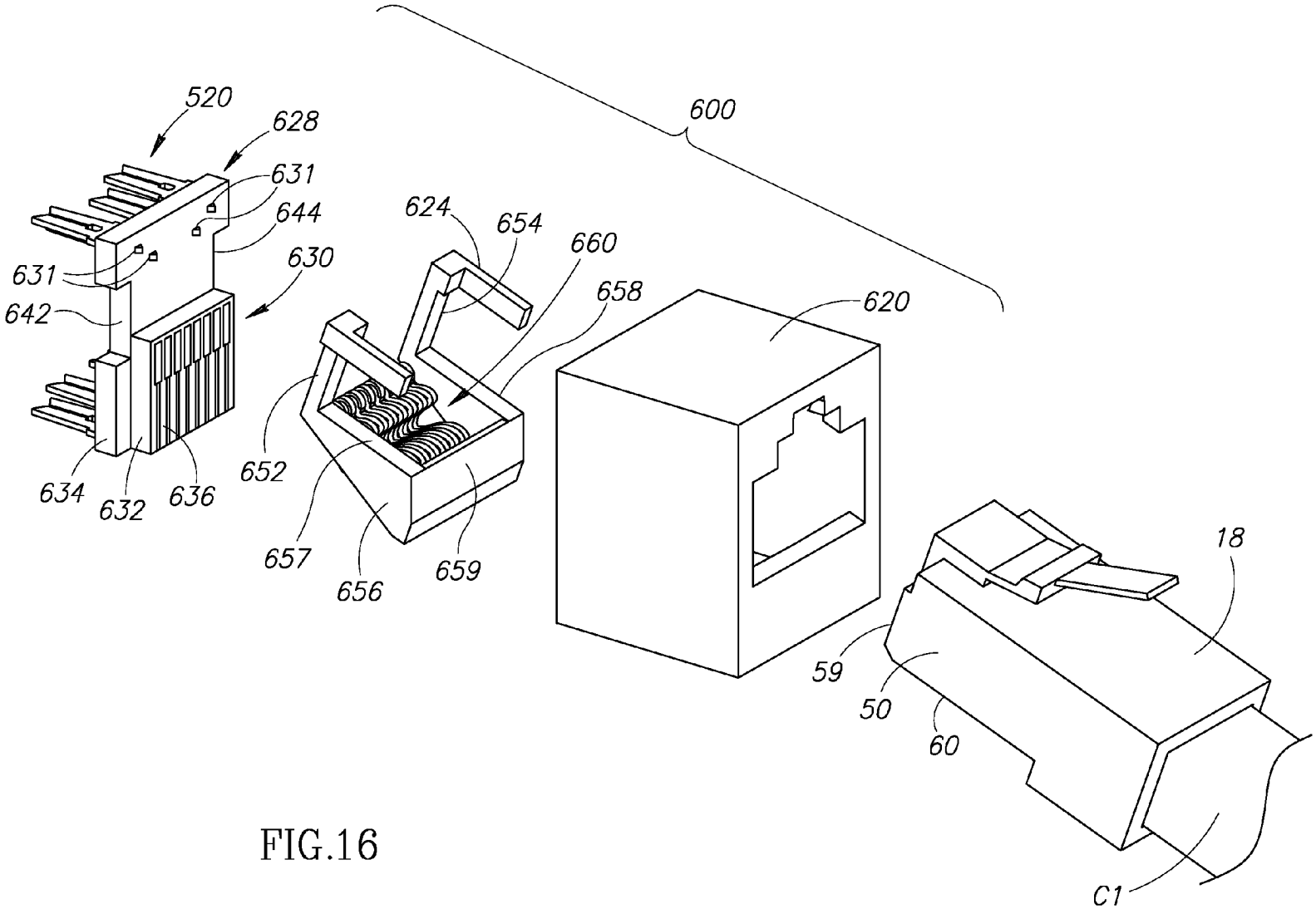
FIG. 16 is an exploded perspective view of a third embodiment of a communication outlet that may be used to form a communication connection with the plug of FIG. 3.

FIG. 16 is an exploded perspective view of an outlet 600 that may be used in place of the outlet 210 (see FIG. 5) to form the connection 200 illustrated in FIG. 5. Referring to FIG. 16, the outlet 600 includes an outlet housing 620, a biasing member 624, a substrate 628, and the wire connectors 520.

The substrate 628 is substantially similar to the substrate 510 (see FIG. 15) and configured to terminate a cable, like the cable C1 (see FIG. 1). The substrate 628 includes contact pads 630 that are substantially identical to the contact pads 311-318 (see FIGS. 9A and 9B) and correspond to the plug contacts P1-P8 (see FIG. 3), respectively. Returning to FIG. 16, the substrate 628 has a different plated through-hole 631 (like the plated through-hole 110 illustrated in FIGS. 4A and 4B) configured to receive and form an electrical connection with each of the wire connectors 520. The substrate 628 also includes electrical connections (not shown) that connect each of the contact pads 630 with a different one of the plated through-holes 631.

In the embodiment illustrated, the substrate 628 includes a front substrate 632 surface mounted to a back substrate 634. The contact pads 630 are mounted on a front face 636 of the front substrate 632 and the plated through-holes 631 configured to receive the wire connectors 520 are formed in the back substrate 634. The wire connectors 520 extend rearwardly from the back substrate 634. Thus, the electrical connections (not shown) that connect each of the contact pads 630 with a different one of the plated through-holes 631 extend between the front and back substrates 632 and 634. While not illustrated in the figures, the front substrate 632 may include NEXT compensation components (e.g., like the crosstalk compensation region CCR2 illustrated in FIGS. 9A and 9B).

The substrate 628 includes cutouts 642 and 644 configured to allow portions of the biasing member 624 to pass therethrough. In the embodiment illustrated, the cutouts 642 and 644 are formed in the back substrate 634. Further, the front substrate 632 is smaller than the back substrate 634 and does not obstruct the cutouts 642 and 644.

The outlet housing 620 is configured to receive the plug 18 at an angle θ (see FIGS. 17B and 17C) with respect to the front face 636 of the front substrate 632. By way of a non-limiting example, the angle θ may be within a range of about zero degrees to about ninety degrees. When the plug 18 encounters the biasing member 624, the plug 18 pushes the biasing member 624 at the angle θ with respect to the front face 636 of the front substrate 632.

Like the biasing member 224 (depicted in FIGS. 6 and 10-13C), the biasing member 624 is configured to be slid inwardly by the plug 18 as the plug 18 is inserted into the outlet 600. The biasing member 624 includes plug engaging members 652 and 654 configured to contact the plug 18 when the plug 18 is inserted into the outlet 600. As the plug 18 is inserted into the outlet 600, the plug 18 presses against the plug engaging members 652 and 654 and pushes the biasing member 624 farther into the outlet housing 620. In the embodiment illustrated, the plug engaging members 652 and 654 are engaged by the front portion 59 of the housing 50 of the plug 18.

The plug engaging members 652 and 654 are connected to a generally U-shaped body portion 656. When the plug 18 engages the plug engaging members 652 and 654, the plug 18 may be adjacent and/or rest upon the body portion 656. The body portion 656 has a first side portion 657 connected to a second side portion 658 by a base portion 659.

The first and second side portions 657 and 658 extend forwardly (or away from the substrate 628) from the plug engaging members 652 and 654, respectively. When the plug 18 is inserted into the outlet 600, the first and second side portions 657 and 658 extend along the upper surface 60 of the plug 18.

A plurality of contact assemblies 660 are mounted to the base portion 659 and extend rearwardly therefrom toward the substrate 628. In the embodiment illustrated, the contact assemblies 660 include eight substantially identical contact assemblies. Together the plug engaging members 652 and 654 and the body portion 656 form a movable sled configured to carry the contact assemblies 660 toward and away from the contact pads 630.

Figure 17A:
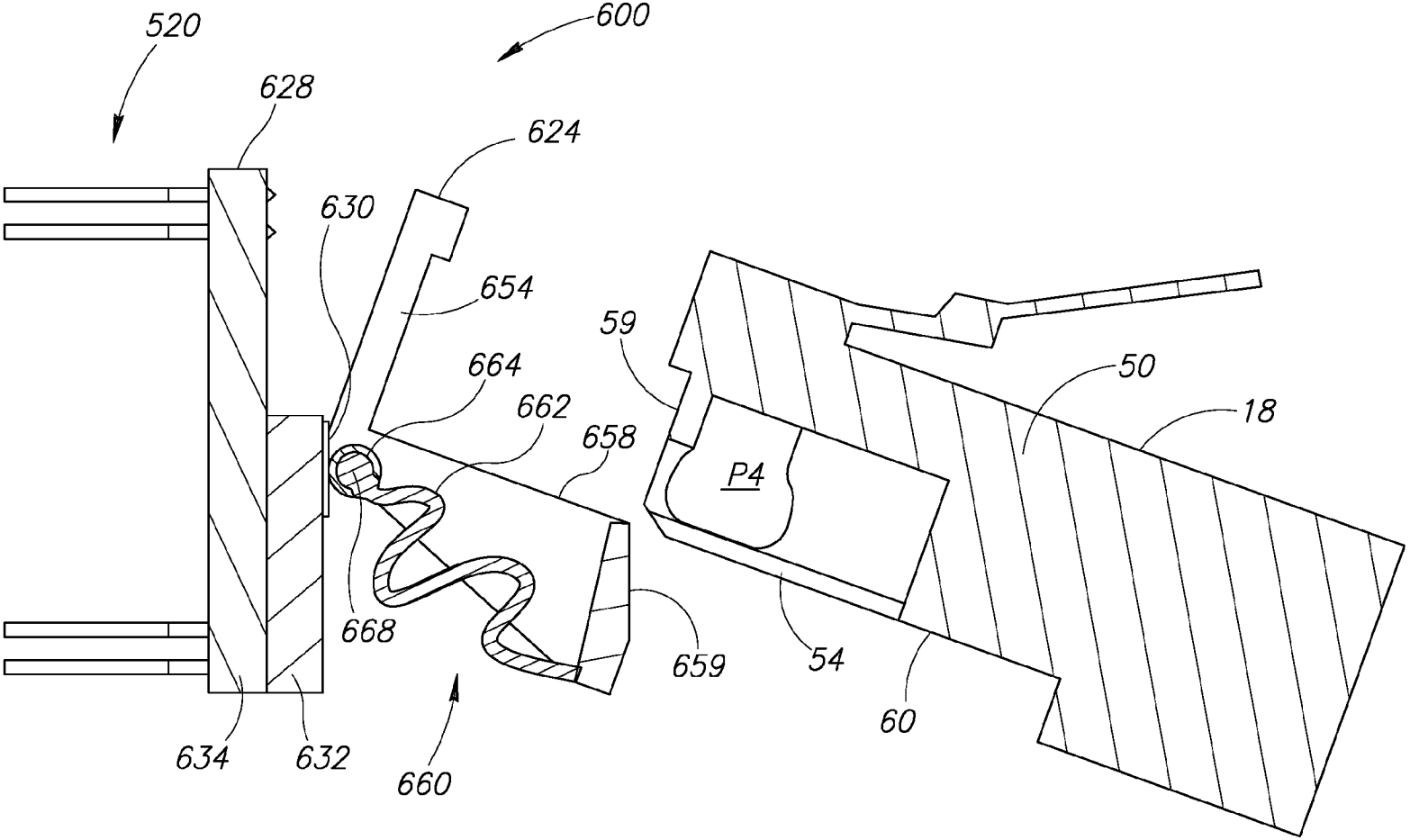
FIG. 17A is a first longitudinal cross sectional view of the outlet of FIG. 16 (omitting its outlet housing) before the plug is inserted into the outlet.
Figure 17B:
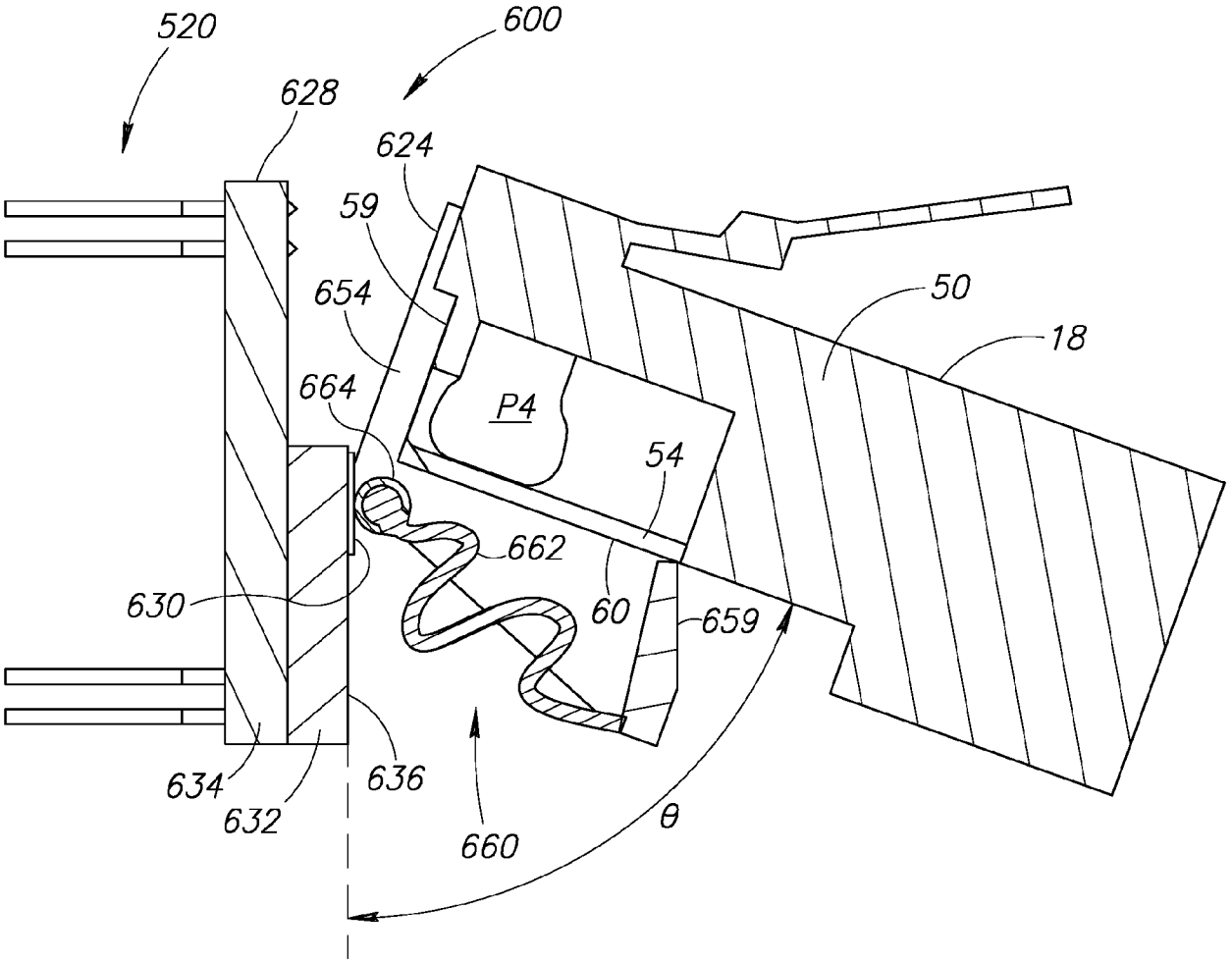
FIG. 17B is a second longitudinal cross sectional view of the outlet of FIG. 16 (omitting its outlet housing) after the plug is partially inserted into the outlet such that the plug first contacts a biasing member.
Figure 17C:
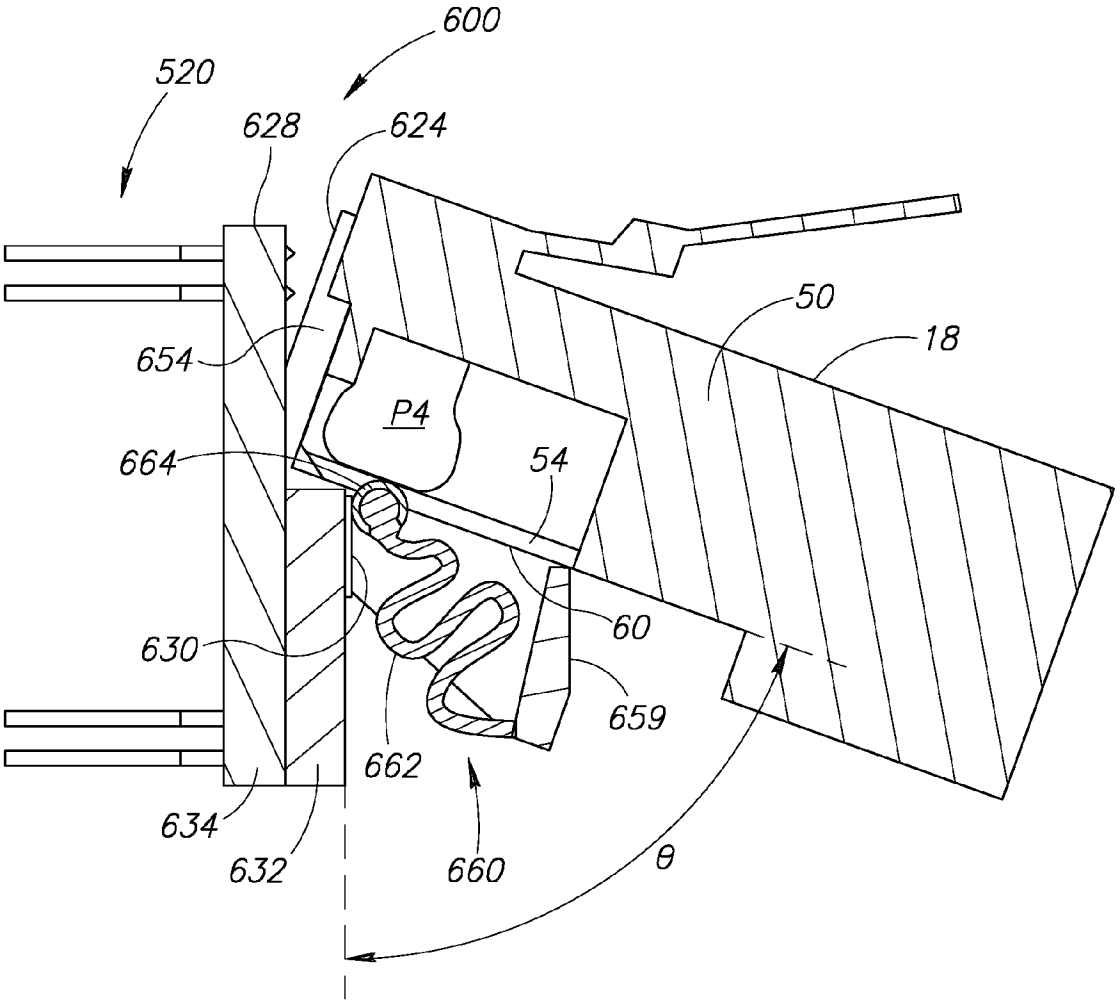
FIG. 17C is a third longitudinal cross sectional view of the outlet of FIG. 16 (omitting its outlet housing) when the plug is fully inserted into the outlet.

FIGS. 17A-17C are cross-sectional views of the plug 18 and the outlet 600 that omit the outlet housing 620 (see FIG. 16) to provide a view of the biasing member 624, the substrate 628, and the wire connectors 520 inside the outlet housing 620. FIGS. 17A-17C show a cross-section of the plug 18 taken through the plug contact P4.

Referring to FIG. 17A, each of the contact assemblies 660 includes an undulating spring 662 and an outlet contact 664. As shown in FIG. 17A, before the plug 18 is inserted into the outlet 600, the outlet contacts 664 of the contact assemblies 660 are in physical contact with the contact pads 630 formed on the substrate 628. Each of the outlet contacts 664 is constructed from a substantially electrically conductive material (e.g., gold plating) and the remainder of the biasing member 624 is constructed from a substantially electrically non-conductive (or insulating) material (e.g., plastic). Each of the outlet contacts 664 may be formed by plating an end portion 668 of one of the undulating springs 662 with a conductive material (e.g., gold). The undulating springs 662 are configured to bias the outlet contacts 664 toward the contact pads 630 and the plug contacts P1-P8 (see FIG. 3) of the plug 18 when the plug 18 is inserted into the outlet 600.

FIG. 17B illustrates the plug 18 partially inserted into the outlet 600. In FIG. 17B, the plug 18 has been inserted far enough to contact the plug engaging members 652 (see FIG. 16) and 654 but not far enough to slide the biasing member 624.

FIG. 17C illustrates the plug 18 fully inserted into the outlet 600. In this embodiment, the plug engaging members 652 and 654 (see FIG. 16) extend into the cutouts 642 and 644 (see FIG. 16), respectively, formed in the back substrate 634 as the biasing member 624 gets closer to the front substrate 632. Insertion of the plug 18 may be halted by a physical barrier (not shown) inside the outlet housing 620 (see FIG. 16). For example, the plug 18 and/or the biasing member 624 may encounter a portion of the outlet housing 620 (see FIG. 16) itself.

As the plug 18 is fully inserted into the outlet 600, the biasing member 624 slides inwardly and presses the contact assemblies 660 against the contact pads 630. This causes the outlet contacts 664 to slide along the contact pads 630 and toward the plug contacts P1-P8 (see FIG. 3). By the time the plug 18 is fully inserted into the outlet 600 as illustrated in FIG. 17C, the undulating springs 662 are pressing the outlet contacts 664 against the plug contacts P1-P8 (see FIG. 3). In the embodiment illustrated, the outlet contacts 664 are each generally C-shaped allowing each of them to contact one of the contact pads 630 formed on the substrate 628, and one of the plug contacts P1-P8 (e.g., the plug contact P4) at the same time.

When the plug 18 is removed from the outlet 600, the undulating springs 662 of the contact assemblies 660 return the biasing member 624 to the position illustrated in FIGS. 16A and 16B.

Fourth Embodiment of Communication Outlet

Figure 18:
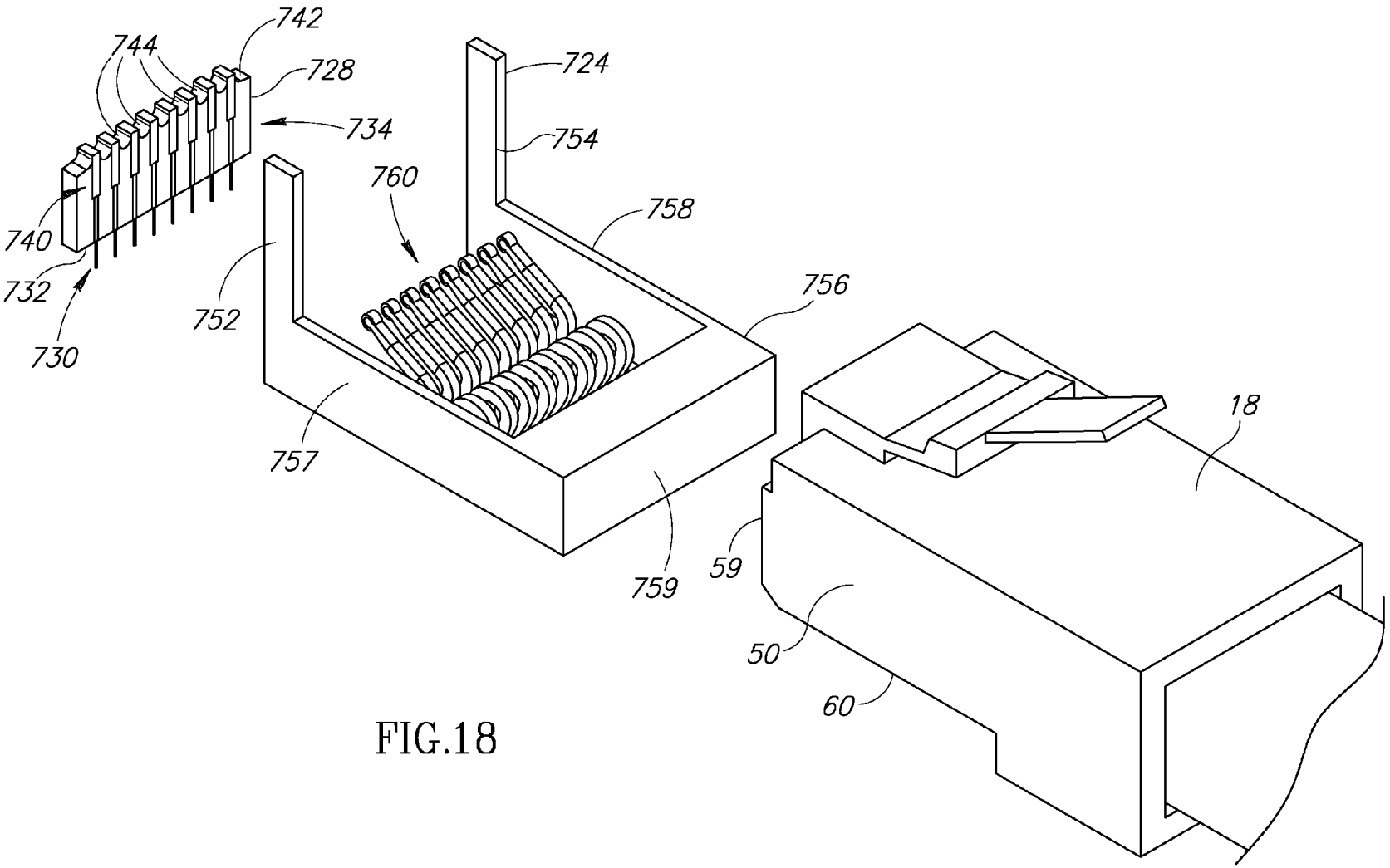
FIG. 18 is an exploded perspective view of embodiments of a biasing member and a substrate that may be used to construct a fourth embodiment of a communication outlet.

FIG. 18 is an exploded perspective view of a biasing member 724 and a scalloped edged substrate 728 that may be positioned inside a suitable outlet housing (similar to the outlet housing 220 illustrated in FIGS. 6-8 and 15) and used to construct an outlet (similar to the outlet 210 illustrated in FIGS. 5 and 6).

The substrate 728 is substantially similar to the substrate 222 (see FIGS. 6, 9A, 9B, and 13A-13C) and includes connectors 730 (substantially similar to the connectors 211-218 illustrated in FIGS. 5, 9A, and 9B) mounted on a first edge portion 732 of the substrate 728. Electrical connections 734 (e.g., traces) connect the connectors 730 with contact pads 740 (substantially similar to the contact pads 311-318 illustrated in FIGS. 9A and 9B). The connectors 730 are configured to form a surface mount solder connection with an external structure (e.g., printed circuit board). By way of a non-limiting example, the connectors 730 may be implemented as solder tail pins. The connectors 730 may be curled or gull-winged. The connectors 730 may be isolated from one another and/or arranged into four pairs corresponding to the four twisted pairs TP1-TP4 (see FIG. 1) of the cable C1 (see FIG. 1).

The substrate 728 has a second edge portion 742 opposite the first edge portion 732. The contact pads 740 are positioned on or near to the second edge portion 742. The second edge portion 742 includes cutouts 744 positioned along both sides of each of the contact pads 740. The cutouts 744 are configured to receive portions of the plug housing 50 (see FIG. 3) positioned alongside the apertures 51-58 (see FIG. 3) so that (as illustrated in FIGS. 19B and 19C) the contact pads 740 may extend at least partially into the apertures 51-58 of the plug housing 50. Thus, the contact pads 740 may be positioned closer to the plug contacts P1-P8 (see FIG. 3) inside the apertures 51-58, respectively, of the plug housing 50. While not illustrated in the figures, the substrate 728 may include NEXT compensation components (e.g., like the crosstalk compensation region CCR2 illustrated in FIGS. 9A and 9B).

Like the biasing member 624 depicted in FIGS. 16-17C, the biasing member 724 is configured to be slid inwardly by the plug 18. The biasing member 724 includes plug engaging members 752 and 754 configured to contact the plug 18 when the plug 18 is inserted into the outlet (not shown). As the plug 18 is inserted, the plug 18 presses against the plug engaging members 752 and 754 and pushes the biasing member 724 farther into the outlet housing (not shown). In the embodiment illustrated, the plug engaging members 752 and 754 are engaged by the front portion 59 of the housing 50 of the plug 18.

The plug engaging members 752 and 754 are connected to a generally U-shaped body portion 756. When the plug 18 engages the plug engaging members 752 and 754, the plug 18 may be adjacent and/or rest upon the body portion 756. The body portion 756 has a first side portion 757 connected to a second side portion 758 by a base portion 759. The first and second side portions 757 and 758 extend forwardly (or away from the substrate 728) from the plug engaging members 752 and 754, respectively. When the plug 18 is inserted into the outlet (not shown), the first and second side portions 757 and 758 extend along the upper surface 60 of the plug 18.

A plurality of contact assemblies 760 are mounted to the base portion 759 and extend rearwardly therefrom toward the substrate 728. In the embodiment illustrated, the contact assemblies 760 include eight substantially identical contact assemblies. Together the plug engaging members 752 and 754 and the body portion 756 form a movable sled configured to carry the contact assemblies 760 toward and away from the contact pads 740.

Figure 19A:
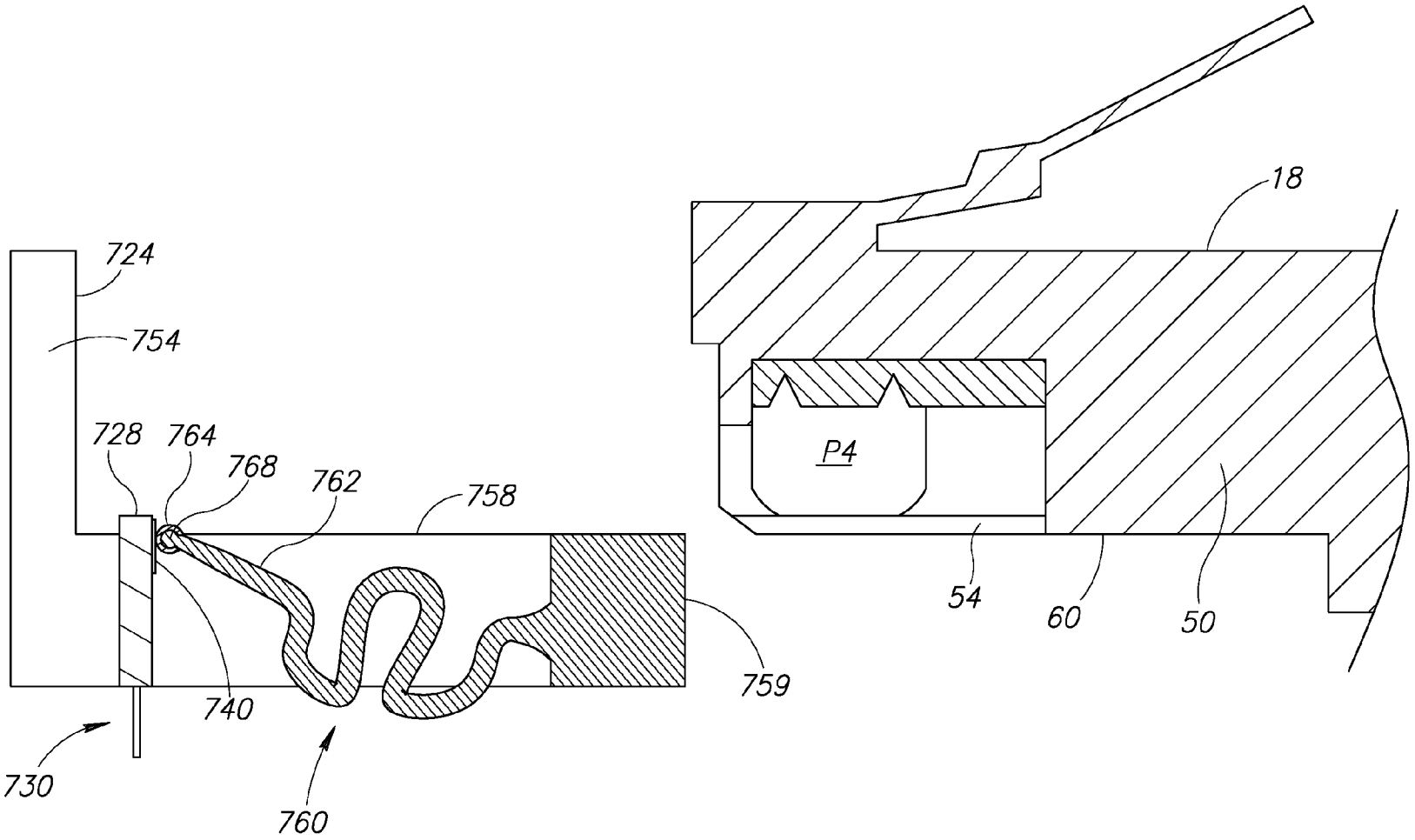
FIG. 19A is a first longitudinal cross sectional view of the biasing member and the substrate of FIG. 18 before the plug first contacts the biasing member.
Figure 19B:
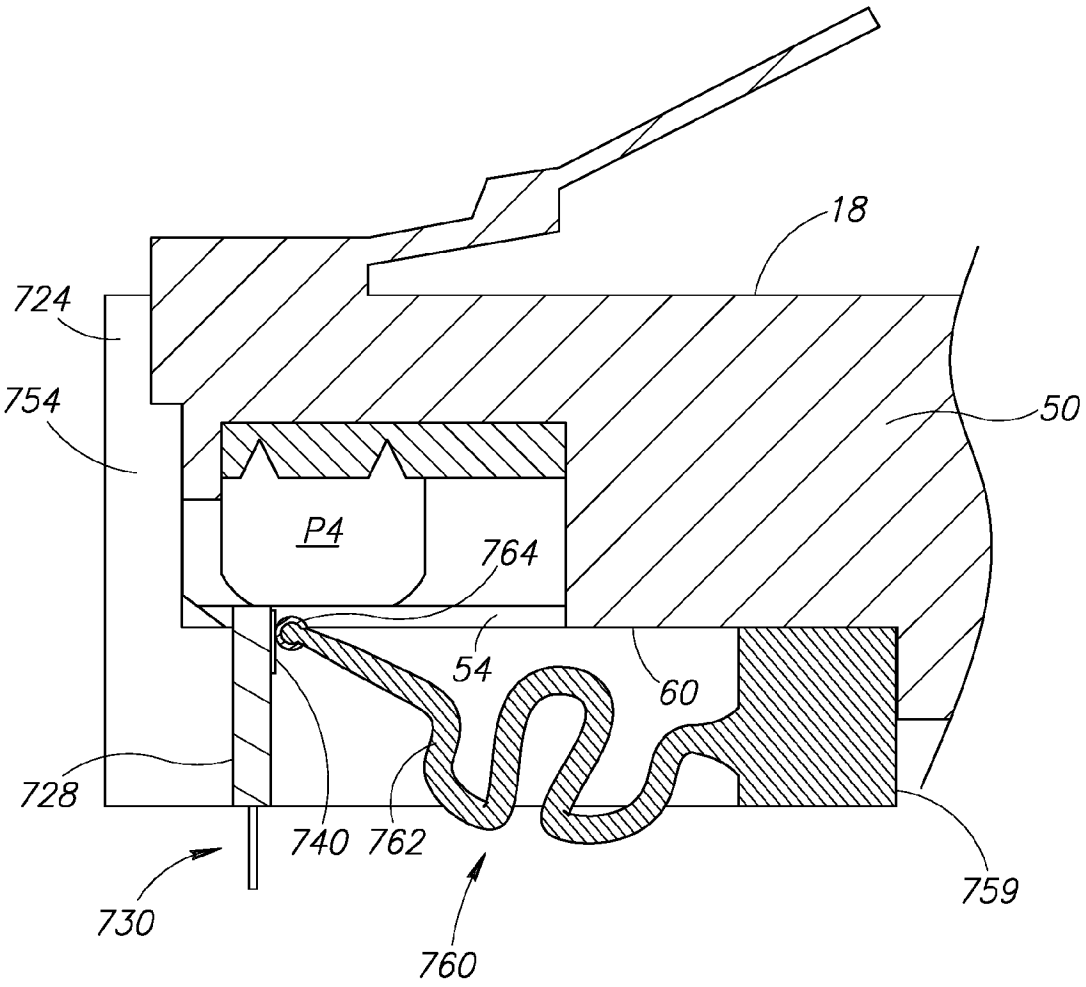
FIG. 19B is a second longitudinal cross sectional view of the biasing member and the substrate of FIG. 18 when the plug first contacts the biasing member.
Figure 19C:
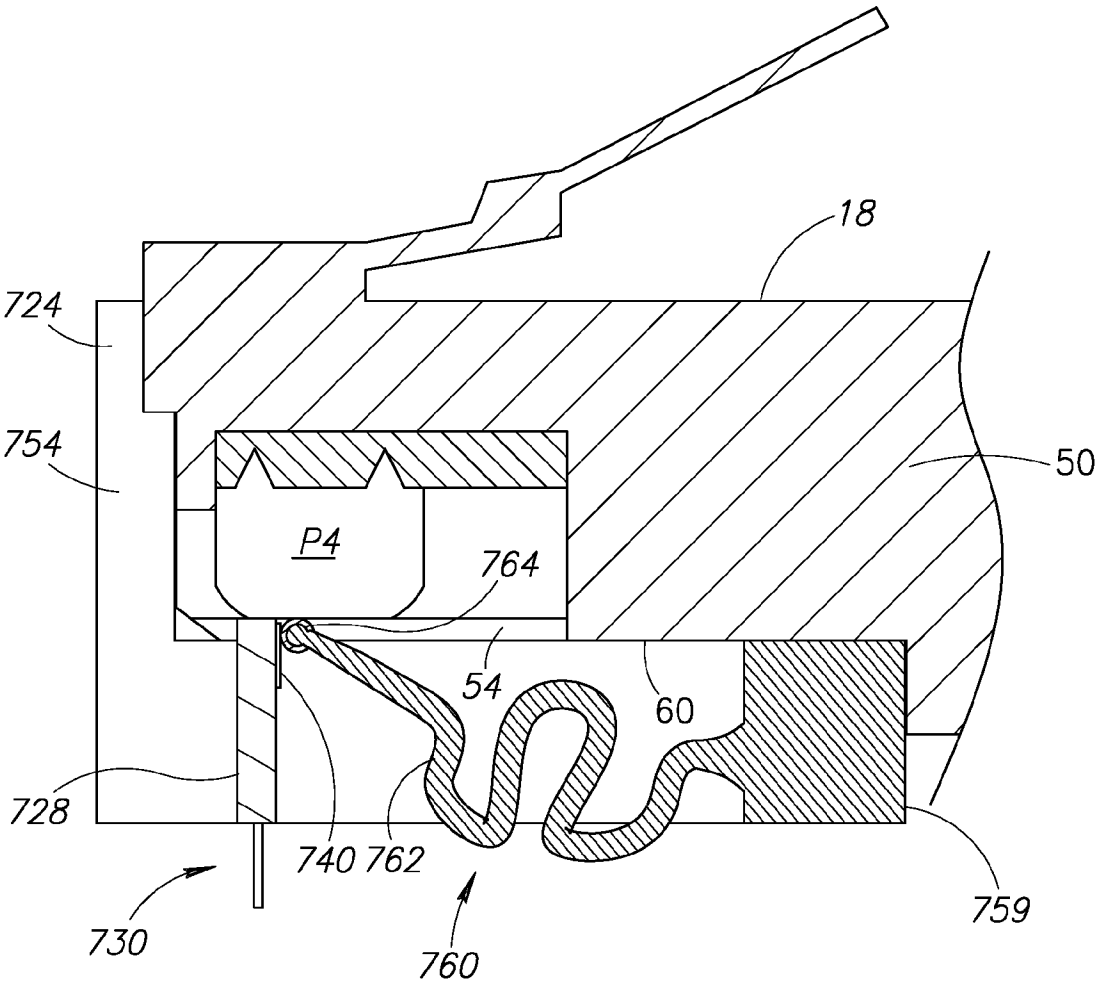
FIG. 19C is a third longitudinal cross sectional view of the biasing member and the substrate of FIG. 18 when a plurality of contact assemblies of the biasing member first contact a plurality of contact pads on the substrate.

FIGS. 19A-19C are cross-sectional views of the plug 18, the biasing member 724, and the substrate 728 that show the interaction between these components. FIGS. 19A-19C show a cross-section of the plug 18 taken through the plug contact P4.

Referring to FIG. 19A, each of the contact assemblies 760 includes an undulating spring 762 and an outlet contact 764. As shown in FIG. 19A, before the plug 18 is inserted into the outlet (not shown), the outlet contacts 764 of the contact assemblies 760 are in physical contact with the contact pads 740 formed on the substrate 728. The outlet contacts 764 may be substantially identical to the outlet contacts 664. The outlet contacts 764 are constructed from a substantially electrically conductive material (e.g., gold plating) and the remainder of the biasing member 724 is constructed from a substantially electrically non-conductive (or insulating) material (e.g., plastic). Each of the outlet contacts 764 may be formed by plating an end portion 768 of one of the undulating springs 762 with a conductive material (e.g., gold). The undulating springs 762 are configured to bias the outlet contacts 764 toward the contact pads 740 and the plug contacts P1-P8 (see FIG. 3) of the plug 18 when the plug 18 is inserted into the outlet (not shown).

FIG. 19B illustrates the plug 18 inserted far enough to contact the plug engaging members 752 (see FIG. 18) and 754 but not far enough to slide the biasing member 724. FIG. 19C illustrates the plug 18 fully inserted into the outlet (not shown). As the plug 18 is fully inserted, the biasing member 724 slides inwardly and presses the contact assemblies 760 against the contact pads 740. This causes the outlet contacts 764 to slide along the contact pads 740 and toward the plug contacts P1-P8 (see FIG. 3). By the time the plug 18 is fully inserted as illustrated in FIG. 19C, the undulating springs 762 are pressing the outlet contacts 764 against the plug contacts P1-P8 (see FIG. 3). In the embodiment illustrated, the outlet contacts 764 are each generally C-shaped allowing each of them to contact one of the contact pads 740 formed on the substrate 728, and one of the plug contacts P1-P8 (e.g., the plug contact P4) at the same time.

Fifth Embodiment of Communication Outlet

Figure 20:
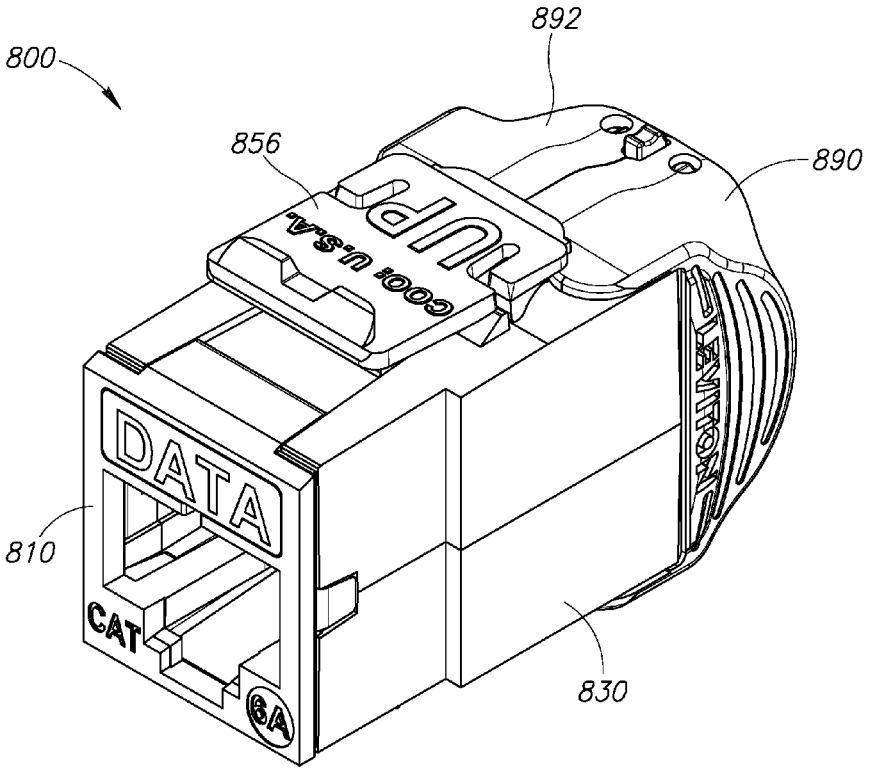
FIG. 20 is a perspective view of a fourth embodiment of a communication outlet that may be used to form a communication connection with the plug of FIG. 3.
Figure 21:
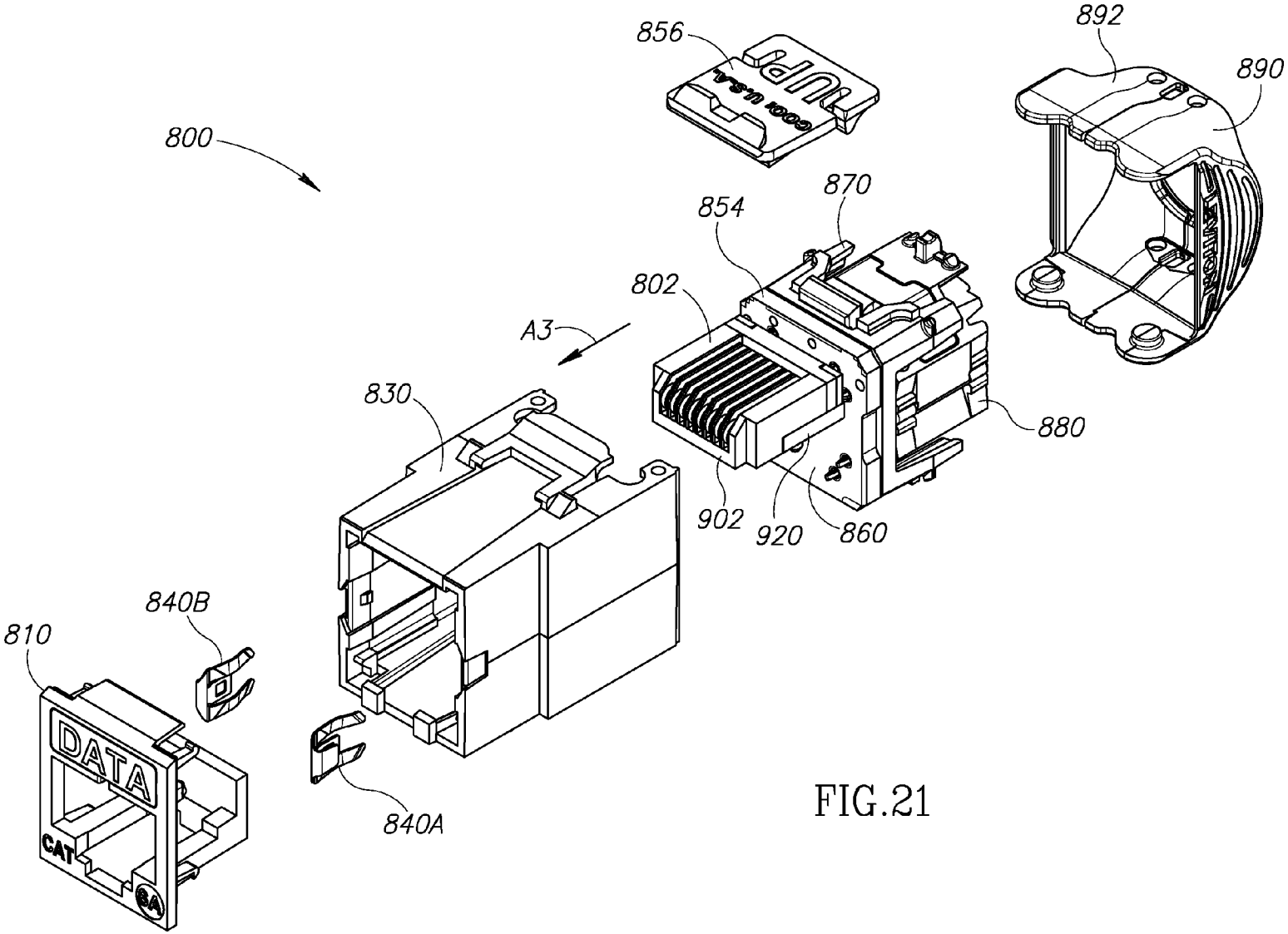
FIG. 21 is a partially exploded perspective view of the communication outlet of FIG. 20.

FIG. 20 is a perspective view of an outlet 800 that may be used in place of the outlet 210 (see FIG. 5) to form the connection 200 illustrated in FIG. 5. FIG. 21 is a partially exploded perspective view of the outlet 800. As shown in FIG. 21, the outlet 800 includes a contact module 802. Other components of the outlet 800 may be conventional and/or substantially identical to components of any of the outlets illustrated and described in U.S. Provisional Patent Application No. 62/289,320, which is incorporated herein by reference, or U.S. patent application Ser. Nos. 14/883,415, 14/685,379, 14/883,267, and 15/135,870, each of which is incorporated herein by reference.

By way of a non-limiting example, the outlet 800 has been illustrated as being implemented using components substantially similar to those of an outlet 120 (described in U.S. patent application Ser. Nos. 14/685,379 and 14/883,267). For example, referring to FIG. 21, the outlet 800 includes the following components:

1. a housing 830 (that is substantially identical to a "housing 330" described in U.S. patent application Ser. Nos. 14/685,379 and 14/883,267);
2. ground springs 840A and 840B (that are substantially identical to "ground springs 340A and 340B" described in U.S. patent application Ser. Nos. 14/685,379 and 14/883,267);
3. an optional clip or latch member 856 (that is substantially identical to a "latch member 356" described in U.S. patent application Ser. Nos. 14/685,379 and 14/883,267);
4. wire contacts 841-848 shown in FIG. 22 (that are each substantially identical to a "wire contacts 1700" described in U.S. patent application Ser. No. 14/883,267);
5. returning to FIG. 21, a guide sleeve 870 (that is substantially identical to a "guide sleeve 370" described in U.S. patent application Ser. Nos. 14/685,379 and 14/883,267);
6. a wire manager 880 (that is substantially identical to a "wire manager 380" described in U.S. patent application Ser. Nos. 14/685,379 and 14/883,267); and
7. housing doors 890 and 892 (that are substantially identical to "housing doors 390 and 392" described in U.S. patent application Ser. Nos. 14/685,379 and 14/883,267).

Figure 22:
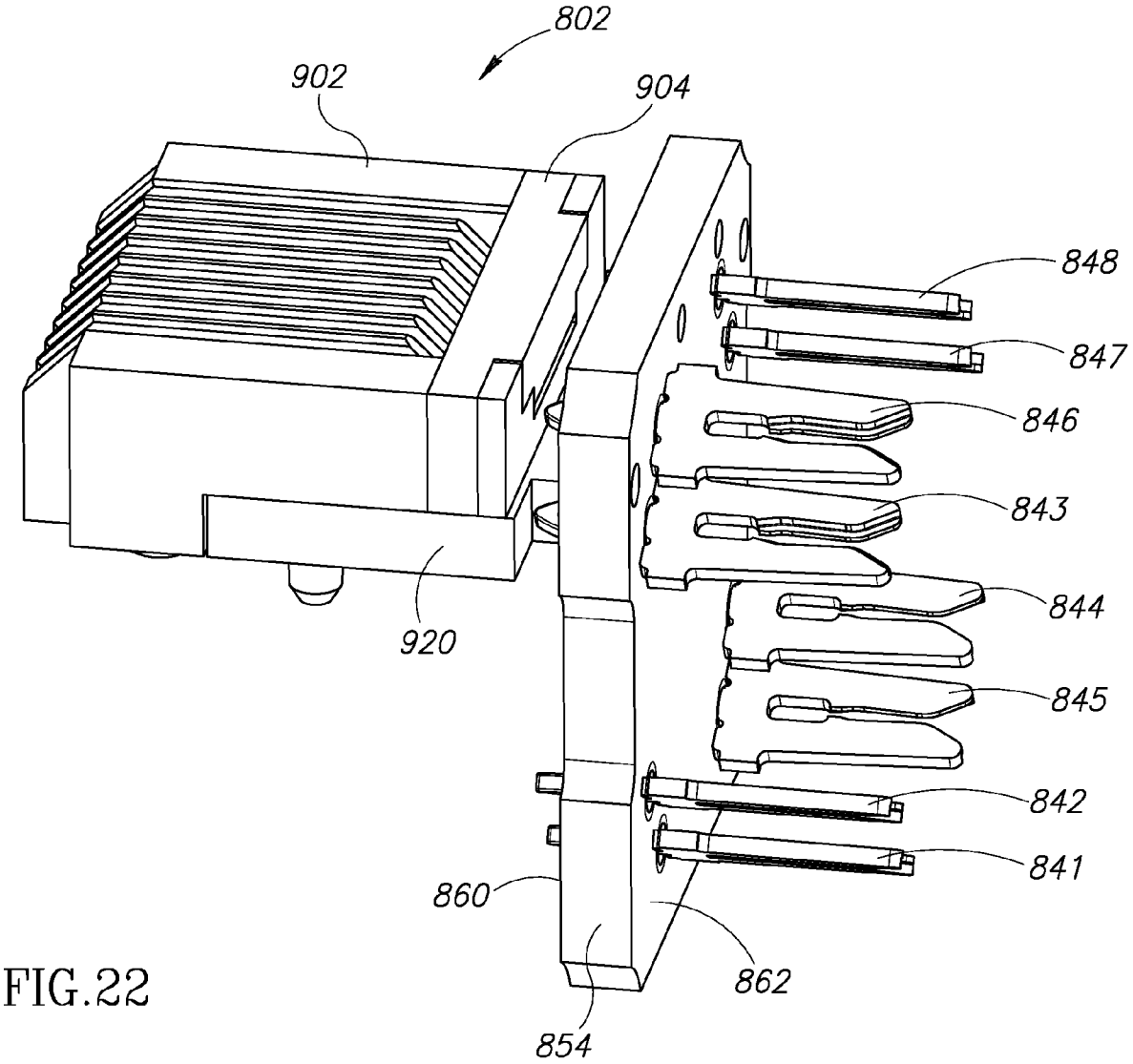
FIG. 22 is a perspective view of a subassembly including a contact module, wire contacts, and first and second substrates of the communication outlet of FIG. 20.

Instead, and in place, of a "substrate 354" described in U.S. patent application Ser. Nos. 14/685,379 and 14/883,267, the outlet 800 includes a first (vertical) substrate 854 (see FIGS. 21 and 22), which may be implemented as a PCB. Referring to FIG. 22, the first (vertical) substrate 854 has a first side 860 opposite a second side 862. Like in the outlet 120 (described in U.S. patent application Ser. Nos. 14/685,379 and 14/883,267), the wire contacts 841-848 are mounted on the second side 862 of the first (vertical) substrate 854. The contact module 802 is mounted on the first side 860 of the first (vertical) substrate 854.

In the outlet 800, the contact module 802 replaces outlet contacts (like "outlet contacts J1-J8" of U.S. patent application Ser. Nos. 14/685,379 and 14/883,267), a spring assembly (like a "spring assembly 350" described in U.S. patent application Ser. Nos. 14/685,379 and 14/883,267), and a contact positioning member (like a "contact positioning member 352" described in U.S. patent application Ser. Nos. 14/685,379 and 14/883,267). Additionally, the outlet 800 illustrated in FIGS. 20 and 21 excludes a locking shutter subassembly (identified by reference numeral "320" in U.S. patent application Ser. Nos. 14/685,379 and 14/883,267) and includes a face plate 810 instead and in place of a face plate (identified by reference numeral "310" in U.S. patent application Ser. Nos. 14/685,379 and 14/883,267) used with the locking shutter subassembly. However, alternative embodiments of the outlet 800 may include a locking shutter subassembly and/or a face plate designed for use with a locking shutter subassembly.

Figure 23:
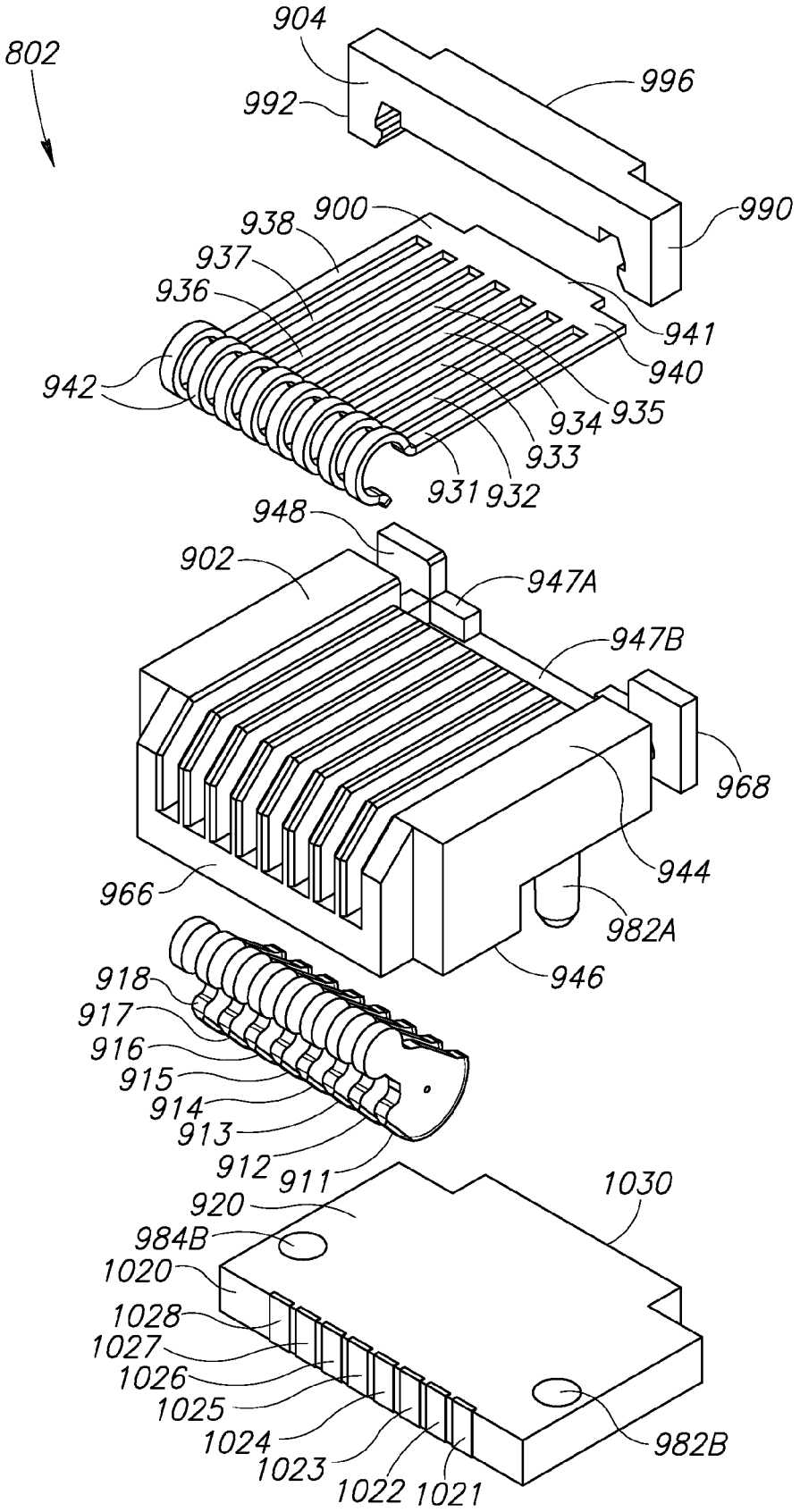
FIG. 23 is an exploded view of the contact module of FIG. 22.

Referring to FIG. 23, the contact module 802 includes a biasing or spring member 900, a spring carrier 902, a retaining member 904, a plurality of movable contact members 911-918, and a second (horizontal) substrate 920 (e.g., a PCB).

The spring member 900 includes a plurality of spring arms 931-938 that correspond (one each) to the contact members 911-918, respectively. In the embodiment illustrated, the spring arms 931-938 are substantially identical to one another. The spring arms 931-938 may each be described as being generally hook-shaped. The spring arms 931-938 are connected together at one end by a transverse connecting portion 940. In the embodiment illustrated, the connecting portion 940 includes a key portion 941. However, this is not a requirement. Opposite the connecting portion 940, each of the spring arms 931-938 has a curved free end 942. The curved free ends 942 of the spring arms 931-938 are spaced apart from one another and configured to grip the contact members 911-918, respectively. Between the connecting portion 940 and their curved free ends 942, the spring arms 931-938 may be substantially planar and parallel to one another.

The spring carrier 902 has an upper portion 944 opposite a lower portion 946. The upper portion 944 has a recess 948 formed therein configured to receive the connecting portion 940 of the spring member 900. In the embodiment illustrated, the recess 948 includes upper and lower keyways 947A and 947B. The lower keyway 947B is configured to receive the key portion 941 of the connecting portion 940.

Figure 25:
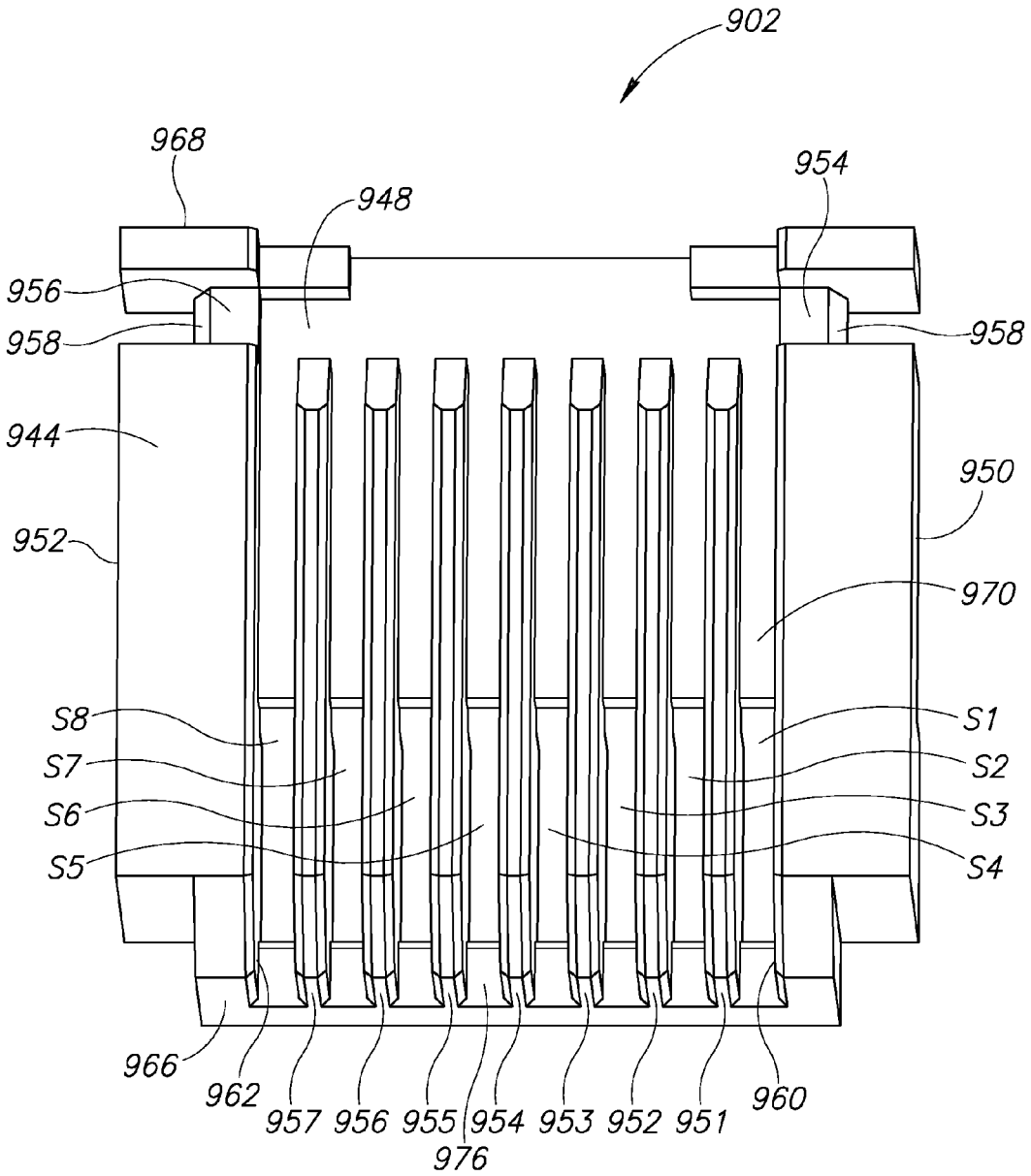
FIG. 25 is a perspective view of an upper portion of a spring carrier of the contact module of FIG. 22.

Referring to FIG. 25, the spring carrier 902 has a first side portion 950 opposite a second side portion 952. The recess 948 extends downwardly along each of the first and second side portions 950 and 952. First and second stops 954 and 956 are positioned inside the recess 948 alongside the first and second side portions 950 and 952, respectively. The first and second stops 954 and 956 are positioned along opposite sides of the connecting portion 940 (see FIG. 23) when the connecting portion 940 is inside the recess 948 and help maintain the spring member 900 (see FIG. 23) in a desired position with respect to the spring carrier 902. The first and second stops 954 and 956 each have an outwardly facing tapered side surface 958. The side surfaces 958 taper toward the upper portion 944 of the spring carrier 902.

The spring carrier 902 includes dividers 951-957 configured to be positioned between adjacent ones of the spring arms 931-938 (see FIG. 23) when the connecting portion 940 (see FIG. 23) is positioned inside the recess 948. The spring carrier 902 also has first and second stop walls 960 and 962 that are substantially parallel with the dividers 951-957. The dividers 951-957 and the first and second stop walls 960 and 962 extend between forward and rearward portions 966 and 968 of the spring carrier 902.

The dividers 951-957 define slots S2-S7. A slot S1 is defined between the divider 951 and the first stop wall 960. A slot S8 is defined between the divider 957 and the second stop wall 962. The slots S1-S8 are configured to receive the spring arms 931-938 (see FIG. 23), respectively, and help position them relative to the second (horizontal) substrate 920 (see FIGS. 22 and 23).

A platform 970 extends transversely between the first and second stop walls 960 and 962. The platform 970 extends forwardly from the rearward portion 968 partway toward the forward portion 966. The platform 970 supports the connecting portion 940 (see FIG. 23) of the spring member 900 (see FIG. 23) and portions of the spring arms 931-938 (see FIG. 23) near the connecting portion 940.

Figure 24:
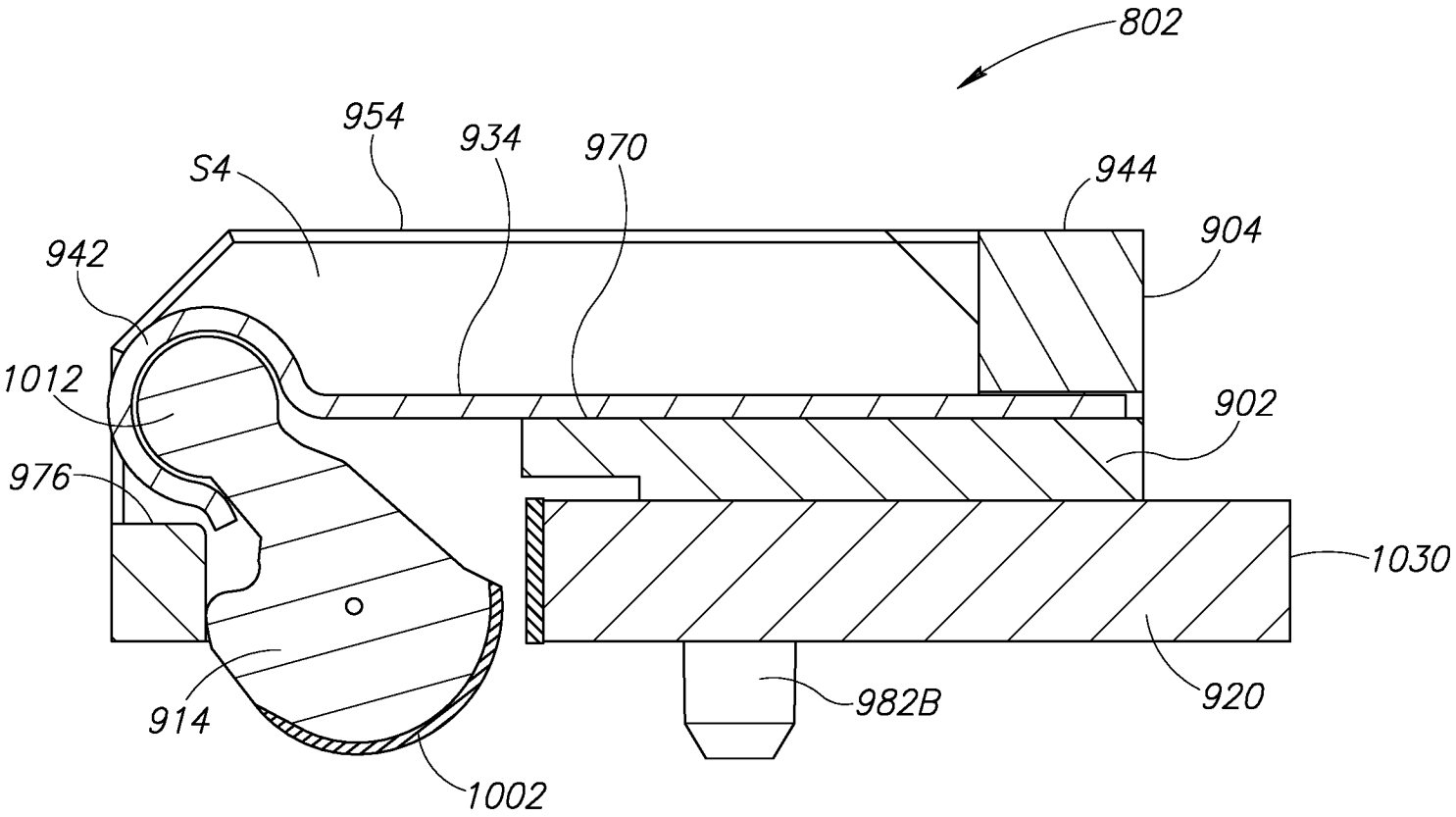
FIG. 24 is a longitudinal cross-sectional view of the contact module coupled to the second (horizontal) substrate of FIG. 22.

An upwardly facing stop wall 976 extends between the first and second stop walls 960 and 962 at the forward portion 966. The curved free ends 942 (see FIG. 23) of the spring arms 931-938 (see FIG. 23) are positioned adjacent to the stop wall 976. However, as shown in FIG. 24, the curved free ends 942 (see FIG. 23) of the spring arms 931-938 (see FIG. 23) may be spaced apart from the stop wall 976. In the embodiment illustrated, the platform 970 is spaced apart vertically from the stop wall 976 so that the platform 970 is closer to the upper portion 944 than the stop wall 976 is.

Figure 26:
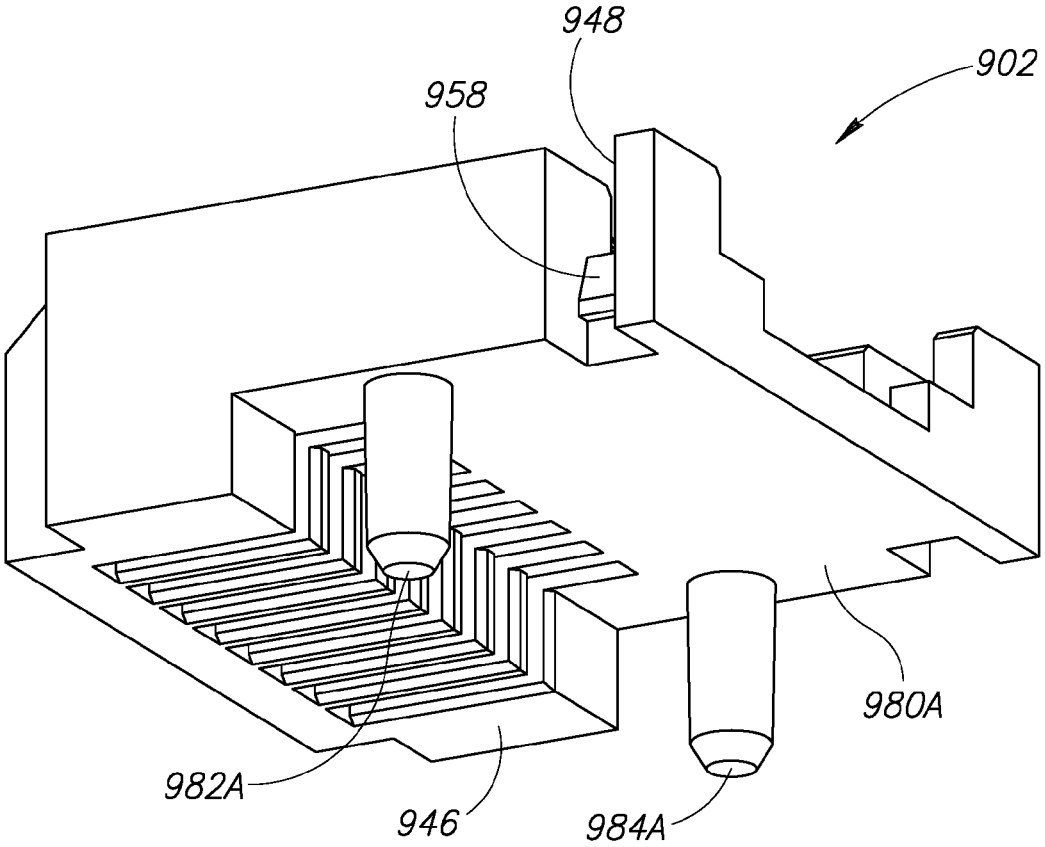
FIG. 26 is a perspective view of a lower portion of the spring carrier of FIG. 25.

Referring to FIG. 26, the lower portion 946 includes a recess 980A configured to receive the second (horizontal) substrate 920 (see FIGS. 22-24). One or more mounting pegs 982A and 984A extend downwardly from the recess 980. Each of the mounting peg(s) 982A and 984A is configured to be received inside a corresponding aperture 982B and 984B (see FIG. 23) formed in the second (horizontal) substrate 920 (see FIGS. 22-24).

Referring to FIG. 23, the retaining member 904 is configured to be received inside the recess 948 and to trap the connecting portion 940 of the spring member 900 against the spring carrier 902. Portions of the spring arms 931-938 extend away from the retaining member 904 toward the forward portion 966 of the spring carrier 902. Referring to FIG. 24, the curved free ends 942 of the spring arms 931-938 (see FIG. 23) are free to move upwardly and downwardly within the slots S1-S8 (see FIGS. 24 and 25), respectively.

Figure 27:
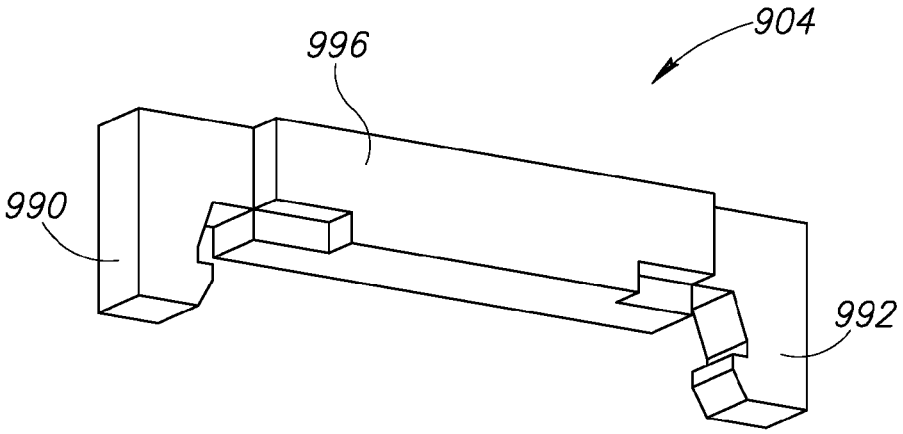
FIG. 27 is a perspective view of a rearward facing portion of a retaining member of the contact module of FIG. 22.

Referring to FIG. 23, the retaining member 904 has first and second downward extending gripping arms 990 and 992. The gripping arms 990 and 992 are configured to grip or clip onto the first and second stops 954 and 956 (see FIG. 25), respectively. The retaining member 904 has a rearwardly projecting key member 996 (see also FIG. 27) configured to be received inside the upper keyway 947A. As mentioned above, the lower keyway 947B is configured to receive the key portion 941 of the connecting portion 940. An upper portion of the lower keyway 947B may also be configured to receive a lower portion of the key member 996.

Figure 28:
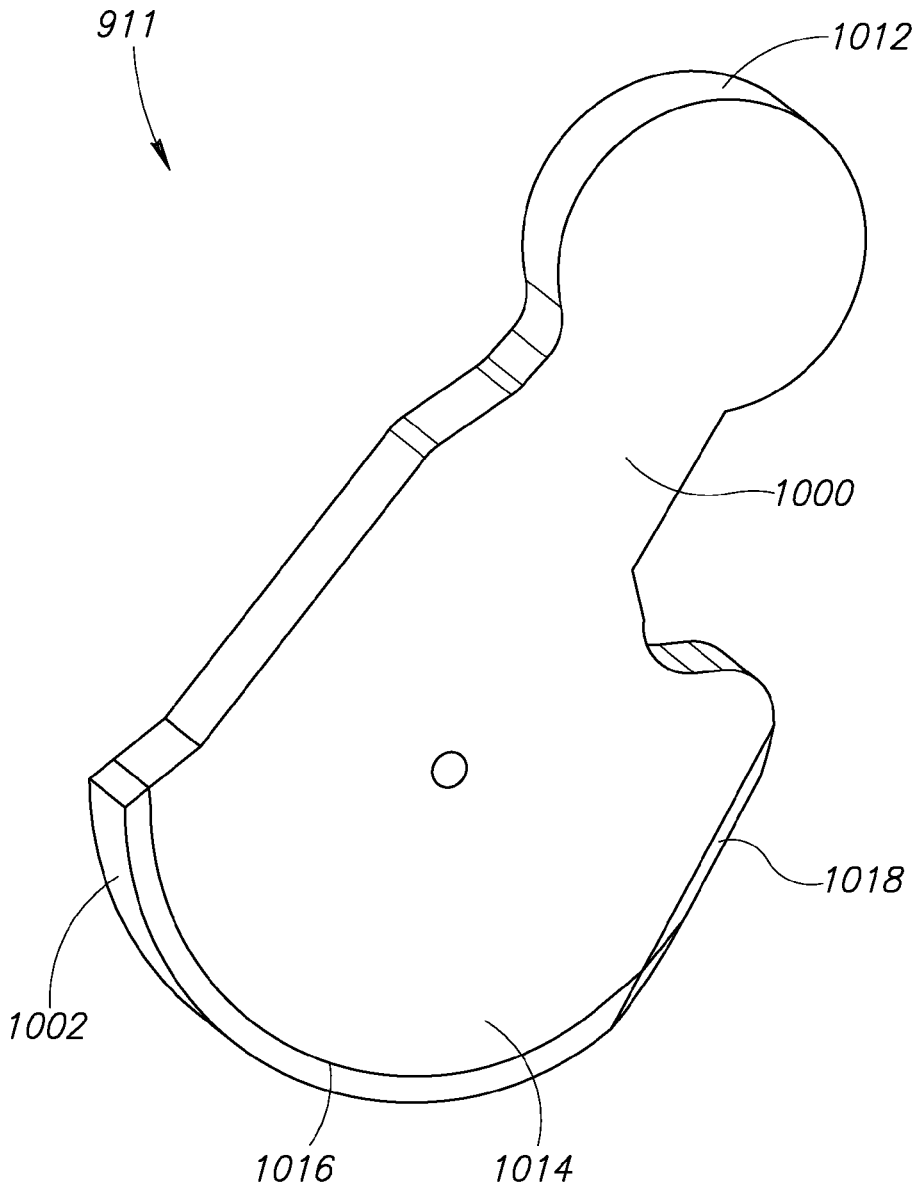
FIG. 28 is a perspective view of a side portion of a contact member of the contact module of FIG. 22.

The contact members 911-918 are substantially identical to one another. Therefore, for the sake of brevity, only the contact member 911 will be described in detail. Referring to FIG. 28, the contact member 911 has an electrically non-conductive body 1000 and an electrical contact 1002. The body 1000 has an upper portion 1012 opposite a lower portion 1014. In the embodiment illustrated, the upper portion 1012 has a generally round outer shape. As shown in FIG. 24, the upper portion 1012 is configured to be gripped by the curved free end 942 of the spring arm 931 (see FIG. 23).

Figure 29A:
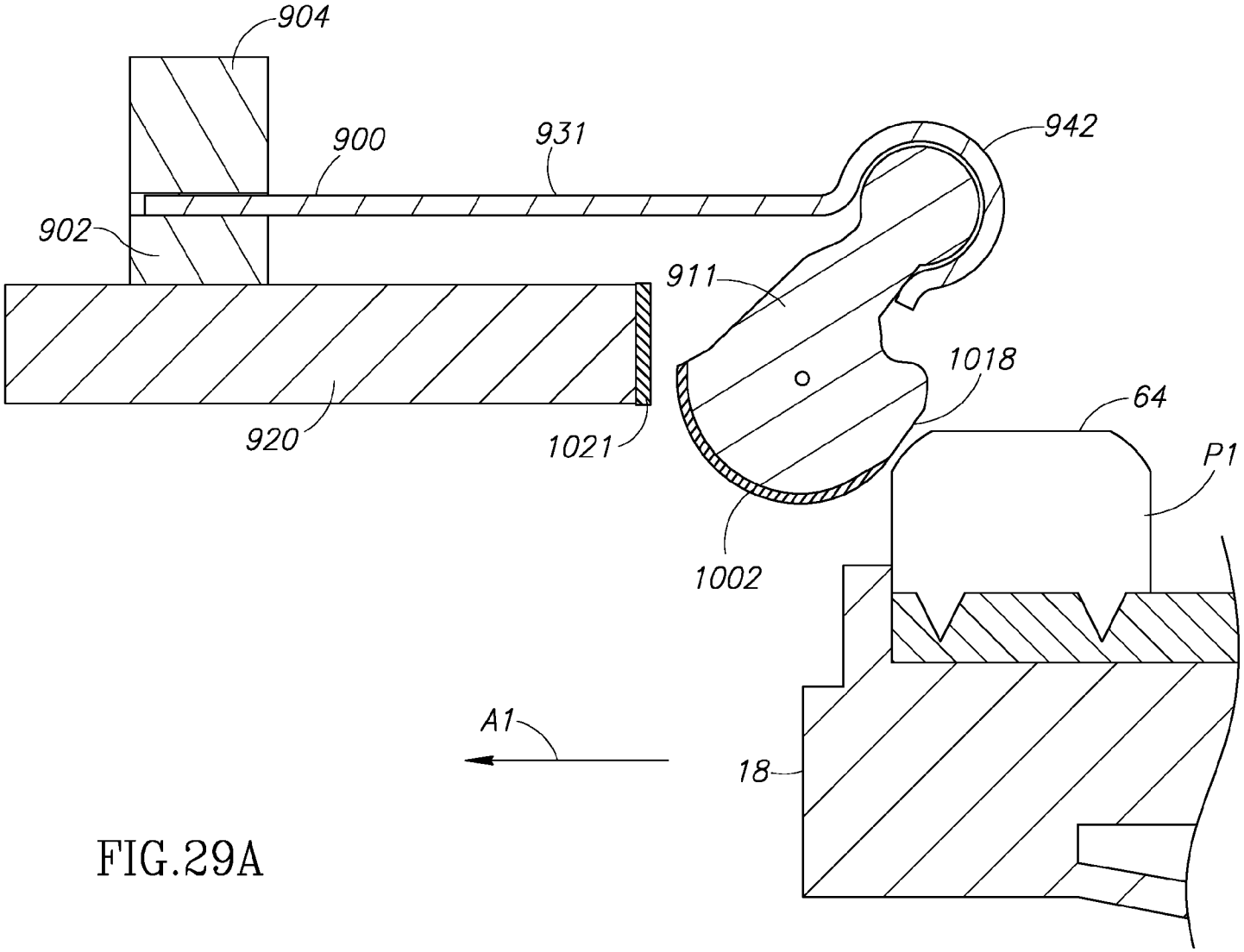
FIG. 29A is a longitudinal cross-sectional view of selected components of the communication outlet of FIG. 20 illustrated before the plug of FIG. 3 contacts the contact member of FIG. 28.

Returning to FIG. 28, the contact 1002 is positioned on a lower surface 1016 of the lower portion 1014. By way of non-limiting examples, the contact member 911 may be constructed by molding the body 1000 over the contact 1002, snapping the contact 1002 onto the body 1000, and the like. The lower surface 1016 and the contact 1002 both have a curved shape. A forward engagement surface 1018 extends upwardly from the lower surface 1016. In the embodiment illustrated, the contact 1002 extends onto a lower portion of the forward engagement surface 1018. The forward engagement surface 1018 is positioned to engage with the plug contact P1 (see FIGS. 29A-29D) and slide along the plug contact P1 as the plug 18 (see FIGS. 29A-29D) is inserted into the outlet 800 (see FIGS. 20 and 21). As shown in FIG. 29A, the spring arm 931 positions the contact member 911 such that the forward engagement surface 1018 is at an angle with respect to the upper surface 64 of the plug contact P1.

Referring to FIG. 23, the second (horizontal) substrate 920 has a forwardly facing surface 1020 with contact pads 1021-1028 positioned thereupon. The contact pads 1021-1028 are electrically connected by conductors (e.g., circuit traces, not shown) formed on the substrates 920 and 854 (see FIGS. 21 and 22) to the wire contacts 841-848 (see FIG. 22). While not illustrated in the figures, one or both of the substrates 920 and 854 (see FIGS. 21 and 22) may include NEXT compensation components (e.g., like the crosstalk compensation region CCR2 illustrated in FIGS. 9A and 9B). As mentioned above, the second (horizontal) substrate 920 includes the aperture(s) 982B and 984B, which are configured to receive the mounting peg(s) 982A and 984A.

Opposite the forwardly facing surface 1020, the second (horizontal) substrate 920 has a rearwardly facing surface 1030. Referring to FIGS. 21 and 22, the rearwardly facing surface 1030 (see FIG. 23) of the second (horizontal) substrate 920 is mounted to the first side 860 of the first (vertical) substrate 854. The rearwardly facing surface 1030 may be mounted to the first side 860 of the first (vertical) substrate 854 using any method known in the art, including using welding, an adhesive, and the like. In the embodiment illustrated, the first and second substrates 854 and 920 are substantially orthogonally to one another. However, this is not a requirement.

Referring to FIG. 23, the contact module 802 may be constructed by snapping the curved free ends 942 of the spring arms 931-938 onto the upper portion 1012 of the contact members 911-918 to form a first subassembly. Then, the first subassembly is inserted into the spring carrier 902 with the connecting portion 940 of the spring member 900 positioned inside the recess 948 and the spring arms 931-938 positioned inside the slots S1-S8 (see FIG. 25), respectively. As shown in FIG. 24, the contact members 911-918 extend downwardly from the spring carrier 902. Returning to FIG. 23, the retaining member 904 is positioned inside the recess 948 and the gripping arms 990 and 992 are clipped onto the first and second stops 954 and 956 (see FIG. 25), respectively, with the rearwardly projecting key member 996 (see also FIG. 27) being received inside the upper keyway 947A and optionally part of the lower keyway 947B.

Returning to FIG. 23, after the contact module 802 has been assembled, the spring carrier 902 is attached to the second (horizontal) substrate 920 by inserting the mounting peg(s) 982A and 984A into the aperture(s) 982B and 984B. As mentioned above, the rearwardly facing surface 1030 of the second (horizontal) substrate 920 is mounted to the first side 860 of the first (vertical) substrate 854. Then, referring to FIG. 21, the subassembly of the contact module 802 and substrates 920 and 854 is inserted into the housing 830 in a longitudinal direction identified by an arrow A3. Referring to FIG. 22, the wire contacts 841-848 may be inserted into the substrate 854 before the subassembly illustrated in FIG. 22 is inserted into the housing 830 (see FIGS. 20 and 21). Referring to FIG. 21, the spring carrier 902 limits lateral movement of the contact module 802 inside the housing 830.

Turning now to FIGS. 29A-29D, the operation of the contact module 802, when the plug 18 is inserted into the outlet 800 (see FIGS. 20 and 21), will be described. For ease of illustration, FIGS. 29A-29D depict only the contact member 911 and the plug contact P1. However, the contact members 912-918 (which are arranged side-by-side in a parallel arrangement with the contact member 911) function in the same manner with respect to the plug contacts P2-P8 as the contact member 911 functions with respect to the plug contact P1.

Figure 29B:
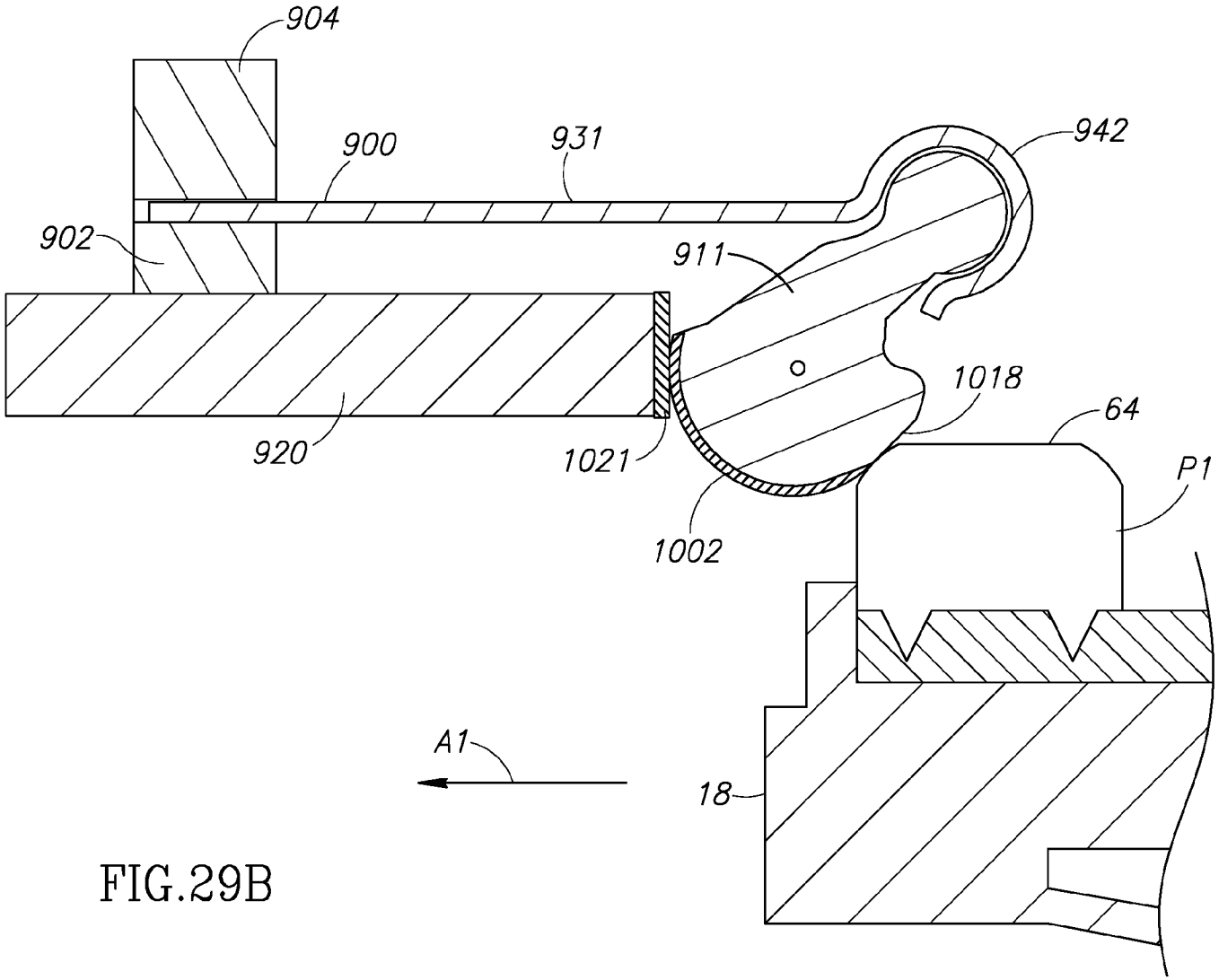
FIG. 29B is a longitudinal cross-sectional view of the selected components of FIG. 29A illustrated when the plug of FIG. 3 first contacts the contact member of FIG. 28.

Referring to FIG. 29A, before the plug contact P1 contacts the contact member 911, the contact member 911 is spaced apart from the contact pad 1021 of the second (horizontal) substrate 920. Referring to FIG. 29B, as the plug 18 is inserted into the outlet 800 (see FIGS. 20 and 21) along an insertion direction (indicated by an arrow A1), the electrically non-conductive forward engagement surface 1018 contacts the plug contact P1. The plug contact P1 pushes the contact member 911 toward the second (horizontal) substrate 920 until the contact 1002 is positioned against (and forms an electrical connection with) the contact pad 1021 of the second (horizontal) substrate 920.

Figure 29C:
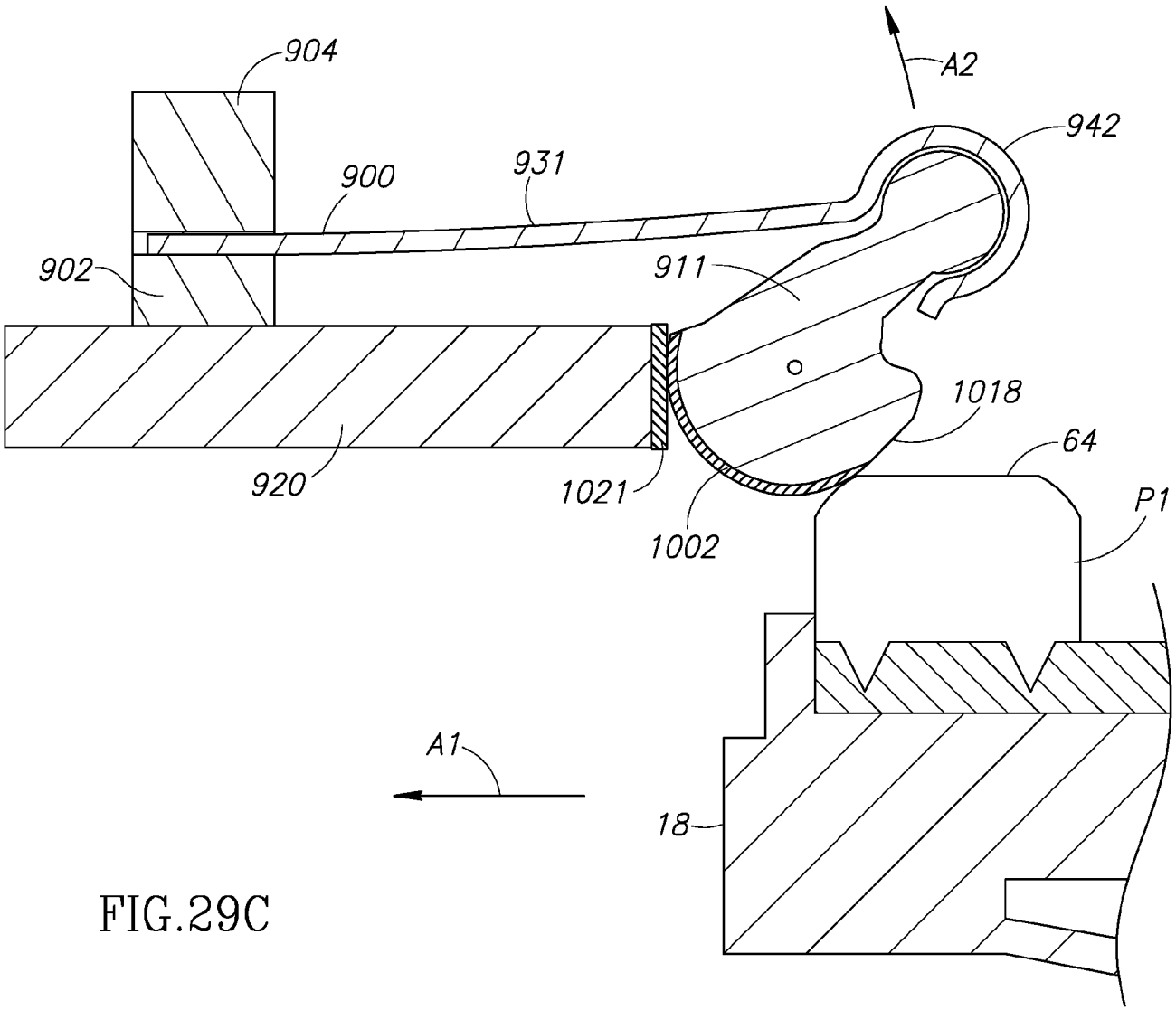
FIG. 29C is a longitudinal cross-sectional view of the selected components of FIG. 29A illustrated with the plug of FIG. 3 inserted further into the communication outlet.

Referring to FIG. 29C, as the plug 18 is inserted further into the outlet 800 (see FIGS. 20 and 21), the contact member 911 is pressed between the contact pad 1021 and the plug contact P1 causing the forward engagement surface 1018 to slide along the plug contact P1. As the forward engagement surface 1018 slides, the spring arm 931 deflects along a direction (indicated by a curved arrow A2) allowing the contact member 911 to move vertically with respect to both the second (horizontal) substrate 920 and the plug 18. Thus, the contact member 911 is movable with respect to the contact pad 1021 and slides therealong. However, the contact member 911 remains in contact with the contact pad 1021 as the plug 18 is inserted.

Figure 29D:
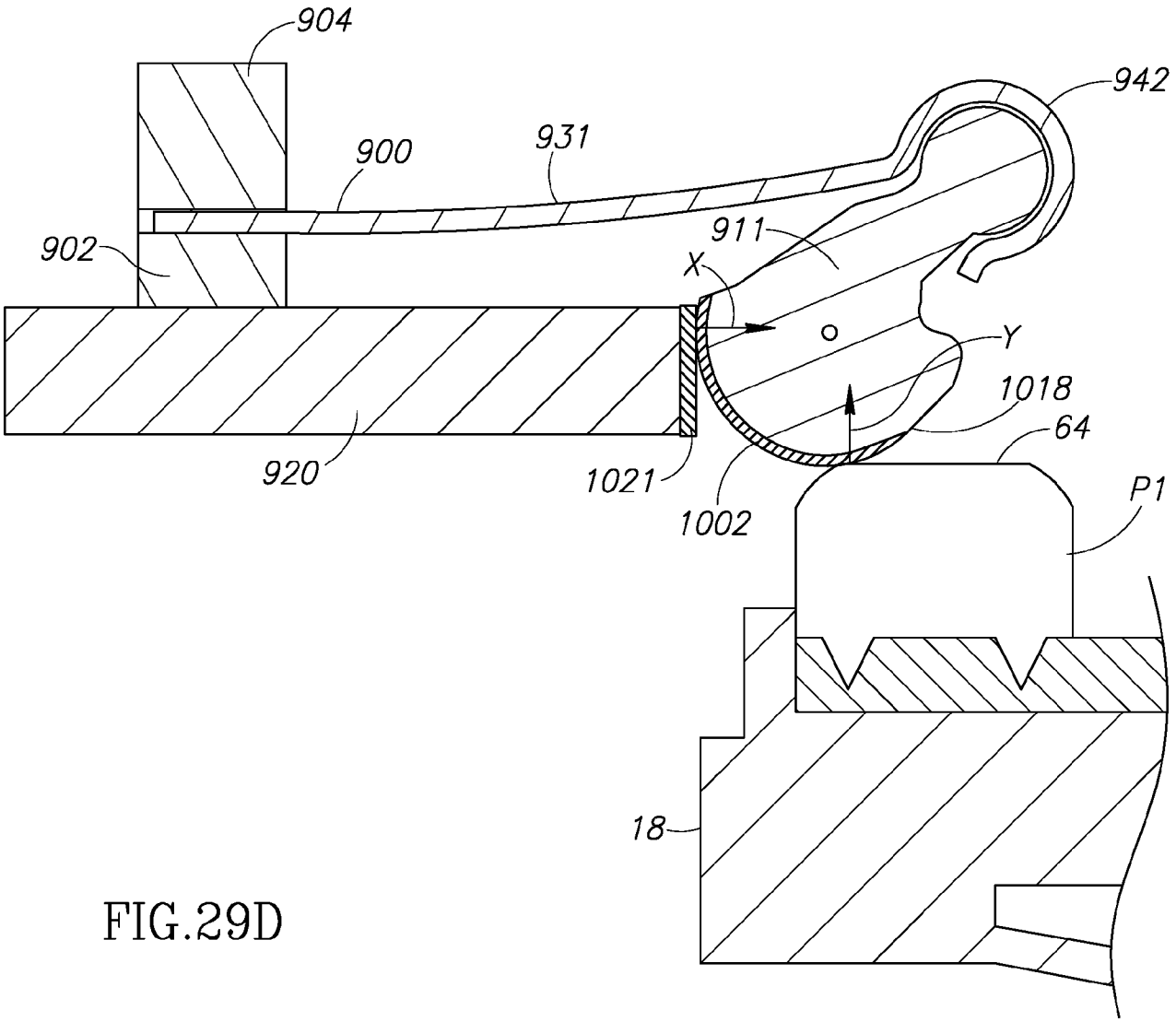
FIG. 29D is a longitudinal cross-sectional view of the selected components of FIG. 29A illustrated with the plug of FIG. 3 fully inserted into the communication outlet.

Referring to FIG. 29D, when the plug 18 is fully inserted into the outlet 800 (see FIGS. 20 and 21) and movement in the insertion direction has halted, the electrical contact 1002 is in contact with the upper surface 64 of the plug contact P1. At the same time, the electrical contact 1002 is in contact with the contact pad 1021. Thus, an electrical connection is formed between the plug contact P1 and the contact pad 1021. As mentioned above, the contact pad 1021 is connected to the wire contact 841 (see FIG. 22). Thus, an electrical connection is formed between the plug contact P1 and the wire contact 841. Simultaneously, electrical connections are formed between the plug contacts P2-P8 and the wire contacts 842-488.

Referring to FIG. 23, the spring arms 931-938 push the contact members 911-918 toward the plug contacts P1-P8 (see FIG. 3), and the plug contacts P1-P8 push the contact members 911-918 toward the contact pads 1021-1028. In this manner, the spring arms 931-938 and the plug contacts P1-P8 provide sufficient normal contact forces (e.g., in directions identified by arrows X and Y in FIG. 29D) to maintain the electrical connections between the contact pads 1021-1028 and the plug contacts P1-P8 (see FIG. 3). By way of a non-limiting example, the normal contact forces may be at least 100 grams in each of the directions identified by the arrows X and Y in FIG. 29D.

Referring to FIG. 21, like the other outlets described above, the outlet 800 omits the prior art long tine structures and decouples mechanical and electrical aspects of the design. In doing so, phase between first and subsequent compensation elements may be better tuned. For example, the phase of the outlet 800 may be maintained in a current phase quadrant allowing crosstalk cancelation to occur. Simulations have shown improvements in Return Loss due to better control of the conductors (e.g., circuit traces or transmission lines) formed on the substrates 920 and 854 compared to long metal tine structures. Simulations have also provided evidence of improved insertion loss due to more efficient crosstalk cancelation and improved Return Loss. While the various biasing members and contact assemblies discussed above have been described as being used to construct outlets, and particularly, RJ-type outlets, these structures could be used to construct other types of communication connectors and switches. For example, through application of the present teachings, one of ordinary skill in the art could construct a hermaphroditic connector or a switch component of a "switched" connector. In a switch embodiment, instead of the plug 18, a different structure (e.g., a rod) may be used to slide the biasing member and cause the electrical connection to be formed.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. A communication outlet for use with a communication plug comprising a plurality of plug contacts, the outlet comprising:

a plurality of contact pads;

a plurality of contact members each having an electrically conductive portion attached to an electrically non-conductive portion, the electrically non-conductive portion of each of the plurality of contact members comprising an engagement surface, the electrically conductive portion of each of the plurality of contact members forming an electrical connection with a different corresponding one of the plurality of contact pads, each of the plurality of contact members being movable with respect to the different corresponding contact pad, the plurality of contact members being movable with respect to the plurality of plug contacts; and a biasing member attached to the electrically non-conductive portion of each of the plurality of contact members, the biasing member being configured to bias the electrically conductive portion of each of the plurality of contact members toward a different corresponding one of the plurality of plug contacts when the plug is inserted into the outlet, the engagement surface of each of the plurality of contact members contacting the different corresponding plug contact when the plug is first inserted into the outlet and sliding along the different corresponding plug contact to position the electrically conductive portion of the contact member in contact with the different corresponding plug contact as the plug is inserted into the outlet.

2. The communication outlet of claim 1, wherein the biasing member deflects when the plug is inserted into the outlet allowing each of the plurality of contact members to slide along the different corresponding plug contact when the plug is inserted into the outlet.

3. The communication outlet of claim 1, wherein the biasing member biases the electrically conductive portion of each of the plurality of contact members toward the different corresponding plug contact such that the contact member applies a normal contact force of at least 100 grams to the different corresponding plug contact.

4. The communication outlet of claim 3, wherein the electrically conductive portion of each of the plurality of contact members applies a normal contact force of at least 100 grams to the different corresponding contact pad.

5. The communication outlet of claim 1, wherein the biasing member biases the electrically conductive portion of each of the plurality of contact members against the different corresponding contact pad to form the electrical connection therebetween.

6. The communication outlet of claim 5, wherein the electrically conductive portion of each of the plurality of contact members applies a normal contact force of at least 100 grams to the different corresponding contact pad.

7. An apparatus for use with a movable structure comprising a first electrical contact, the apparatus comprising:

a substrate with a second electrical contact; and a movable member comprising a third electrical contact, pressing the movable structure against the movable member moving the third electrical contact closer to the first electrical contact, the third electrical contact being in physical contact with the second electrical contact before the movable structure is pressed against the movable member, movement of the third electrical contact toward the first electrical contact halting after the third electrical contact is positioned in physical contact with both the first and second electrical contacts.

8. The apparatus of claim 7, further comprising a stop member configured to halt the movement of the third electrical contact toward the first electrical contact.

9. The apparatus of claim 7, wherein pressing the movable structure against the movable member moves the movable member toward the substrate thereby moving the third electrical contact closer to the first electrical contact, and the apparatus further comprises a stop member configured to halt the movement of the movable member caused by pressing the movable structure against the movable member.

10. The apparatus of claim 9, wherein the movable member comprises a biasing member that biases the third electrical contact into the physical contact with both the first and second electrical contacts when the movement of the movable member is halted by the stop member.

11. The apparatus of claim 7, wherein the movable member comprises a biasing member that biases the third electrical contact into the physical contact with both the first and second electrical contacts when the movement of the third electrical contact toward the first electrical contact is halted.

12. The apparatus of claim 11, wherein the third electrical contact is a layer of electrically conductive material plated on the biasing member.

13. The apparatus of claim 11, wherein the biasing member is an undulating spring.

14. The apparatus of claim 11, wherein the biasing member is a coil spring.

15. The apparatus of claim 7 for use with the movable structure being a communication plug, and the first electrical contact being a plug contact, the apparatus further comprising:

a housing defining an interior receptacle configured to house the substrate and the movable member, the plug being insertable inside the interior receptacle to press against the movable member to move the movable member toward the substrate thereby moving the third electrical contact closer to the first electrical contact.

16. The apparatus of claim 15, further comprising:

an insulation displacement connector coupled to the substrate; and an electrical connection connecting the insulation displacement connector to the second electrical contact.

17. The apparatus of claim 15, further comprising:

a pin coupled to an edge portion of the substrate; and an electrical connection connecting the pin to the second electrical contact.

18. The apparatus of claim 7, wherein the third electrical contact is a granule of electrically conductive material having a maximum dimension that is less than 19 millimeters.

19. The apparatus of claim 7, wherein the third electrical contact is a granule of electrically conductive material having a maximum dimension of approximately one millimeter.

20. The apparatus of claim 7, wherein the third electrical contact is a granule of electrically conductive material having a maximum dimension that is less than one quarter of a wavelength of a signal being conducted across the first, second, and third electrical contacts.

21. An apparatus for use with a movable structure comprising a first electrical contact, the apparatus comprising:

a substrate with a second electrical contact; and a movable member comprising a third electrical contact, pressing the movable structure against the movable member moving the third electrical contact closer to the first electrical contact, the third electrical contact being spaced apart from the second electrical contact before the movable structure is pressed against the movable member, pressing the movable structure against the movable member moving the third electrical contact into physical contact with the second electrical contact before the third electrical contact physically contacts the first electrical contact, movement of the third electrical contact toward the first electrical contact halting after the third electrical contact is positioned in physical contact with both the first and second electrical contacts.

22. The apparatus of claim 21, further comprising a stop member configured to halt the movement of the third electrical contact toward the first electrical contact.

23. The apparatus of claim 21, wherein pressing the movable structure against the movable member moves the movable member toward the substrate thereby moving the third electrical contact closer to the first electrical contact, and the apparatus further comprises a stop member configured to halt the movement of the movable member caused by pressing the movable structure against the movable member.

24. The apparatus of claim 23, wherein the movable member comprises a biasing member that biases the third electrical contact into the physical contact with both the first and second electrical contacts when the movement of the movable member is halted by the stop member.

25. The apparatus of claim 21, wherein the movable member comprises a biasing member that biases the third electrical contact into the physical contact with both the first and second electrical contacts when the movement of the third electrical contact toward the first electrical contact is halted.

26. The apparatus of claim 25, wherein the third electrical contact is a layer of electrically conductive material plated on the biasing member.

27. The apparatus of claim 25, wherein the biasing member is an undulating spring.

28. The apparatus of claim 25, wherein the biasing member is a coil spring.

29. The apparatus of claim 21 for use with the movable structure being a communication plug, and the first electrical contact being a plug contact, the apparatus further comprising:

a housing defining an interior receptacle configured to house the substrate and the movable member, the plug being insertable inside the interior receptacle to press against the movable member to move the movable member toward the substrate thereby moving the third electrical contact closer to the first electrical contact.

30. The apparatus of claim 29, further comprising:

an insulation displacement connector coupled to the substrate; and an electrical connection connecting the insulation displacement connector to the second electrical contact.

31. The apparatus of claim 29, further comprising:

a pin coupled to an edge portion of the substrate; and an electrical connection connecting the pin to the second electrical contact.

32. The apparatus of claim 21, wherein the third electrical contact is a granule of electrically conductive material having a maximum dimension that is less than 19 millimeters.

33. The apparatus of claim 21, wherein the third electrical contact is a granule of electrically conductive material having a maximum dimension of approximately one millimeter.

34. The apparatus of claim 21, wherein the third electrical contact is a granule of electrically conductive material having a maximum dimension that is less than one quarter of a wavelength of a signal being conducted across the first, second, and third electrical contacts.

* * * * *